US009427965B2

(12) United States Patent
Togashi

(10) Patent No.: US 9,427,965 B2
(45) Date of Patent: Aug. 30, 2016

(54) LIQUID EJECTING HEAD AND LIQUID EJECTING APPARATUS

(71) Applicant: SEIKO EPSON CORPORATION, Tokyo (JP)

(72) Inventor: Isamu Togashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/659,285

(22) Filed: Mar. 16, 2015

(65) Prior Publication Data

US 2015/0258787 A1 Sep. 17, 2015

(30) Foreign Application Priority Data

Mar. 17, 2014 (JP) ..... 2014-053653

(51) Int. Cl.
*B41J 2/14* (2006.01)

(52) U.S. Cl.
CPC ... *B41J 2/14233* (2013.01); *B41J 2002/14362* (2013.01); *B41J 2002/14419* (2013.01)

(58) Field of Classification Search
CPC ..... B41J 2/14233; B41J 2002/14362; B41J 2002/14419
USPC ..... 347/47
See application file for complete search history.

(56) References Cited

U.S. PATENT DOCUMENTS 4,905,017 A * 2/1990 Sugitani et al. ..... 347/65
6,250,738 B1 * 6/2001 Waller ..... B41J 2/14024 347/13
7,222,937 B2 5/2007 Brookfield et al.
2002/0033861 A1 * 3/2002 Boyd et al. ..... 347/42
2004/0263583 A1 * 12/2004 Kanada ..... B41J 2/14209 347/71
2005/0151783 A1 * 7/2005 Brookfield et al. ..... 347/40
2007/0229596 A1 10/2007 Chikamoto et al.
2010/0073433 A1 3/2010 Shimizu et al.

FOREIGN PATENT DOCUMENTS

| | | |
|---|---|---|
| EP | 2 529 934 | 12/2012 |
| JP | 2005-193680 | 7/2005 |
| JP | 2006-068944 | 3/2006 |
| JP | 2012-171255 | 9/2012 |
| JP | 2013-132848 | 7/2013 |
| WO | 2011/046539 | 4/2011 |

OTHER PUBLICATIONS

European Search Report for Application No. 15159279.7 dated Jul. 22, 2015.

* cited by examiner

*Primary Examiner* — Erica Lin
*Assistant Examiner* — Alexander D Shenderov
(74) *Attorney, Agent, or Firm* — Workman Nydegger

(57) ABSTRACT

Provided is a liquid ejecting head which includes a head main body which ejects ink from a liquid ejection surface and has a plurality of manifolds which store the ink, and a flow-path member in which a first distribution flow path and a second distribution flow path is provided to supply ink to the head main body, in which the plurality of manifolds are arranged on the same plane and the plurality of manifolds, the first distribution flow path, and the second distribution flow path are not disposed in the same plane.

18 Claims, 23 Drawing Sheets

LIQUID EJECTING HEAD AND LIQUID EJECTING APPARATUS

CROSS REFERENCES TO RELATED APPLICATIONS

This application claims priority to Japanese Patent Application No. 2014-053653 filed on Mar. 17, 2014. The entire disclosure of Japanese Patent Application No. 2014-053653 is hereby incorporated herein by reference.

BACKGROUND

1. Technical Field

The present invention relates to a liquid ejecting head and a liquid ejecting apparatus and, particularly, relates to an ink jet type recording head which ejects ink as liquid and an ink jet type recording apparatus.

2. Related Art

An ink jet type recording head which includes a head main body in which a pressure generation chamber communicating with a nozzle opening through which ink droplets are discharged is deformed by a pressure generation unit, such as a piezoelectric element, in such a manner that an ink droplet is discharged through the nozzle opening and a flow-path member which constitutes a flow path of ink supplied to the head main body is known as a liquid ejecting head.

The head main body is connected to the flow-path member. Ink is supplied from the flow path to the head main body or ink is discharged from the head main body to the flow path. An ink jet type recording head in which a plurality of nozzle opening groups, each of which is constituted of a plurality of nozzle openings and ejects the same ink, are provided in one head main body and a flow-path member having a plurality of flow paths through which different inks are supplied to respective nozzle opening groups are provided has been proposed (see JP-A-2005-193680, for example).

In the ink jet type recording head according to JP-A-2005-193680, a manifold in common to the nozzle openings constituting the nozzle opening group is formed. A plurality of manifolds are provided corresponding to the number of the nozzle opening groups. The plurality of manifolds are arranged in a state where the manifolds overlap in a direction perpendicular to a liquid ejection surface in which the nozzle openings are provided. Accordingly, the plane-direction size of the liquid ejection surface can be reduced, compared to in the case where all of the manifolds are arranged in the same plane.

However, when the plurality of manifolds overlap each other in the direction perpendicular to the liquid ejection surface, the plurality of manifolds are located at different positions in the direction perpendicular to the liquid ejection surface. As a result, the position of each manifold in relation to the liquid ejection surface is different for each nozzle opening group. Furthermore, the length of a flow path from the manifold to the nozzle opening group is different for each nozzle opening group, and thus flow-path resistance is different. Furthermore, the weight of ink droplets ejected from the nozzle opening group is different for each nozzle opening group.

When the plurality of manifolds are located at different positions in the direction perpendicular to the liquid ejection surface, as described above, variation in ejection properties of the ink ejected from each manifold occurs.

Such a problem is not limited to an ink jet type recording head which discharges ink but is shared by a liquid ejecting head and a liquid ejecting apparatus which eject liquid other than ink.

SUMMARY

An advantage of some aspects of the invention is to provide a liquid ejecting head of which the size is reduced and in which variation in ejection properties of liquid ejected from a plurality of manifolds can be reduced, and a liquid ejecting apparatus.

Aspect 1

According to an aspect of the invention for solving the problem described above, there is provided a liquid ejecting head which includes a head main body which ejects liquid from a liquid ejection surface and has a plurality of manifolds which store the liquid, and a flow-path member in which a first distribution flow path and a second distribution flow path are provided to supply liquid to the head main body, in which the plurality of manifolds are arranged on the same plane and the plurality of manifolds, the first distribution flow path, and the second distribution flow path are not disposed in the same plane.

In the aspect, the size of the flow-path member can be reduced in an in-plane direction parallel to the liquid ejection surface, compared to in the case where the first distribution flow path and the second distribution flow path are formed in the same plane. Furthermore, in one head main body, the plurality of manifolds are arranged in the same plane. Thus, the positions of respective manifolds can be aligned in the direction perpendicular to the liquid ejection surface. Accordingly, in different manifolds, the lengths of the flow paths from respective manifolds to the nozzle openings are set to be values which are as similar as possible. As a result, variation in flow-path resistance can be reduced. In other words, variation in the pressure of liquid in the manifold can be reduced, and thus it is easy to manage back-pressure control. In the case of the manifold of the related art, the size thereof can be reduced. However, liquid ejection properties are deteriorated. However, according to the liquid ejecting head of the invention, the first distribution flow path and the second distribution flow path are not formed in the same plane in the flow-path member, in such a manner that the size thereof can be reduced. In addition, the manifolds are provided in the same plane in the head main body, in such a manner that the liquid ejection properties can be improved. The liquid ejecting head according to the invention can achieve a reduction in the size and improvement in the liquid ejection properties, as described above. In addition, the plurality of manifolds, the first distribution flow path, and the second distribution flow path are not disposed in the same plane. Accordingly, in both the first distribution flow path and the second distribution flow path, flow paths allowing air bubbles to be effectively discharged can be provided in portions between the distribution flow paths and the manifolds in the direction perpendicular to the liquid ejection surface.

Aspect 2

In the liquid ejecting head according to Aspect 1, it is preferable that at least parts of the first distribution flow path and the second distribution flow path overlap when viewed from a direction perpendicular to the liquid ejection surface. In the aspect, the first distribution flow path and the second distribution flow path overlap in the direction perpendicular to the liquid ejection surface, and thus the size of the first distribution flow path and the second distribution flow path can be reduced in the in-plane direction of the liquid ejection surface, compared to in the case where the distribution flow paths do not overlap. As a result, the size of the liquid ejecting head can be reduced in the in-plane direction of the liquid ejecting surface.

Aspect 3

In the liquid ejecting head according to Aspect 1 or 2, it is preferable that the liquid ejecting head further include a first introduction flow path which communicates with the first distribution flow path, and a second introduction flow path which communicates with the second distribution flow path. Furthermore, it is preferable that the first introduction flow path and the second introduction flow path extend to a side opposite to the head main body, in a direction perpendicular to the liquid ejection surface. In addition, it is preferable that a boundary portion between the first distribution flow path and the first introduction flow path and a boundary portion between the second distribution flow path and the second introduction flow path be disposed on an inner portion between the plurality of manifolds, in the a direction in which ink flows in the first distribution flow path and the second distribution flow path. In the aspect, it is not necessary to arrange the boundary portions outside the manifolds. As a result, the size of the liquid ejecting head can be reduced.

Aspect 4

In the liquid ejecting head according to Aspect 3, it is preferable that, in a direction perpendicular to the liquid ejection surface, the first distribution flow path be disposed closer to the head main body than the second introduction flow path. In addition, it is preferable that the second distribution flow path be formed in a state where the second distribution flow path makes a detour in order to avoid the first introduction flow path. In the aspect, the second distribution flow path is formed in a state where the second distribution flow path makes a detour in order to avoid the first introduction flow path. As a result, the degree of freedom in the arrangement of the first introduction flow path is increased.

Aspect 5

In the liquid ejecting head according to any one of Aspects 1 to 4, it is preferable that the flow-path member be formed by stacking a first flow-path member, a second flow-path member, and a third flow-path member, in the direction perpendicular to the liquid ejection surface, in order, far away from the head main body. Furthermore, it is preferable that the first distribution flow path be formed in a boundary between the second flow-path member and the third flow-path member. In addition, it is preferable that the second distribution flow path be formed in a boundary between the first flow-path member and the second flow-path member. In the aspect, the first distribution flow path and the second distribution flow path can be formed by at least three members. As a result, the number of parts can be reduced.

Aspect 6

In the liquid ejecting head according to any one of Aspects 1 to 5, it is preferable that the direction in which liquid flows in the manifold intersect a direction in which liquid flows in the first distribution flow path and the second distribution flow path. In this aspect, liquid can be effectively supplied over the entirety of the flow-path member when the flow-path member is viewed from the top, compared to in the case where the direction in which liquid flows in the manifold is parallel to the direction in which liquid flows in the first distribution flow path and the second distribution flow path. Furthermore, the size of the distribution flow path can be reduced.

Aspect 7

In the liquid ejecting head according to any one of Aspects 1 to 6, it is preferable that a nozzle row constituted of a plurality of nozzle openings which are aligned in one direction and through which liquid is ejected be provided in the liquid ejection surface. In addition, it is preferable that the manifold extend in the one direction. Furthermore, it is preferable that a vertical flow path extending in a direction perpendicular to the liquid ejection surface allow the manifold to communicate with the first distribution flow path and the second distribution flow path. In the aspect, the size of the flow-path member can be reduced when the flow-path member is viewed from the top. In addition, it is possible to easily adjust a gap between the first distribution flow path and the manifold and a gap between the second distribution flow path and the manifold, in the direction perpendicular to the liquid ejection surface.

Aspect 8

In the liquid ejecting head according to any one of Aspects 1 to 7, it is preferable that the liquid ejecting head further include a plurality of head main bodies. In addition, it is preferable that the flow-path member include first connection portions and second connection portions which are connected to respective head main bodies, first bifurcation flow paths which allow the first distribution flow paths to be connected to respective first connection portions, and second bifurcation flow paths which allow the second distribution flow paths to be connected to respective second connection portions. In the aspect, it is possible to provide flow paths which communicate with the plurality of connection portions through the first bifurcation flow path and the second bifurcation flow path which branch off from the first distribution flow path and the second distribution flow path. As a result, flow paths through which liquid is supplied to the plurality of head main bodies can be reliably formed in a small space. Furthermore, since the bifurcation flow paths are provided, the positional relationship of the connection portions in a plane, in relation to the distribution flow paths, can be set with a high degree of freedom. As a result, the degree of freedom in the layout is increased.

Aspect 9

In the liquid ejecting head according to Aspect 8, it is preferable that the first distribution flow path and the first bifurcation flow path be formed in the same plane. Furthermore, it is preferable that the second distribution flow path and the second bifurcation flow path be formed in the same plane. In the aspect, the first distribution flow path, the second distribution flow path, and the bifurcation flow path can be formed in a common member.

Aspect 10

In the liquid ejecting head according to Aspect 8 or 9, it is preferable that the first connection portion and the second connection portion be connected to a common head main body. In the aspect, different liquids can be supplied to one head main body through the plurality of flow paths.

Aspect 11

In the liquid ejecting head according to any one of Aspects 8 to 10, it is preferable that the liquid ejecting head further include flexible wiring substrates which are respectively connected to the head main bodies. In addition, it is preferable that the flexible wiring substrates extend to the flow-path member side with respect to the head main bodies. Furthermore, it is preferable that the first connection portions and the second connection portions be connected to the head main bodies with the flexible wiring substrates interposed therebetween. In the aspect, it is easy to connect the flexible wiring substrate and a terminal (such as a lead electrode of a pressure generation unit) in the head main body to which the flexible wiring substrate is connected.

Aspect 12

In the liquid ejecting head according to any one of Aspects 8 to 11, it is preferable that the first connection portions and the second connection portions be alternately connected to the head main bodies aligned in a direction in which the first distribution flow path and the second distribution flow path extend. In the aspect, a plurality of different liquids can be supplied to the respective head main bodies.

Aspect 13

In the liquid ejecting head according to any one of Aspects 8 to 12, it is preferable that the liquid ejecting head further include a relay substrate to which the flexible wiring substrate is connected. In addition, it is preferable that the flow-path member be provided in a portion between the relay substrate and the head main bodies, in a direction in which the flexible wiring substrate extends to the flow-path member side with respect to the head main body. In the aspect, the distribution flow path can be formed in a portion outside the area in which the flexible wiring substrate is disposed. As a result, the size of the flow-path member can be reduced.

Aspect 14

In the liquid ejecting head according to any one of Aspects 8 to 13, it is preferable that the head main body have the manifold which extends in one direction along an end portion of the flexible wiring substrate, which is the end portion bonded to the head main body, and which stores liquid supplied to the head main body. Furthermore, it is preferable that the first connection portions and the second connection portions be disposed in a portion between one of both ends of the manifold, which is the end far away, in the one direction, from the distribution flow path, and the distribution flow path. In the aspect, liquid can be supplied, in one direction, by the manifold. Thus, it is not necessary to dispose the connection portion on a side far away from the distribution flow path. As a result, the layout is facilitated.

Aspect 15

In the liquid ejecting head according to any one of Aspects 8 to 14, it is preferable that the first distribution flow path be located closer to the head main body side in a direction perpendicular to the liquid ejection surface than the second distribution flow path. Furthermore, it is preferable that the flexible wiring substrate be constituted of one end portion which is located, in a direction perpendicular to the liquid ejection surface, close to the head main body and the other end portion which is located far away from the head main body. In addition, it is preferable that the plane-direction width of the other end portion be smaller than that of the one end portion. Furthermore, it is preferable that the second distribution flow path be formed in the flow-path member, in a state where the second distribution flow path passes through an area outside the other end portion in the plane direction. In the aspect, an area in which the second distribution flow path is formed can be provided outside the flexible wiring substrate, in the plane direction (which is a direction parallel to the surface) of the flexible wiring substrate. As a result, the degree of freedom in the arrangement of the second flow path is further increased in the flow-path member.

Aspect 16

In the liquid ejecting head according to any one of Aspects 8 to 15, it is preferable that all of the flexible wiring substrates connected to the head main bodies, each of which communicates with one of the first distribution flow paths and the second distribution flow paths overlap when viewed from a direction in which liquid flows in the first distribution flow path or the second distribution flow path. In the aspect, the first distribution flow path or the second distribution flow path can extend in a straight line shape, in a direction in which liquid flows. As a result, it is possible to ensure the minimum width of the first distribution flow path or the second distribution flow path in a direction intersecting the direction in which liquid flows.

Aspect 17

In the liquid ejecting head according to any one of Aspects 8 to 16, it is preferable that the first distribution flow path be located further on the head main body side in a direction perpendicular to the liquid ejection surface than the second distribution flow path. In addition, it is preferable that nozzle rows constituted of nozzle openings which are aligned in one direction and through which liquid is ejected be provided in the liquid ejection surface of the head main body. In addition, it is preferable that the one direction in which the nozzle rows are aligned intersect a transporting direction of an ejection target medium onto which liquid is ejected by the head main body. In addition, it is preferable that the first distribution flow path include a first upstream-side distribution flow path and a first downstream-side distribution flow path which are disposed on both sides of the head main body in the transporting direction. It is preferable that the second distribution flow path include a second upstream-side distribution flow path and a second downstream-side distribution flow path which are disposed on both sides of the head main body in the transporting direction. Furthermore, it is preferable that the positions of the first upstream distribution flow path, the first downstream-side distribution flow path, the second upstream-side distribution flow path, and the second downstream-side distribution flow path, in relation to the flexible wiring substrates, be common to all of the head main bodies. In the aspect, the head main bodies are aligned, in such a manner that, even when a specific nozzle row of the head main body is not extended, a line constituted of nozzle openings aligned in the alignment direction can be formed.

Aspect 18

According to another aspect of the invention, there is provided a liquid ejecting apparatus which includes the liquid ejecting head according to any one of Aspects 1 to 17.

In the aspect, it is possible to provide a liquid ejecting apparatus having a liquid ejecting head of which the size is reduced and in which variation in the ejection properties of liquid ejected from the plurality of manifolds can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Figure 1:
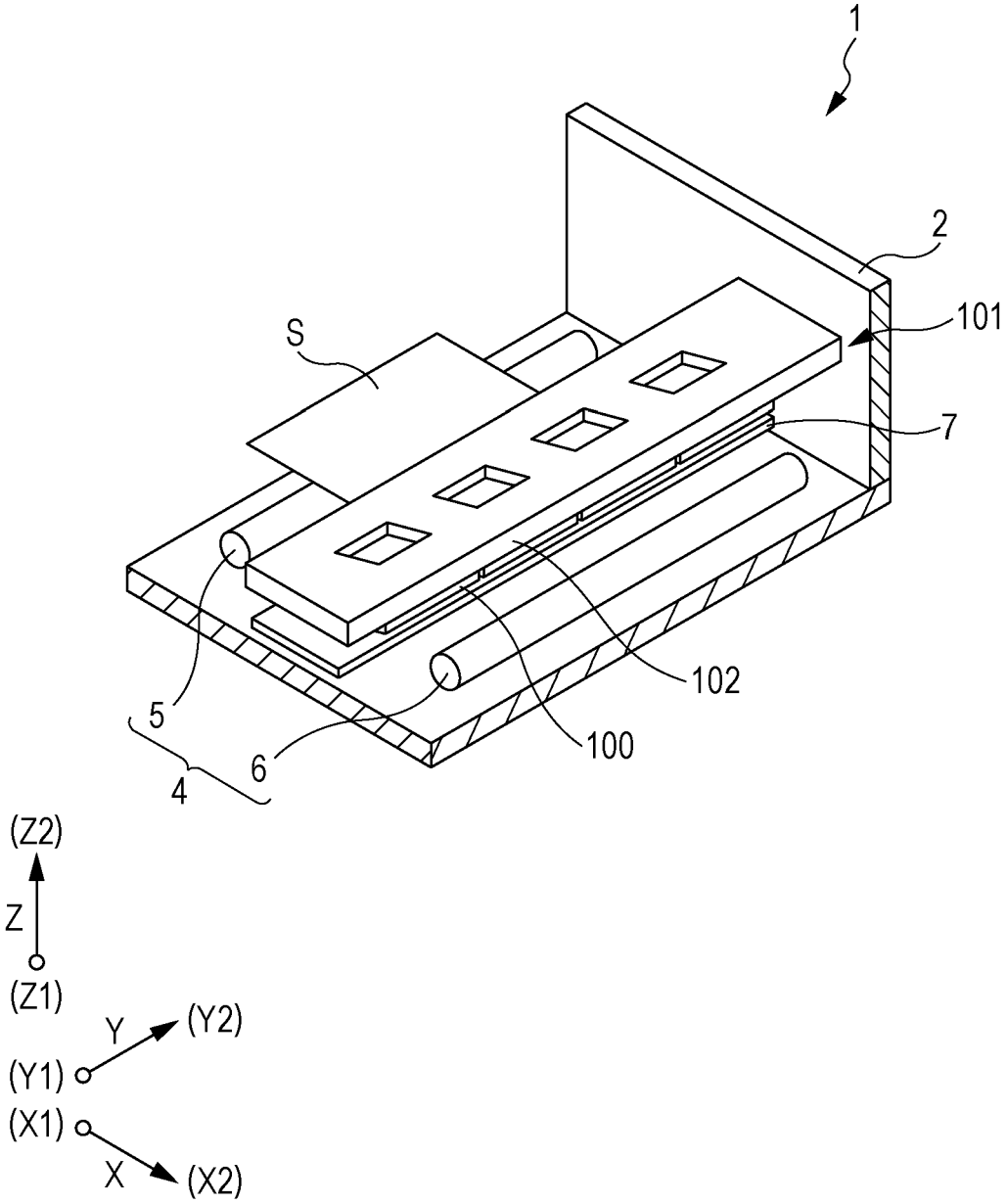
FIG. 1 is a schematic perspective view of a recording apparatus according to Embodiment 1 of the invention.

Details of embodiments of the invention will be described. An ink jet type recording head is an example of a liquid ejecting head and is also referred to simply as a recording head. An ink jet type recording unit is an example of a liquid ejecting head unit and is also referred to simply as a head unit. An ink jet type recording apparatus is an example of a liquid ejecting apparatus. FIG. 1 is a perspective view illustrating the schematic configuration of an ink jet type recording apparatus according to this embodiment.

An ink jet type recording apparatus 1 is a so-called line type recording apparatus, as illustrated in FIG. 1. The ink jet type recording apparatus 1 includes a head unit 101. In the ink jet type recording apparatus 1, a recording sheet S, such as a paper sheet as an ejection target medium, is transported, in such a manner that printing is performed.

Specifically, the ink jet type recording apparatus 1 includes an apparatus main body 2, the head unit 101, a transport unit 4, and a support member 7. The head unit 101 has a plurality of recording heads 100. The transport unit 4 transports the recording sheet S. The support member 7 supports the recording sheet S facing the head unit 101. In this embodiment, a transporting direction of the recording sheet S is set to an X direction. In a liquid ejection surface of the head unit 101, in which nozzle openings are provided, a direction perpendicular to the X direction is set to a Y direction. A direction perpendicular to both the X direction and the Y direction is set to a Z direction. In the X direction, an upstream direction in which the recording sheet S is transported is set to an X1 direction and a downstream direction is set to an X2 direction. In the Y direction, one direction is set to a Y1 direction and the other is set to a Y2 direction. In the Z direction, a direction (toward the recording sheet S) parallel to a liquid ejecting direction is set to a Z1 direction and an opposite direction is set to a Z2 direction.

The head unit 101 includes a plurality of recording heads 100 and a head fixing substrate 102 which holds a plurality of recording heads 100.

The plurality of recording heads 100 is fixed to the head fixing substrate 102, in a state where the recording heads 100 are aligned in the Y direction intersecting the X direction which is the transporting direction. In this embodiment, the plurality of recording heads 100 are aligned in a straight line extending in the Y direction. In other words, the plurality of recording heads 100 are arranged so as not to be shifted toward the X direction. Accordingly, the X-direction width of head unit 101 is reduced, and thus it is possible to reduce the size of the head unit 101.

The head fixing substrate 102 holds the plurality of recording heads 100, in a state where the nozzle openings of the plurality of recording heads 100 are directed to the recording sheet S. The head fixing substrate 102 holds a plurality of the recording heads 100 and is fixed to the apparatus main body 2.

The transport unit 4 transports the recording sheet S in the X direction, with respect to the head unit 101. The transport unit 4 includes a first transport roller 5 and a second transport roller 6 which are provided, in relation with the head unit 101, for example, on both sides in the X direction as the transporting direction of the recording sheet S. The recording sheet S is transported, in the X direction, by the first transport roller 5 and the second transport roller 6. The transport unit 4 for transporting the recording sheet S is not limited to a transport roller. The transport unit 4 may be constituted of a belt, a drum, or the like.

The support member 7 supports the recording sheet S transported by the transport unit 4, at a position facing the head unit 101. The support member 7 is constituted of, for example, a metal member or a resin member of which the cross-sectional surface has a rectangular shape. The support member 7 is disposed in an area between the first transport roller 5 and the second transport roller 6, in a state where the support member 7 faces the head unit 101.

An adhesion unit which is provided in the support member 7 and causes the recording sheet S to adhere thereto may be provided in the support member 7. Examples of the adhesion unit include a unit which causes the recording sheet S to adhere thereto by sucking up the recording sheet S and a unit which causes the recording sheet S to be adhered thereto by electrostatically attracting the recording sheet S using electrostatic force. Furthermore, when the transport unit 4 is constituted of a belt or a drum, the support member 7 is located at a position facing the head unit 101 and causes the recording sheet S to be supported on the belt or the drum.

Although not illustrated, a liquid storage unit, such as an ink tank and an ink cartridge in which ink is stored, is connected to each recording head 100 of the head unit 101, in a state where the liquid storage unit can supply ink to the recording head 100. The liquid storage unit may be held on, for example, the head unit 101. Alternatively, in the apparatus main body 2, the liquid storage unit is held at a position separate from the head unit 101. A flow path and the like through which the ink supplied from the liquid storage unit is supplied to the recording head 100 may be provided in the inner portion of the head fixing substrate 102. Alternatively, an ink flow-path may be provided in the head fixing substrate 102 and ink from the liquid storage unit may be supplied to the recording head 100 through the ink flow-path member. Needless to say, ink may be directly supplied from the liquid storage unit to the recording head 100, without passing through the head fixing substrate 102 or the ink flow-path member fixed to the head fixing substrate 102.

In such an ink jet type recording apparatus 1, the recording sheet S is transported, in the X direction, by the first transport roller 5, and then the head unit 101 performs printing on the recording sheet S supported on the support member 7. The recording sheet S subjected to printing is transported, in the X direction, by the second transport roller 6.

Figure 2:
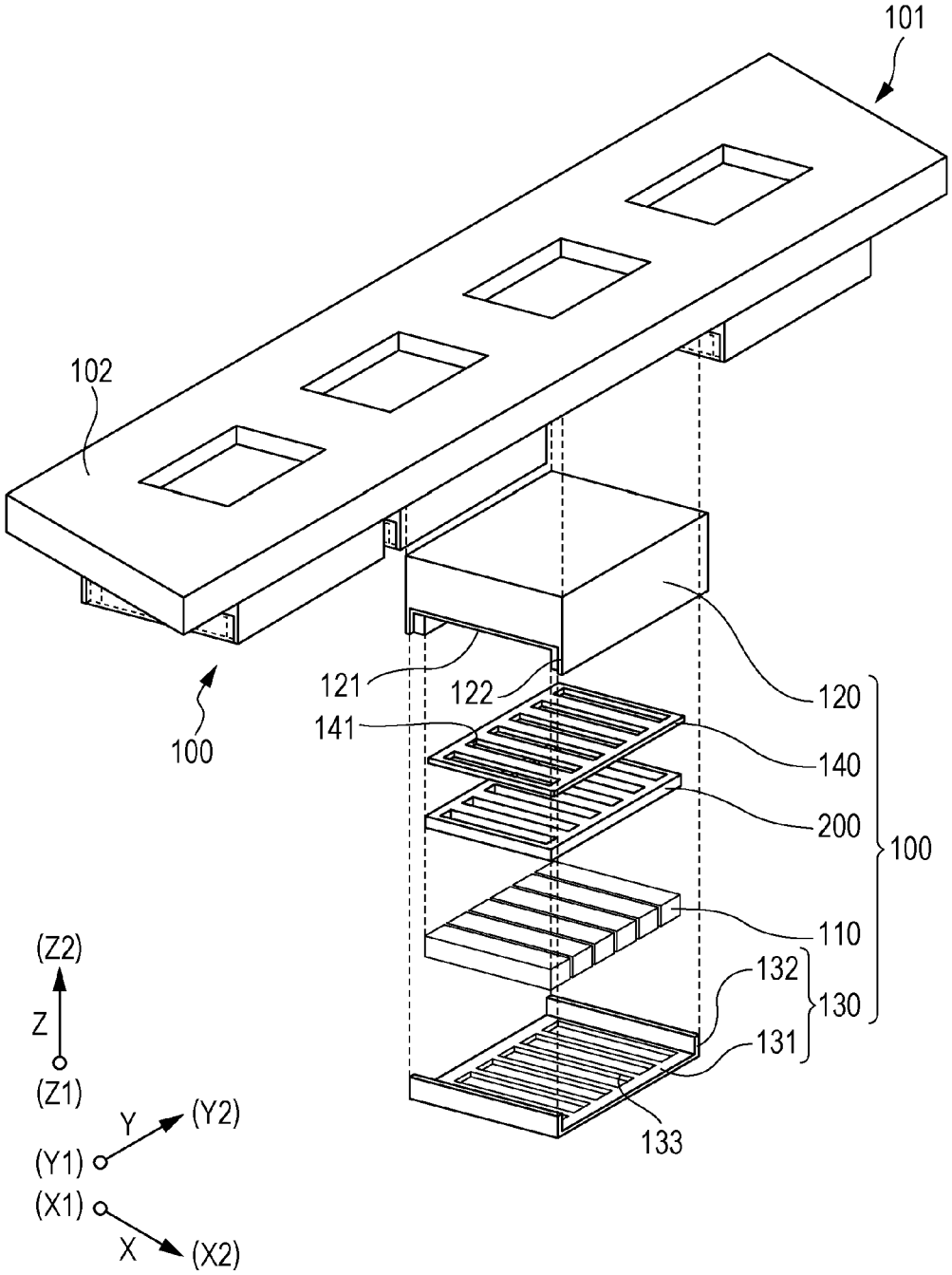
FIG. 2 is an exploded perspective view of a head unit according to Embodiment 1 of the invention.
Figure 3:
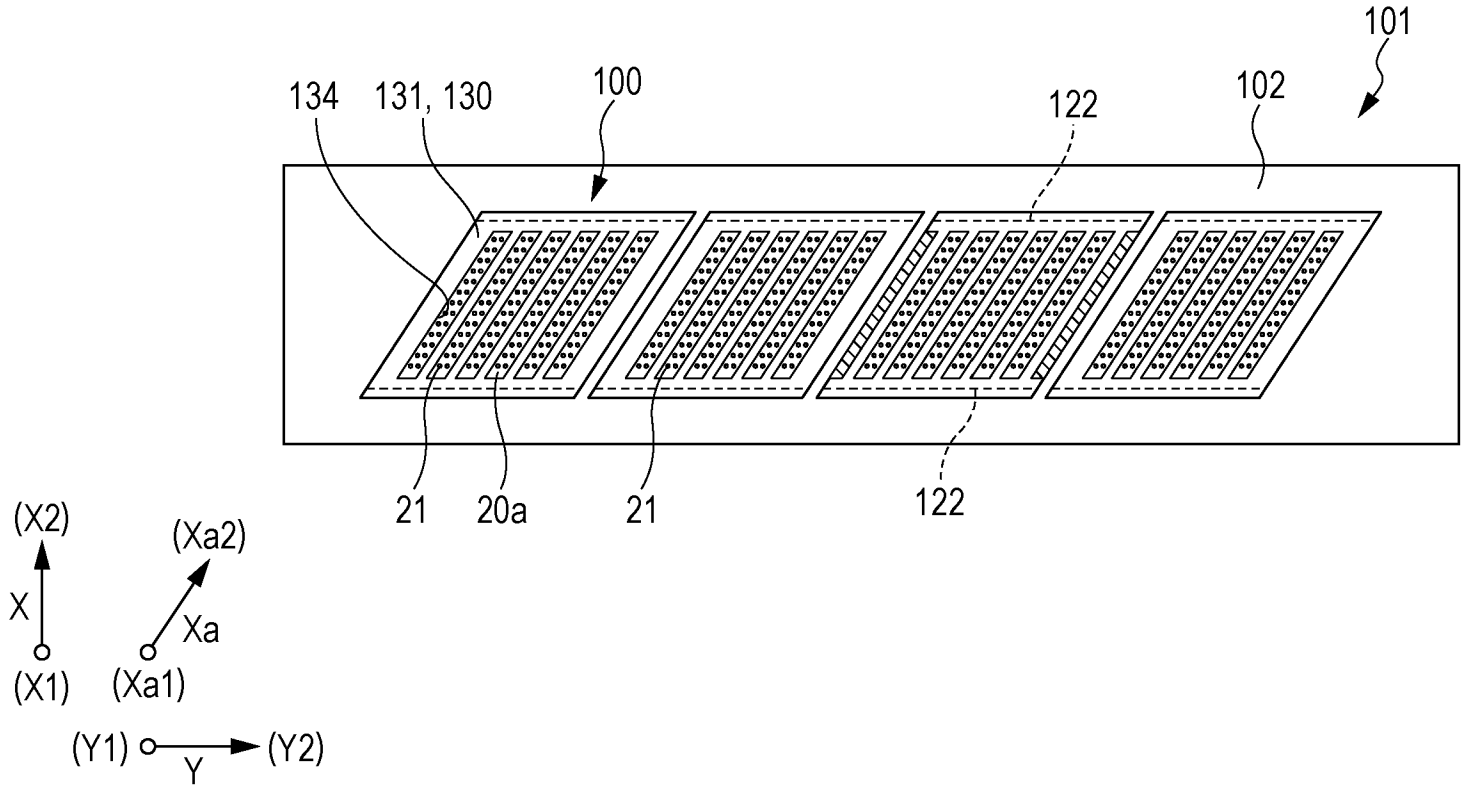
FIG. 3 is a bottom view of the head unit according to Embodiment 1 of the invention.

Details of the head unit 101 will be described with reference to FIGS. 2 and 3. FIG. 2 is an exploded perspective view illustrating the head unit according to this embodiment and FIG. 3 is a bottom view of the head unit, when viewed from the liquid ejection surface side.

The head unit 101 of this embodiment includes a plurality of recording heads 100 and the head fixing substrate 102 which holds the plurality of recording heads 100. In the recording head 100, a liquid ejection surface 20*a* in which the nozzle openings 21 are formed is provided on the Z1 side in the Z direction. Each recording head 100 is fixed to a surface of the head fixing substrate 102, which is the surface facing the recording sheet S. In other words, the recording head 100 is fixed to the Z1 side, that is, the side facing the recording sheet S, of the head fixing substrate 102 in the Z direction.

As described above, the plurality of recording heads 100 are fixed to the head fixing substrate 102, in a state where the recording heads 100 are aligned in a straight line extending in the Y direction perpendicular to the X direction which is the transporting direction. In other words, the plurality of recording heads 100 are arranged so as not to be shifted toward the X direction. Accordingly, the X-direction width of the head unit 101 is reduced, and thus it is possible to reduce the size of the head unit 101. Needless to say, the recording heads 100 aligned in the Y direction may be arranged so as to be shifted toward the X direction. However, in this case, when the recording heads 100 are greatly shifted toward the X direction, for example, the X-direction width of the head fixing substrate 102 increases. When the X-direction size of the head unit 101 increases, as described above, the X-directional distance between the first transport roller 5 and the second transport roller 6 increases in the ink jet type recording apparatus 1. As a result, it is difficult to fix the posture of the recording sheet S. In addition, the size of the head unit 101 and the ink jet type recording apparatus 1 increases.

In this embodiment, four recording heads 100 are fixed to the head fixing substrate 102. However, the configuration is not limited thereto, as long as the number of recording heads 100 is two or more.

Figure 4:
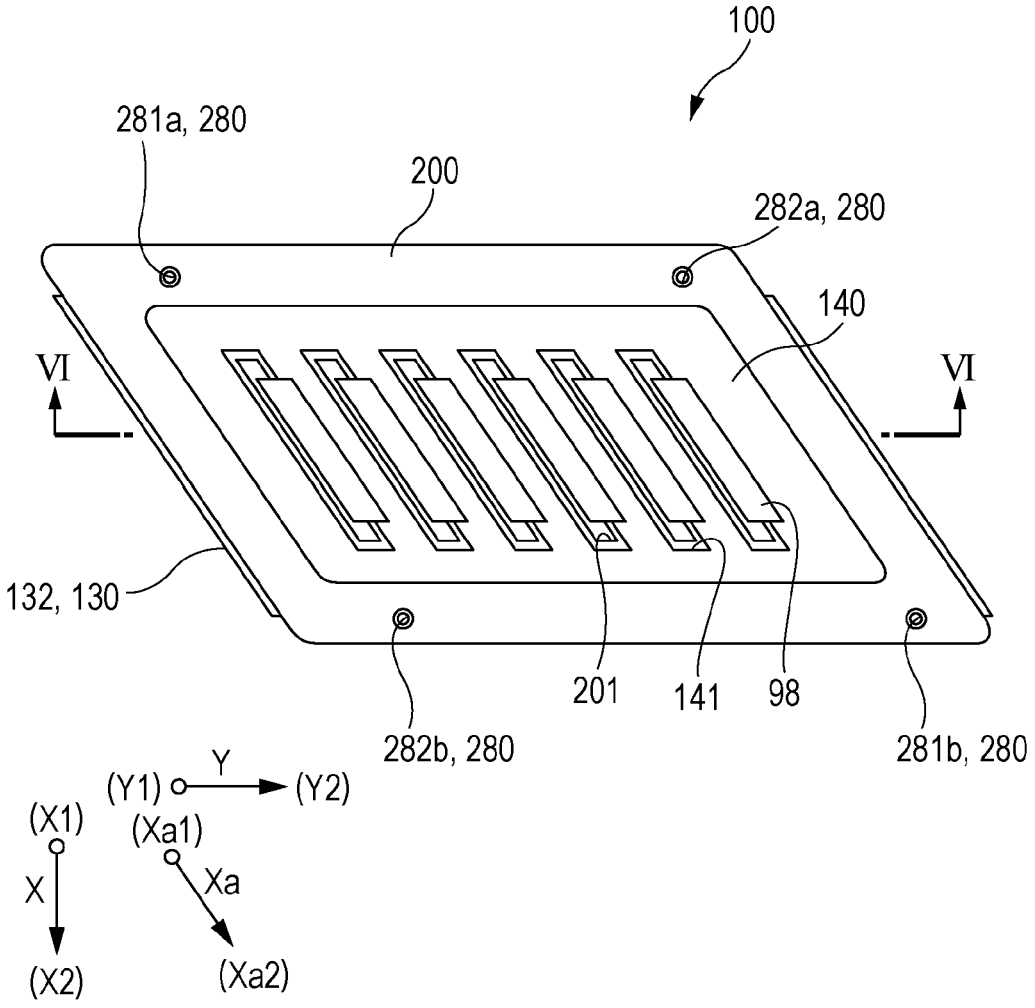
FIG. 4 is a plan view of a recording head according to Embodiment 1 of the invention.
Figure 5:
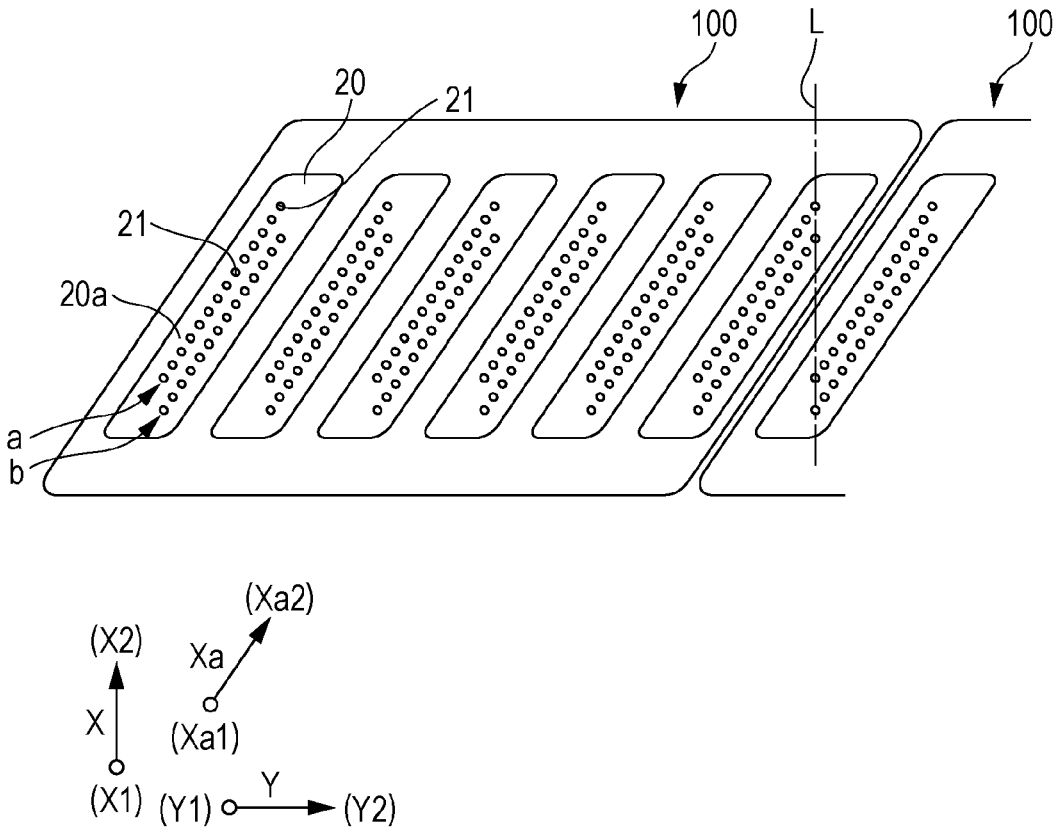
FIG. 5 is a bottom view of the recording head according to Embodiment 1 of the invention.
Figure 6:
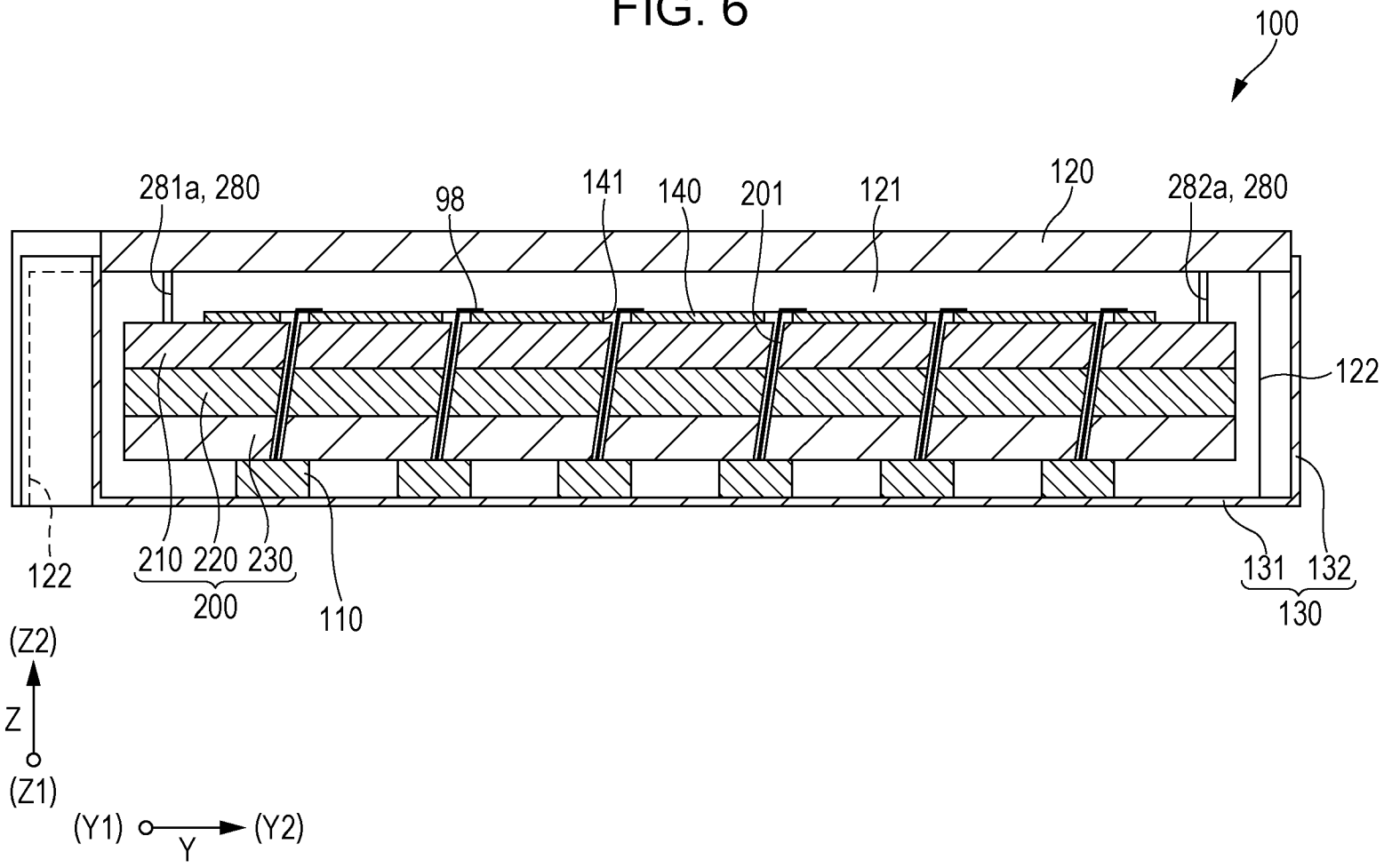
FIG. 6 is a cross-sectional view of FIG. 4, taken along line VI-VI.

Next, the recording head 100 will be described with reference to FIG. 2 and FIGS. 4 to 6. FIG. 4 is a plan view of the recording head and FIG. 5 is a bottom view of the recording head. FIG. 6 is a cross-sectional view of FIG. 4, taken along a line VI-VI. FIG. 4 is a plan view of the recording head 100, when viewed from the Z2 side in the Z direction. A holding member 120 is not illustrated in FIG. 4.

The recording head 100 includes the plurality of head main bodies 110, COF substrates 98, and a flow-path member 200. The COF substrates 98 are respectively connected to the head main bodies 110. Flow paths through which ink is supplied to respective head main bodies 110 are provided in the flow-path member 200. Furthermore, in this embodiment, the recording head 100 includes the holding member 120, a fixing plate 130, and a relay substrate 140. The holding member 120 holds the plurality of head main bodies 110. The fixing plate 130 is provided on the liquid ejection surface 20*a* side of the head main body 110.

The head main body 110 receives ink from the holding member 120 and the flow-path member 200 in which ink flow paths are provided. Control signals are transmitted from a controller (not illustrated) in the ink jet type recording apparatus 1 to the head main body 110, via both the relay substrate 140 and the COF substrate 98, and the head main body 110 discharges ink droplets in accordance with the control signals. Details of the configuration of the head main body 110 will be described below.

In each head main body 110, the liquid ejection surface 20*a* in which nozzle openings 21 are formed is provided on the Z1 side in the Z direction. Z2 sides of the plurality of head main bodies 110 adhere to the Z1-side surface of the flow-path member 200.

Flow paths of ink supplied to the head main body 110 are provided in the flow-path member 200. The plurality of head main bodies 110 adhere to the Z1-side surface of the flow-path member 200, in a state where the plurality of head main bodies 110 are aligned in the Y direction. Details of the configuration of the flow-path member 200 will be described below. The flow paths in the flow-path member 200 are connected to flow paths communicating with the nozzle openings 21 of the respective head main bodies 110, in such a manner that ink is supplied from the flow-path member 200 to the respective head main bodies 110.

In this embodiment, six head main bodies 110 adhere to one flow-path member 200. However, the number of head main bodies 110 fixed to one flow-path member 200 is not limited to six. One head main body 110 may be fixed to each flow-path member 200 or two or more head main bodies 110 may be fixed to each flow-path member 200.

An opening portion 201 is provided in the flow-path member 200, in a state where the opening portion 201 passes through the flow-path member 200 in the Z direction. The COF substrate 98 of which one end is connected to the head main body 110 is inserted through the opening portion 201.

The COF substrate 98 is an example of a flexible wiring substrate. A flexible wiring substrate is a flexible substrate having wiring formed thereon. Furthermore, the COF substrate 98 includes a driving circuit 97 (see FIG. 7) which drives a pressure generation unit in the head main body 110.

The relay substrate 140 is a substrate on which electrical components, such as wiring, an IC, and a resistor, are mounted. The relay substrate 140 is disposed in a portion between the holding member 120 and the flow-path member 200. A passing-through portion 141 communicating with the opening portion 201 in the flow-path member 200 is formed in the relay substrate 140. The size of the opening of each passing-through portion 141 is greater than that of the opening portion 201 of the flow-path member 200.

The COF substrate 98 connected to the pressure generation unit of the head main body 110 is inserted through both the opening portion 201 and the passing-through portion 141. The COF substrate 98 is connected to a terminal (not illustrated) in the Z2-side surface of the relay substrate 140.

Although not particularly illustrated, the relay substrate 140 is connected to the controller of the ink jet type recording apparatus 1. Accordingly, for example, the driving signals sent from the controller are transmitted, through the relay substrate 140, to the driving circuit 97 of the COF substrate 98. The pressure generation unit of the head main body 110 is driven by the driving circuit 97. Therefore, an ink ejection operation of the recording head 100 is controlled.

On the Z1 side of the holding member 120, a hold portion 121 is provided to form a space having a groove shape. On the Z1-side surface of the holding member 120, the hold portion 121 continuously extends in the Y direction, and thus the hold portion 121 is open to both side surfaces of the holding member 120 in the Y direction. Furthermore, the hold portion 121 is provided in a substantially central portion of the holding member 120 in the X direction, and thus leg portions 122 are formed on both sides of the hold portion 121 in the X direction. In other words, in the Z1-side surface of the holding member 120, the leg portions 122 are provided on only both end portions in the X direction and are not provided on both end portions in the Y direction. In this embodiment, the holding member 120 is constituted of one member. However, the configuration of the holding member 120 is not limited thereto. The holding member 120 may be constituted of a plurality of members stacked in the Z direction.

The relay substrate 140, the flow-path member 200, and the plurality of head main body 110 are accommodated in such a hold portion 121. Specifically, the respective head main bodies 110 are bonded to the Z1-side surface of the flow-path member 200, using, for example, an adhesive. Furthermore, the relay substrate 140 is fixed to the Z2-side surface of the flow-path member 200. The relay substrate 140, the flow-path member 200, and the plurality of head main bodies 110 which are bonded into a single member are accommodated in the hold portion 121.

In the holding member 120 and the flow-path member 200, the Z-direction facing surfaces of the hold portion 121 and the flow-path member 200 adhere to each other, using an adhesive. The relay substrate 140 is accommodated in a space between the hold portion 121 and the flow-path member 200. The holding member 120 and the flow-path member 200 may be integrally fixed using a fixing unit, such as a screw, instead of using an adhesive.

Although not particularly illustrated, a flow path through which ink flows, a filter which filters out, for example, foreign matter, and the like may be provided in the holding member 120. The flow path of the holding member 120 communicates with the flow path of the flow-path member 200. Accordingly, the ink fed from the liquid storage unit in the ink jet type recording apparatus 1 is supplied to the head main body 110 via both the holding member 120 and the flow-path member 200.

The fixing plate 130 is provided on the liquid ejection surface 20*a* side of the recording head 100. In other words, the fixing plate 130 is provided on the Z1 side of the recording head 100 in the Z direction and holds the respective recording heads 100. The fixing plate 130 is formed by bending a plate-shaped member constituted of, for example, metal. Specifically, the fixing plate 130 includes a base portion 131 and bent portions 132. The base portion 131 is provided on the liquid ejection surface 20*a* side of the fixing plate 130. Both end portions of the base portion 131 in the Y direction are bent in the Z2 direction, in such a manner that the bent portions 132 are formed.

Exposure opening portions 133 are provided in the base portion 131. The exposure opening portions 133 are openings for exposing the nozzle openings 21 of the respective head main bodies 110. In this embodiment, the exposure opening portions 133 are open in a state where the exposure opening portions 133 separately respectively correspond to the head main bodies 110. In other words, the recording head 100 of this embodiment has the six head main bodies 110, and thus six separate exposure opening portions 133 are provided in the base portion 131. Needless to say, one common exposure opening portion 133 may be provided with respect to a head main body group constituted of a plurality of head main bodies 110, in accordance with, for example, the configuration of the head main body 110.

The Z1 side of the hold portion 121 of the holding member 120 is covered with such a base portion 131. The base portion 131 is bonded, using an adhesive, to the Z1-side surface of the holding member 120 in the Z direction, in other words, the Z1-side end surfaces of the leg portion 122, as illustrated in FIG. 6.

The bent portions 132 are provided on both end portions of the base portion 131 in the Y direction. The bent portions 132 have a size which is capable of covering the opening areas of the hold portion 121, which are open in the Y-direction side surfaces of the hold portion 121. In other words, the bent portion 132 is a portion extending from the Y-direction end portion of the base portion 131 to the edge portion of the fixing plate 130. In addition, such a bent portion 132 is bonded, using an adhesive, to the Y-direction side surface of the holding member 120. Accordingly, the openings of the hold portion 121, which are open in the Y-direction side surfaces of the hold portion 121, are covered and sealed with the bent portions 132.

The fixing plate 130 adheres, using an adhesive, to the holding member 120, as described above, and thus the head main body 110 is disposed in the inner portion of the hold portion 121, which is a space between the holding member 120 and the fixing plate 130.

The plurality of head main bodies 110 are provided in each recording head 100, in such a manner that the recording head 100 of this embodiment has a plurality of nozzle rows, as described above. In this case, it is possible to improve the yield, compared to in a case where a plurality of nozzle rows are provided in only one head main body 110, in such a manner that one recording head 100 has a plurality of nozzle rows. In other words, when a plurality of nozzle rows are provided by one head main body 110, the yield of the head main body 110 decreases and the manufacturing cost increases. In contrast, when a plurality of nozzle rows are provided in a plurality of head main bodies 110, the yield of the head main body 110 is improved and the manufacturing cost can be reduced.

The openings in the Y-direction side surfaces of the holding member 120 are sealed with the bent portions 132 of the fixing plate 130. Accordingly, even when leg portions which adhere to the base portion 131 of the fixing plate 130 are not provided on both sides (which are hatched portions in FIG. 3) of the holding member 120 in the Y direction, it is possible to prevent moisture evaporation from occurring through the openings in the Y-direction side surfaces of the hold portion 121.

Accordingly, in the head unit 101 in which the recording heads 100 are aligned in the Y direction, a gap between adjacent recording heads 100 in the Y direction can be reduced because the leg portions 122 are not provided on the Y-direction sides of the adjacent recording heads 100. Accordingly, the head main bodies 110 of adjacent recording heads 100 in the Y direction can be arranged close to each other, and thus the nozzle openings 21 of the respective head main bodies 110 of the adjacent recording heads 100 can be arranged close to each other in the Y direction.

In the recording head 100 according to this embodiment, the leg portions 122 are provided on both sides of the holding member 120 in the X direction. However, the leg portions 122 may not be provided. In other words, the head main body 110 may adhere to the Z1-side surface of the holding member 120 and the bent portions 132 may be provided on both sides of the fixing plate 130 in the X direction and on both sides thereof in the Y direction. That is, the bent portions 132 may be provided over the circumference of the fixing plate 130, in an in-plane direction of the liquid ejection surface 20*a*, and the fixing plate 130 adheres over the circumference of the side surfaces of the holding member 120. However, when the leg portions 122 are provided on both sides of the holding member 120 in the X direction, as in the case of this embodiment, the Z1-side end surfaces of the leg portion 122 adhere to the base portion 131 of the fixing plate 130. As a result, the hardness of the ink jet type recording head 100 in the Z direction can be improved and it is possible to prevent moisture evaporation from occurring through the leg portions 122.

Figure 7:
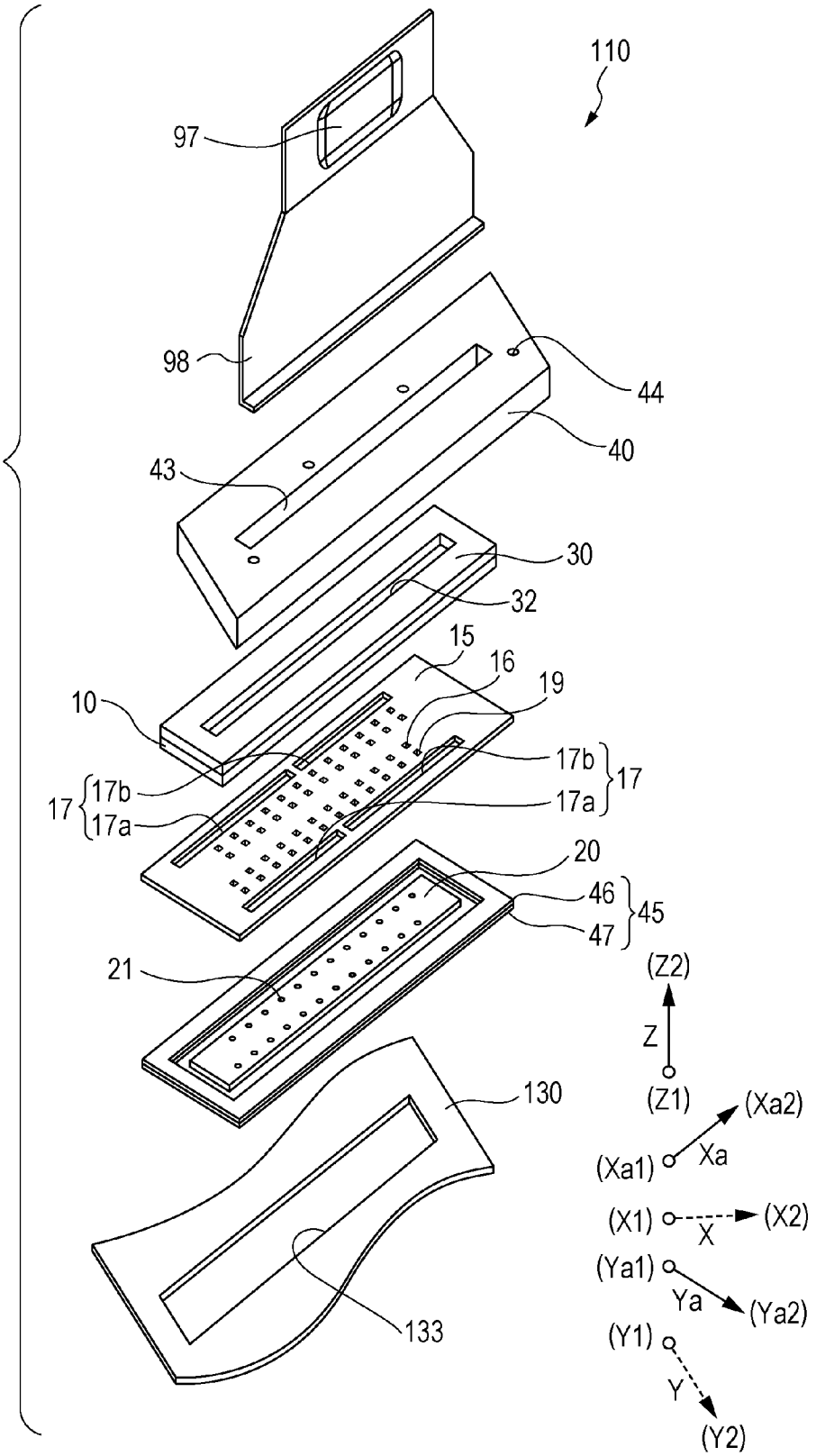
FIG. 7 is an exploded perspective view of a head main body according to Embodiment 1 of the invention.
Figure 8:
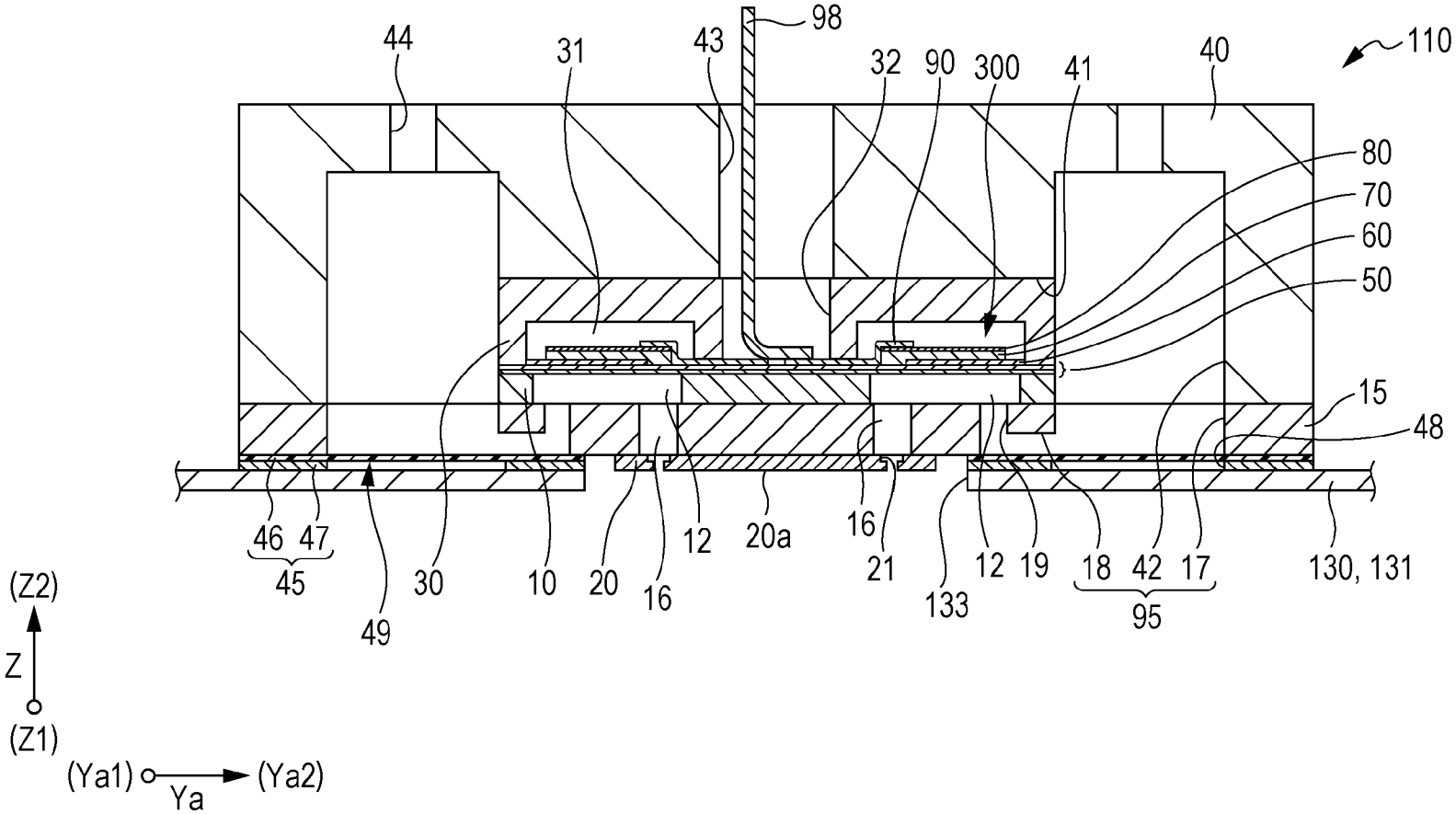
FIG. 8 is a cross-sectional view of the head main body according to Embodiment 1 of the invention.

The head main body 110 will be described with reference to FIGS. 7 and 8. FIG. 7 is an exploded perspective view of the head main body according to this embodiment and FIG. 8 is a cross-sectional view of the head main body, taken along a line extending in the Y direction. Needless to say, the configuration of the head main body 110 is not limited to the configuration described below.

The head main body 110 of this embodiment includes a pressure generation chamber 12, the nozzle openings 21, a manifold 95, the pressure generation unit, and the like. Therefore, a plurality of members, such as a flow-path forming substrate 10, a communication plate 15, a nozzle plate 20, a protection substrate 30, a compliance substrate 45, a case 40 and the like are bonded to one another, using, for example, an adhesive.

One surface side of the flow-path forming substrate 10 is subjected to anisotropic etching, in such a manner that a plurality of pressure generation chambers 12 partitioned by a plurality of partition walls are provided in the flow-path forming substrate 10, in a state where the pressure generation chambers 12 are aligned in an alignment direction of a plurality of the nozzle openings 21. In this embodiment, the alignment direction of the pressure generation chambers 12 is referred to as the Xa direction. Furthermore, a plurality (two, in this embodiment) of rows, each of which is constituted of the pressure generation chambers 12 aligned in the Xa direction, are provided in the flow-path forming substrate 10. A row-alignment direction in which a plurality of rows of the pressure generation chambers 12 are aligned will be referred to as a Ya direction. In this embodiment, a direction perpendicular to both the Xa direction and the Ya direction is parallel to the Z direction. Furthermore, the head main body 110 of this embodiment is mounted on the head unit 101, in a state where the Xa direction as an alignment direction of the nozzle openings 21 is inclined with respect to the X direction as the transporting direction of the recording sheet S.

For example, a supply path of which the opening area is smaller than that of the pressure generation chamber 12 and which imparts a flow-path resistance to the ink flowing to the pressure generation chamber 12 may be provided in the flow-path forming substrate 10 in one end side of the Ya direction of the pressure generation chamber 12.

The communication plate 15 is bonded to one surface side of the flow-path forming substrate 10. Furthermore, the nozzle plate 20 in which a plurality of nozzle openings 21 communicating with the respective pressure generation chambers 12 are provided is bonded to the communication plate 15. In this embodiment, the Z1 side of the nozzle plate 20, on which the nozzle openings 21 are open, is the liquid ejection surface 20*a*.

A nozzle communication path 16 which allows the pressure generation chamber 12 to communicate with the nozzle opening 21 is provided in the communication plate 15. The area of the communication plate 15 is greater than that of the flow-path forming substrate 10 and the area of the nozzle plate 20 is smaller than that of the flow-path forming substrate 10. The nozzle plate 20 has a relatively small area, as described above. As a result, it is possible to achieve a reduction in costs.

A first manifold 17 and a second manifold 18 which constitute a part of the manifold 95 are provided in the communication plate 15. The first manifold 17 passes through the communication plate 15 in the Z direction. The second manifold 18 does not pass through the communication plate 15 in the Z direction. The second manifold 18 is open to the nozzle plate 20 side of the communication plate 15 and extends to the Z-direction middle portion of the nozzle plate 20.

Supply communication paths 19 which communicate with one of each of the end portions of the pressure generation chambers 12 in the Y direction is provided in the communication plate 15, in a state where the supply communication paths 19 separately respectively correspond to the pressure generation chambers 12. The supply communication path 19 allows the second manifold 18 to communicate with the pressure generation chamber 12.

The nozzle openings 21 which respectively communicate with the pressure generation chambers 12 through the nozzle communication path 16 are formed in the nozzle plate 20. The plurality of nozzle openings 21 are aligned in the Xa direction. The aligned nozzle openings 21 form two nozzle rows which are a nozzle row a and a nozzle row b. The nozzle row a and the nozzle row b are aligned in the Ya direction. In this embodiment, each of the nozzle rows a and b is divided into two portions, and thus one nozzle row can eject liquids of two kinds. Details of this will be described below.

Meanwhile, a diaphragm 50 is formed on a surface of the flow-path forming substrate 10, which is the surface on the side opposite to the communication plate 15 of the flow-path forming substrate 10. A first electrode 60, a piezoelectric layer 70, and a second electrode 80 are laminated, in order, on the diaphragm 50, in such a manner that a piezoelectric actuator 300 as the pressure generation unit of this embodiment is constituted. Generally, one electrode of the piezoelectric actuator 300 is constituted of a common electrode. The other electrodes and the piezoelectric layers are subjected to patterning such that the other electrode and the piezoelectric layer correspond to each pressure generation chamber 12.

The protection substrate 30 having substantially the same size as that of the flow-path forming substrate 10 is bonded to a surface of the flow-path forming substrate 10, which is the surface on the piezoelectric actuator 300 side. The protection substrate 30 has a hold portion 31 which is a space for protecting the piezoelectric actuator 300. Furthermore, in the protection substrate 30, a through-hole 32 is provided in a state where the through-hole 32 passes through the protection substrate 30 in the Z direction. An end portion of a lead electrode 90 extending from the electrode of the piezoelectric actuator 300 extends such that the end portion is exposed to the inner portion of the through-hole 32. The lead electrode 90 and the COF substrate 98 are electrically connected in the through-hole 32.

Furthermore, the case 40 which forms manifolds 95 communicating with a plurality of pressure generation chambers 12 is fixed to both the protection substrate 30 and the communication plate 15. In a plan view, the case 40 and the communication plate 15 described above have substantially the same shape. The case 40 is bonded to the protection substrate 30 and, further, bonded to the communication plate 15 described above. Specifically, a concave portion 41 is provided on the protection substrate 30 side of the case 40. The depth of the concave portion 41 is enough to accommodate both the flow-path forming substrate 10 and the protection substrate 30. The opening area of the concave portion 41 is greater than that of a surface of the protection substrate 30, which is the surface bonded to the flow-path forming substrate 10. An opening surface of the concave portion 41, which is the opening surface on the nozzle plate 20 side, is sealed with the communication plate 15, in a state where the flow-path forming substrate 10 and the like are accommodated in the concave portion 41. Accordingly, in the outer circumferential portion of the flow-path forming substrate 10, a third manifold 42 is formed by the case 40, the flow-path forming substrate 10, and the protection substrate 30. The manifold 95 of this embodiment is constituted of the third manifold 42, the first manifold 17, and the second manifold 18, in which the first manifold 17 and the second manifold 18 are provided in the communication plate 15. Liquids of two kinds can be ejected by one nozzle row, as described above. Thus, each of the first manifold 17, the second manifold 18, and the third manifold 42 which constitute the manifold 95 is divided into two portions, in a nozzle-row direction, that is, the Xa direction. The first manifold 17 is constituted of, for example, a first manifold 17*a* and a first manifold 17*b*, as illustrated in FIG. 7. Similarly, each of the second manifold 18 and the third manifold 42 is also divided into two portions. Thus, the entirety of the manifold 95 is divided into two portions, in the Xa direction.

In this embodiment, the first manifolds 17, the second manifolds 18, and the third manifolds 42 which constitute the manifolds 95 are symmetrically arranged with the nozzle rows a and b interposed therebetween. In this case, the nozzle row a and the nozzle row b can eject different liquids. Needless to say, the arrangement of the manifolds is not limited thereto.

In this embodiment, each of the manifolds corresponding to the respective nozzle rows is divided into two portions, in the Xa direction. Accordingly, in total, four manifolds 95 are provided such that liquids of four kinds can be ejected, as described below. However, manifolds may be provided corresponding to nozzle rows a and b. Alternatively, one common manifold may be provided with respect to the two rows which are the nozzle row a and the nozzle row b.

A plurality (two, in this embodiment) of manifolds 95 are provided in one head main body 110, as described above. The manifolds 95 are arranged in the same plane. The meaning of "a plurality of manifolds 95 are arranged in the same plane" implies that there is a surface capable of forming a cross-sectional surface which is parallel to the liquid ejection surface 20*a* and is shared in common by all of the manifolds 95. A boundary surface between the case 40 and the communication plate 15, which is an example of the cross-sectional surface parallel to the liquid ejection surface 20*a*, can form a cross-sectional surface which is parallel to the liquid ejection surface 20*a* and is common to the two manifolds 95. A plurality of manifolds 95 are arranged in the same plane, and thus it is possible to stabilize ink ejection properties. Details of this will be described below.

The compliance substrate 45 is provided in a surface of the communication plate 15, in which both the first manifold 17 and the second manifold 18 are open. The openings of both the first manifold 17 and the second manifold 18 are sealed with the compliance substrate 45.

In this embodiment, such a compliance substrate 45 includes a sealing film 46 and a fixing substrate 47. The sealing film 46 is constituted of a flexible thin film (which is formed of, for example, polyphenylene sulfide (PPS) or stainless steel (SUS)). The fixing substrate 47 is constituted of a hard material, for example, metal, such as stainless metal (SUS). A part of the fixing substrate 47, which is the portion facing the manifold 95, is completely removed in a thickness direction and forms an opening portion 48. Thus, one surface of the manifold 95 forms a compliance portion 49 which is a flexible portion sealed with only the sealing film 46 having flexibility.

The fixing plate 130 adheres to a surface of the compliance substrate 45, which is the surface on a side opposite to the communication plate 15. In other words, the opening area of the exposure opening portion 133 of the base portion 131 of the fixing plate 130 is greater than the area of the nozzle plate 20. The liquid ejection surface 20*a* of the nozzle plate 20 is exposed through the exposure opening portion 133. Needless to say, the configuration is not limited thereto. The opening area of the exposure opening portion 133 of the fixing plate 130 may be smaller than that of the nozzle plate 20 and the fixing plate 130 may abut or adhere to the liquid ejection surface 20*a* of the nozzle plate 20. Alternatively, even when the opening area of the exposure opening portion 133 of the fixing plate 130 is smaller than that of the nozzle plate 20, the fixing plate 130 may be provided in a state where the fixing plate 130 is not in contact with the liquid ejection surface 20*a*. In other words, the meaning of "the fixing plate 130 is provided on the liquid ejection surface 20*a* side" includes both a state where the fixing plate 130 is not in contact with the liquid ejection surface 20*a* and a state where the fixing plate 130 is in contact with the liquid ejection surface 20*a*.

An introduction path 44 is provided in the case 40. The introduction path 44 communicates with the manifold 95 and allows ink to be supplied to the manifold 95. In addition, a connection port 43 is provided in the case 40. The connection port 43 communicates with the through-hole 32 of the protection substrate 30 and the COF substrate 98 is inserted therethrough.

In the head main body 110 configured as described above, when ink is ejected, ink is fed from a storage unit through the introduction path 44 and the flow path from the manifold 95 to the nozzle openings 21 is filled with the ink. Then, voltage is applied, in accordance with signals from the driving circuit 97, to each piezoelectric actuator 300 corresponding to the pressure generation chamber 12, in such a manner that the diaphragm, along with the piezoelectric actuator 300, is flexibly deformed. As a result, the pressure in the pressure generation chamber 12 increases, and thus ink droplets are ejected from predetermined nozzle openings 21.

Here, details of the configuration in which the alignment direction of the nozzle openings 21 constituting the nozzle row of the head main body 110 is inclined with respect to the X direction as the transporting direction of the recording sheet S will be described with reference to FIGS. 5 and 9.

Figure 9:
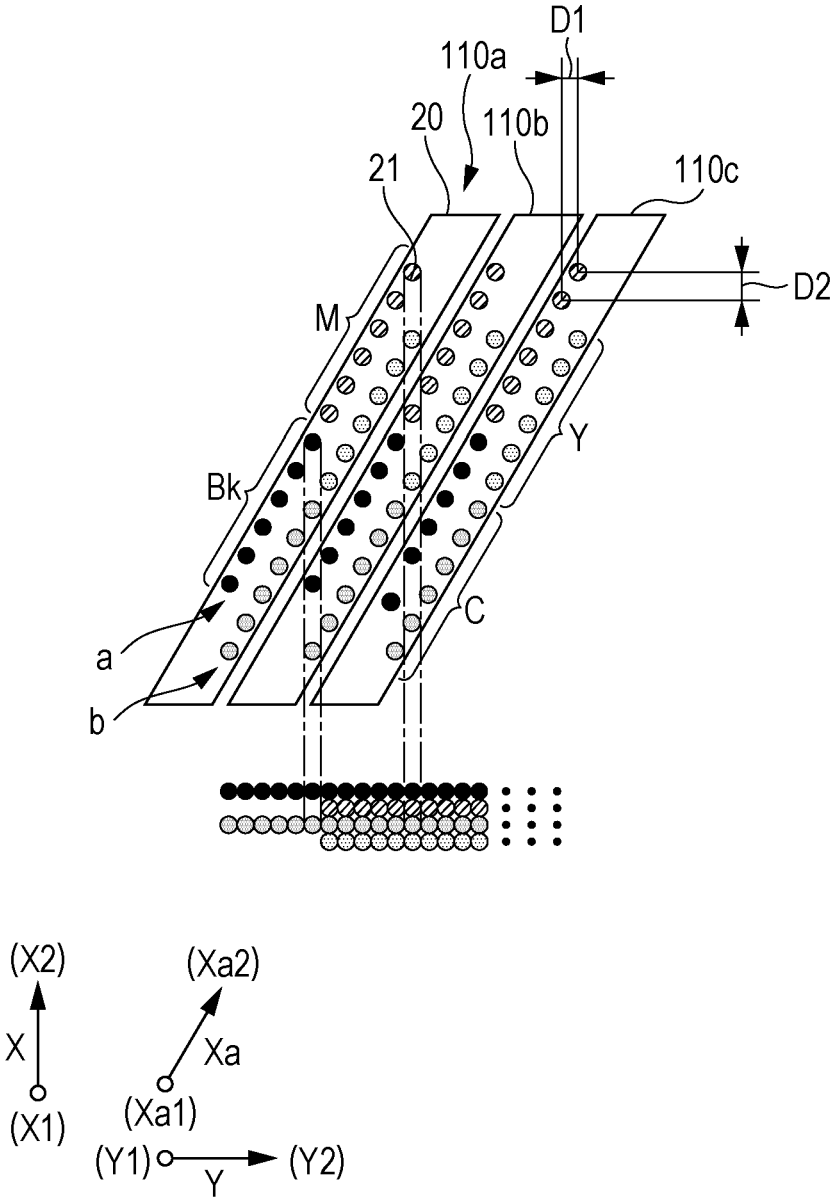
FIG. 9 is a schematic view illustrating the arrangement of nozzle openings of Embodiment 1 of the invention.

FIG. 9 is a schematic view explaining the arrangement of the nozzle openings of the head main body according to this embodiment.

The plurality of the head main bodies 110 are fixed in a state where, in the in-plane direction of the liquid ejection surface 20*a*, the nozzle rows a and b are inclined with respect to the X direction as the transporting direction of the recording sheet S. The nozzle row referred to in this case is a row of a plurality of nozzle openings 21 aligned in a predetermined direction. In this embodiment, two rows which are the nozzle rows a and b, each of which is constituted of a plurality of nozzle openings 21 aligned in the Xa direction as the predetermined direction, are provided in the liquid ejection surface 20*a*. The Xa direction intersects the X direction at an angle greater than 0° and less than 90°. In this case, it is preferable that the Xa direction intersect the X direction at an angle greater than 0° and less than 45°. In this case, upon comparison with in the case where the Xa direction intersects the X direction at an angle greater than 45° and less than 90°, a gap D1 between adjacent nozzle openings 21 in the Y direction can be further reduced. As a result, the recording head 100 can have high definition in the Y direction. Needless to say, the Xa direction may intersect the X direction at an angle greater than 45° and less than 90°.

The meaning of "the Xa direction intersects the X direction at the angle greater than 0° and less than 45°" implies that, in the plane of the liquid ejection surface 20*a*, the nozzle row is inclined closer to the X direction than a straight line intersecting the X direction at 45°. The gap D1 referred to in this case is a gap between the nozzle openings 21 of the nozzle rows a and b, in a state where the nozzle openings 21 are projected in the X direction, with respect to an imaginary line in the Y direction. Furthermore, a gap between the nozzle openings 21 of the nozzle rows a and b which are projected in the Y direction, with respect to an imaginary line in the X direction, is set to a gap D2.

In this embodiment, liquids of two kinds can be ejected from one nozzle row and liquids of four kinds can be ejected from two nozzle rows, as illustrated in FIG. 9. In other words, when it is assumed that inks of four colors are used, a black ink Bk and a magenta ink M are can be ejected from the nozzle row a and a cyan ink C and a yellow ink Y can be ejected from the nozzle row b. Furthermore, the nozzle row a and the nozzle row b have the same number of nozzle openings 21. The Y-direction positions of the nozzle openings 21 of the nozzle row a and the Y-direction positions of the nozzle openings 21 of the nozzle row b overlap in the X direction.

Head main bodies 110*a* to 110*c* have the nozzle rows a and b. The head main bodies 110*a* to 110*c* are arranged close to each other in the Y direction, and thus the nozzle openings 21 of adjacent head main bodies 110 in the Y direction are aligned in a state where the nozzle openings 21 overlap in the X direction. Accordingly, a part of the nozzle row a of the head main body 110*a*, which is a portion ejecting the magenta ink M, and a part of the nozzle row b of the head main body 110*a*, which is a portion ejecting the yellow ink Y, overlap, in the X direction, with a part of the nozzle row a of the head main body 110*b*, which is a portion ejecting the black ink Bk, and a part of the nozzle row b of the head main body 110*b*, which is a portion ejecting the cyan ink C. Therefore, lines of four colors are aligned in one row in the X direction, and thus a color image can be printed. Similarly, in the case of adjacent head main bodies 110*b* and 110*c* in the Y direction, the nozzle openings 21 are aligned in a state where the nozzle openings 21 overlap in the X direction.

At least some of nozzle openings 21 of nozzle rows of adjacent head main bodies 110, which are the nozzle rows ejecting ink of the same color, overlap in the X direction. As a result, the image quality in a joining portion between the head main bodies 110 can be improved. In other words, one nozzle opening 21 of the nozzle row a of the head main body 110*a*, which is the nozzle row ejecting the magenta ink M, and one nozzle opening 21 of the nozzle row a of the head main body 110*b*, which is the nozzle row ejecting the magenta ink M, overlap in the X direction. Ejection operations through the two overlapping nozzle openings 21 are controlled, in such a manner that image quality deterioration, such as banding and streaks, can be prevented from occurring in the joining portion between the adjacent head main bodies 110. In an example illustrated in FIG. 9, only one nozzle opening 21 of one head main body 110 and one nozzle openings 21 of the other head main body 110 overlap in the X direction. However, two or more nozzle openings 21 of one head main body 110 and two or more nozzle openings 21 of the other head main body 110 may overlap in the X direction.

Needless to say, the arrangement relating to colors may not be limited thereto. Although not particularly illustrated, the black ink Bk, the magenta ink M, the cyan ink C, and the yellow ink Y can be ejected from, for example, one nozzle row.

As described above, the head unit 101 is constituted by fixing four recording heads 100 to the head fixing substrate 102, in which each recording head 100 has a plurality of head main bodies 110. Parts of nozzle rows of adjacent recording heads 100 overlap in the X direction, as illustrated by a straight line L in FIG. 5. In other words, similarly to the relationship between adjacent head main bodies 110 in one recording head 100, adjacent head main bodies 110 of adjacent recording heads 100 in the Y direction are arranged close to each other in the Y direction, and thus a color image can be printed in a portion between the adjacent recording heads 100 and, further, the image quality in the joining portion between the adjacent recording heads 100 can be improved. Needless to say, the number of overlapping nozzle openings 21 between adjacent recording heads 100, which overlap in the X direction, is not necessarily the same as the number of overlapping nozzle openings 21 between adjacent head main bodies 110 in one recording head 100, which overlap in the X direction.

As described above, the nozzle rows between adjacent head main bodies 110 and the nozzle rows between adjacent recording heads 100 partially overlap in the X direction, and thus the image quality in the joining portion can be improved.

It is preferable that, in a portion between nozzle openings 21 of nozzle rows, which are adjacent in the Xa direction, a pitch between adjacent nozzles and the an angle between the X direction and the Xa direction be set to satisfy a condition in which the relationship between the gap D1 in the X direction and the gap D2 in the Y direction satisfies an integer ratio. In this case, when an image is printed in accordance with image data which is constituted of pixels having a matrix shape in which the pixels are arranged in both the X direction and the Y direction, it is easy to pair each nozzle with each pixel. Needless to say, the relationship is not limited to the relationship of an integer ratio.

In a plan view seen from the liquid ejection surface 20*a* side, the recording head 100 of this embodiment has a substantially parallelogram shape, as illustrated in FIG. 5. The reason for this is as follows. The Xa direction as the alignment direction of the nozzle openings 21 which constitute the nozzle rows a and b of each head main body 110 is inclined with respect to the X direction as the transporting direction of the recording sheet S. Furthermore, the recording head 100 is formed in a shape parallel to the Xa direction as an inclined direction of the nozzle rows a and b. In other words, the fixing plate 130 has a substantially parallelogram shape. Needless to say, in a plan view seen from the liquid ejection surface 20*a* side, the shape of the recording head 100 is not limited to a substantially parallelogram. The recording head 100 may have a trapezoidal-rectangular shape, a polygonal shape, or the like.

An example in which two nozzle rows are provided in one head main body is described in the embodiment described above. However, needless to say, even when three or more nozzle rows are provided, the same effects described above may be obtained. Furthermore, when two nozzle rows are provided in one head main body 110, as in the case of this embodiment, nozzle openings 21 of the two nozzle rows can be arranged in a portion between two manifolds 95 respectively corresponding to the two nozzle rows, as illustrated in FIG. 7. Thus, a gap between the two nozzle rows in the Ya direction can be reduced, compared to in the case where nozzle openings 21 of a plurality of nozzle rows are arranged on the same side with respect to manifolds respectively corresponding to the plurality of nozzle rows. As a result, in the nozzle plate 20, the area required for providing two nozzle rows can be reduced. In addition, it is easy to connect the respective piezoelectric actuators 300 corresponding to two nozzle rows and the respective COF substrates 98.

In this embodiment, the nozzle row a and the nozzle row b have the same number of nozzle openings 21. Accordingly, in the nozzle rows, the same number of nozzle openings 21 can overlap in the X direction, and thus it is possible to effectively eject liquid. However, nozzle rows do not have necessarily the same number of nozzle openings. Furthermore, the nozzle rows a and b may eject liquids of the same kind. In other words, the nozzle rows a and b may eject, for example, ink of the same color.

In this embodiment, it is preferable that the head main body 110 have s nozzle plate 20 having two nozzle rows. In this case, nozzle rows can be arranged with higher precision. Needless to say, one nozzle row may be provided in each nozzle plate 20. The nozzle plate 20 is constituted of a stainless-steel (SUS) plate, a silicon substrate, or the like.

Figure 10:
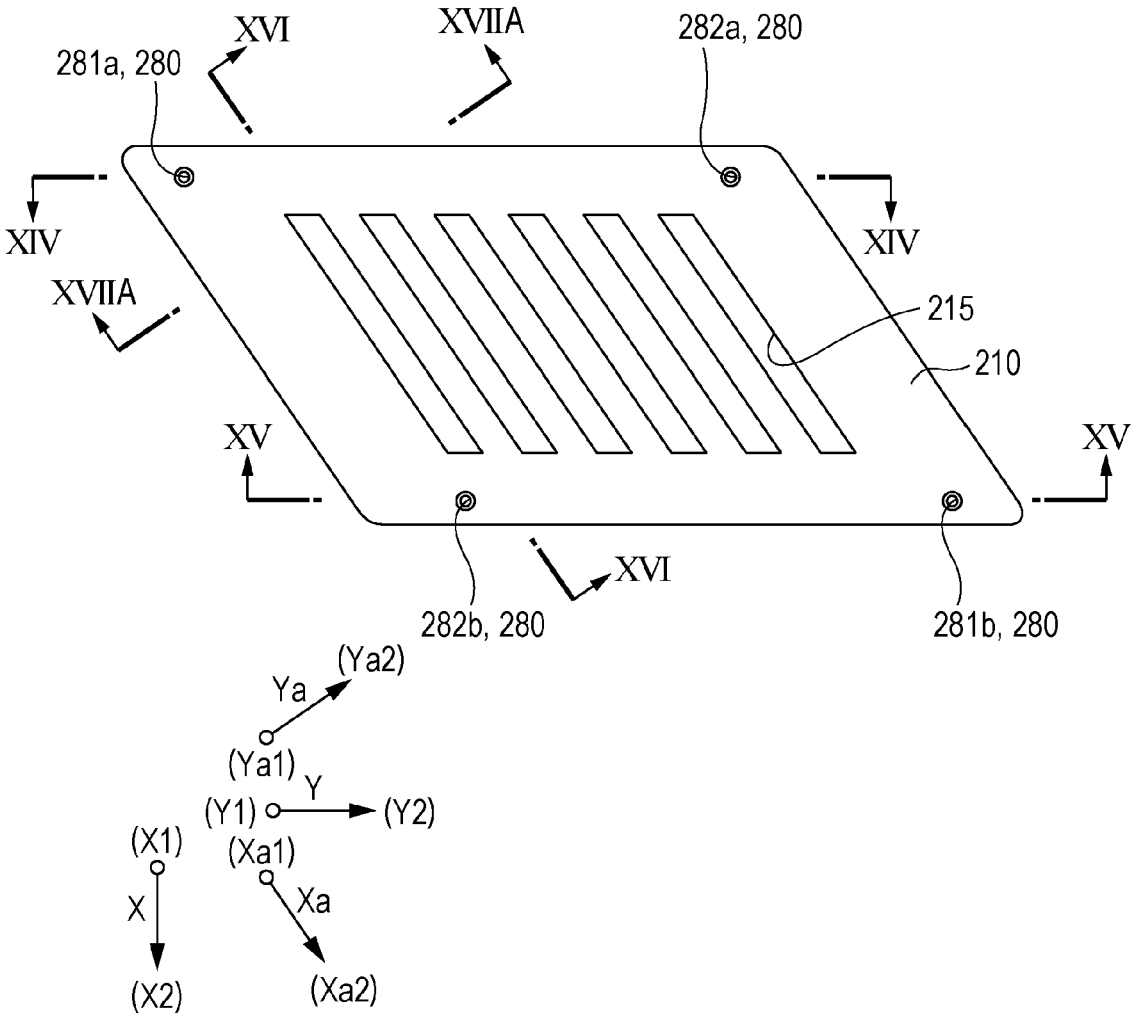
FIG. 10 is a plan view of a flow-path member (which is a first flow-path member) according to Embodiment 1 of the invention.
Figure 11:
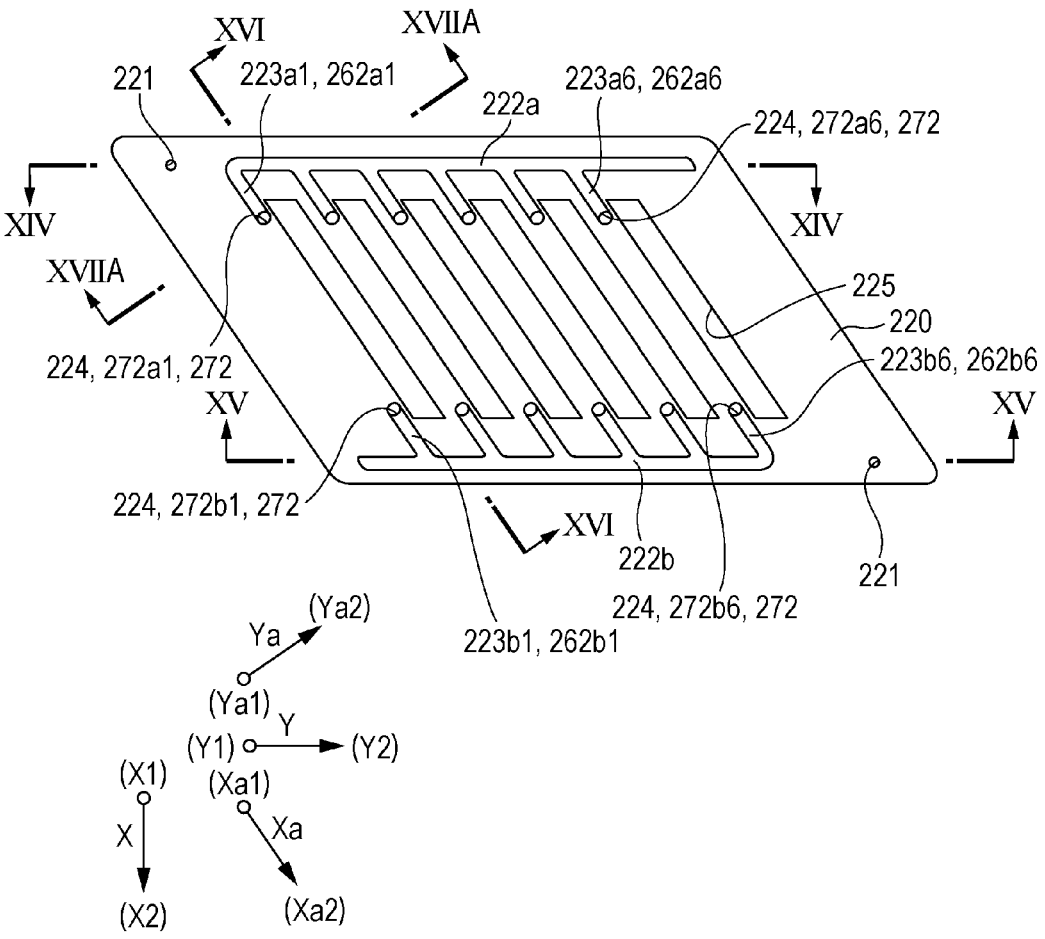
FIG. 11 is a plan view of a second flow-path member according to Embodiment 1 of the invention.
Figure 12:
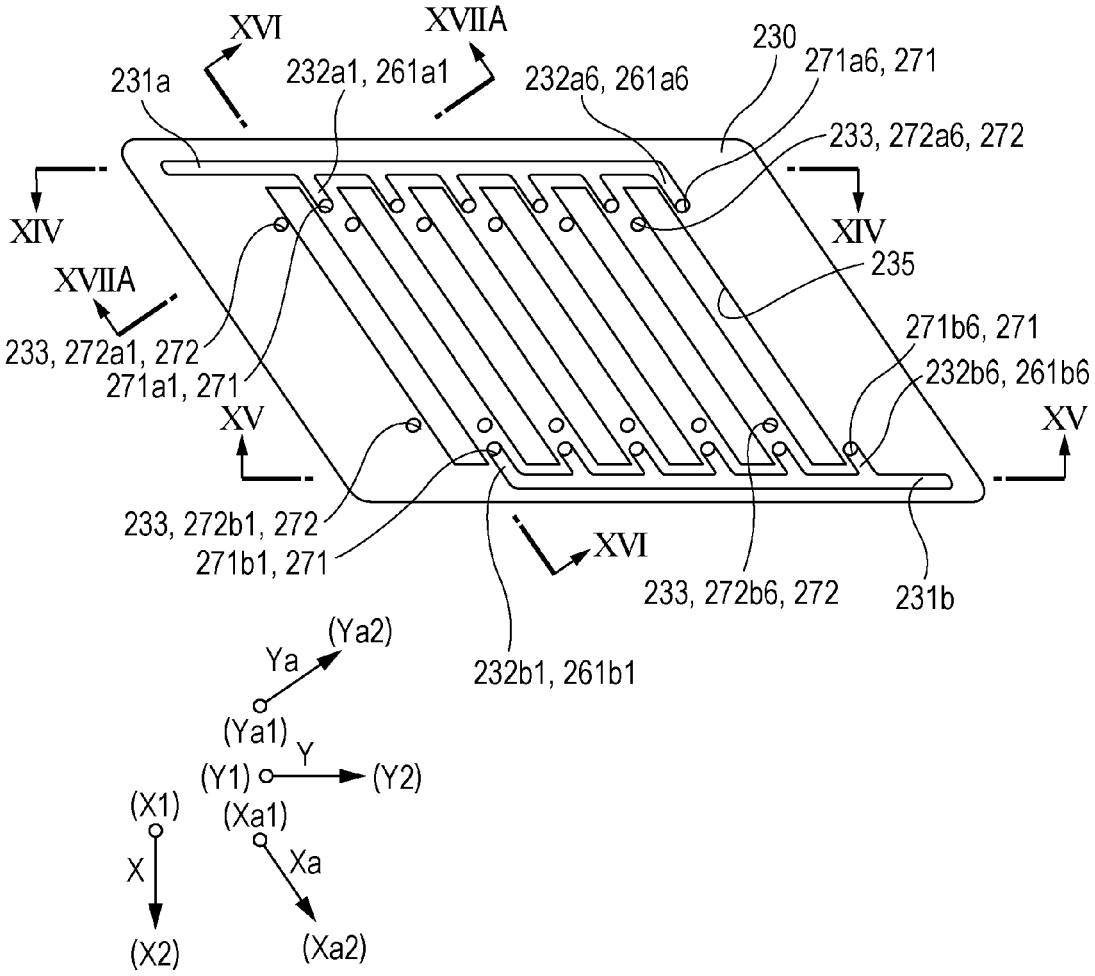
FIG. 12 is a plan view of a third flow-path member according to Embodiment 1 of the invention.
Figure 13:
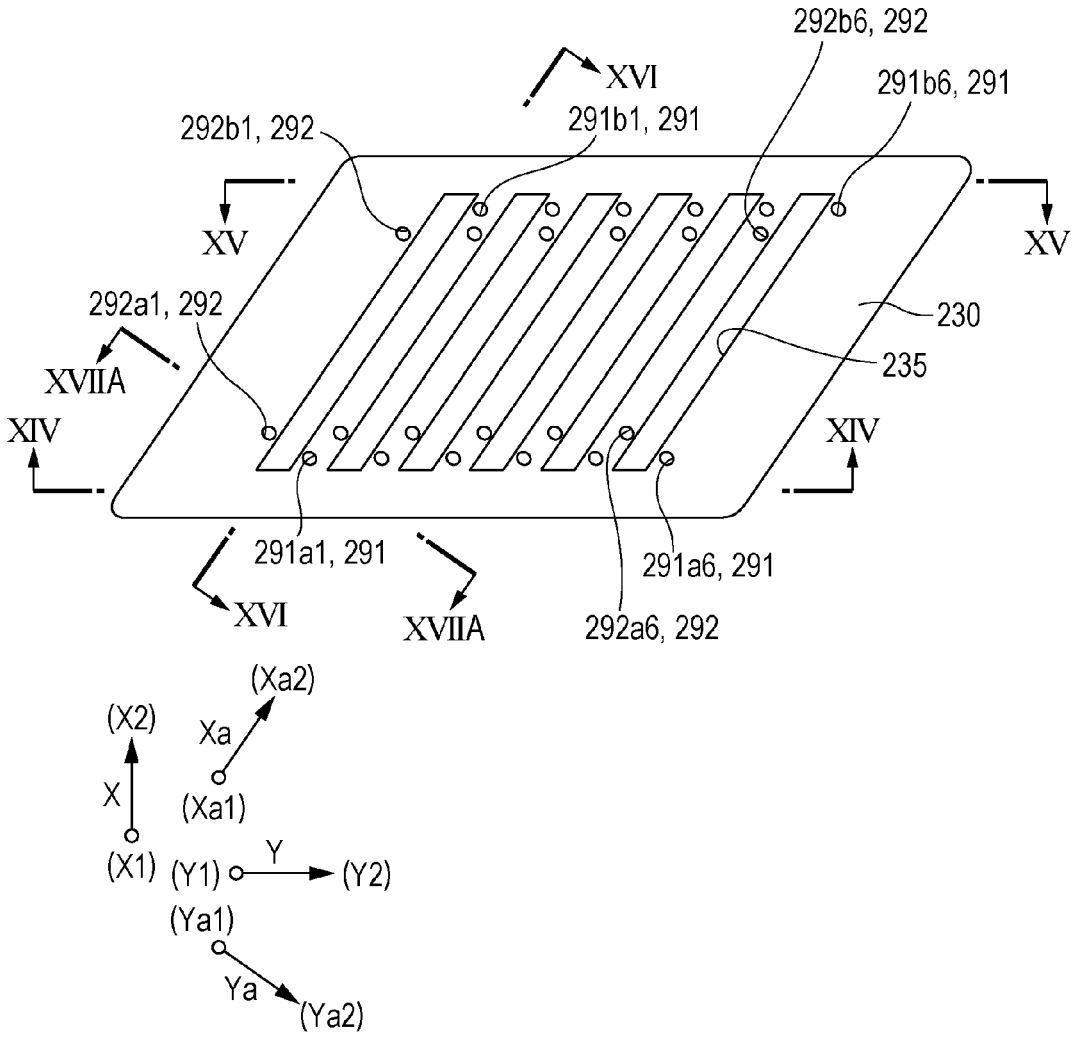
FIG. 13 is a bottom view of the third flow-path member according to Embodiment 1 of the invention.
Figure 14:
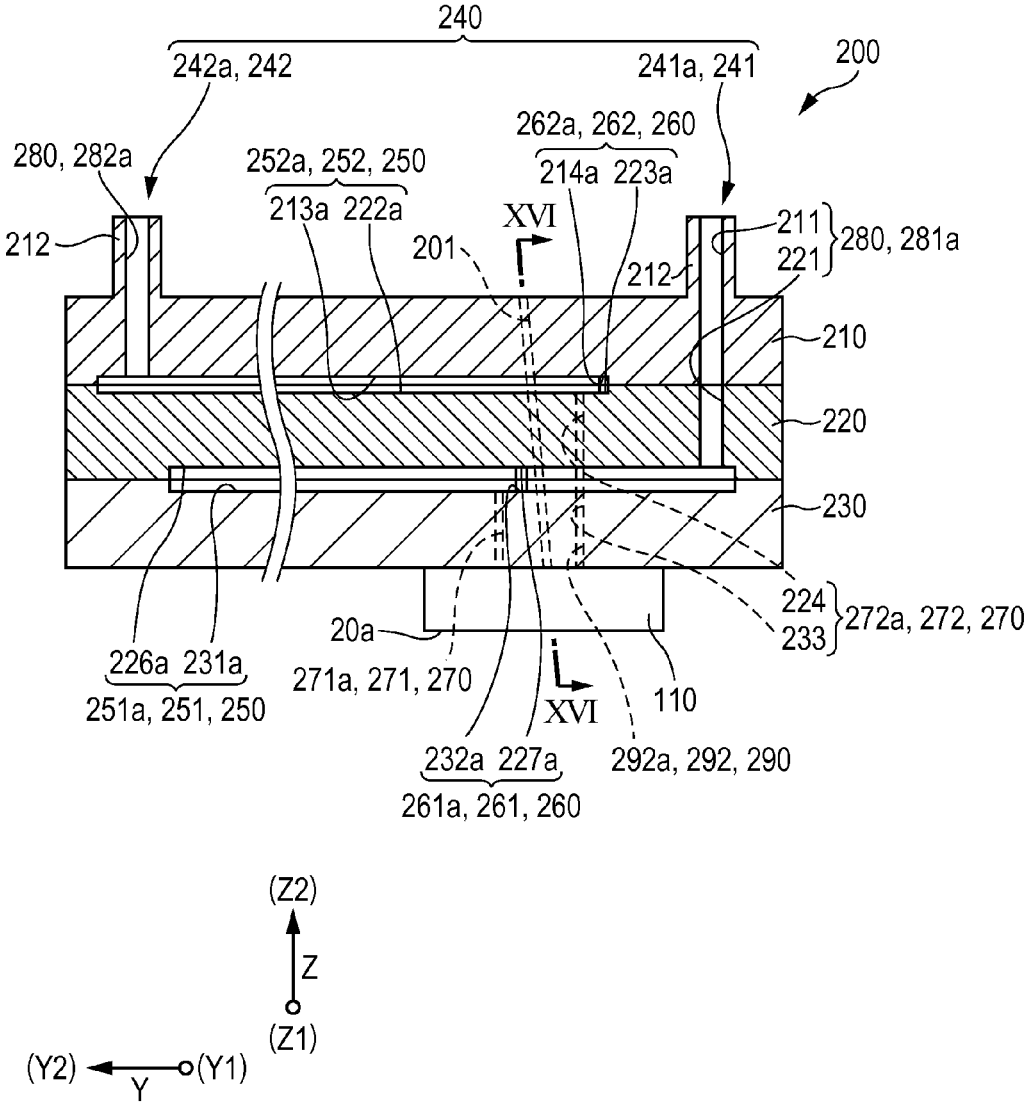
FIG. 14 is a cross-sectional view of FIGS. 10 to 13, taken along a line XIV-XIV.
Figure 15:
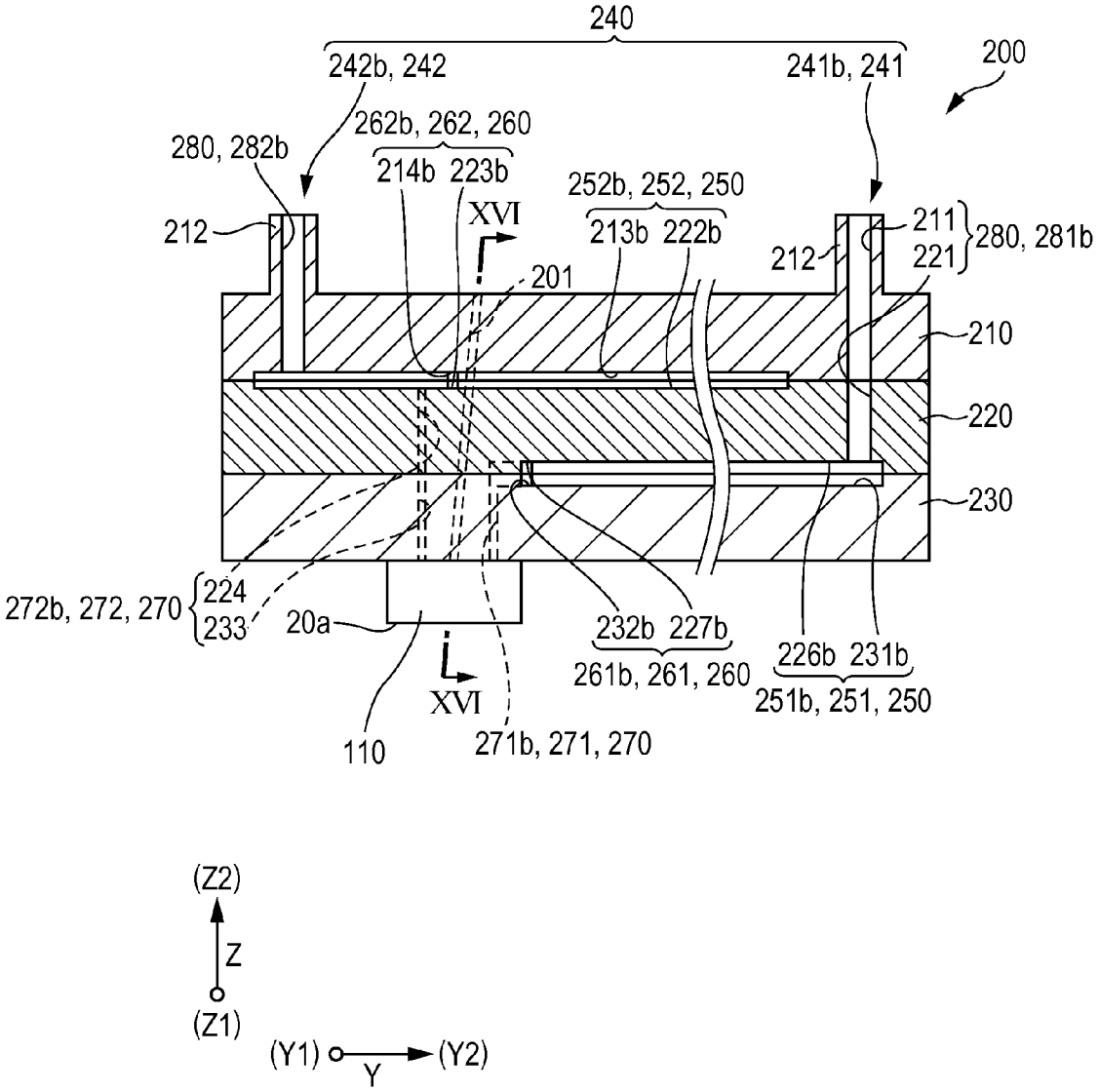
FIG. 15 is a cross-sectional view of FIGS. 10 to 13, taken along a line XV-XV.
Figure 16:
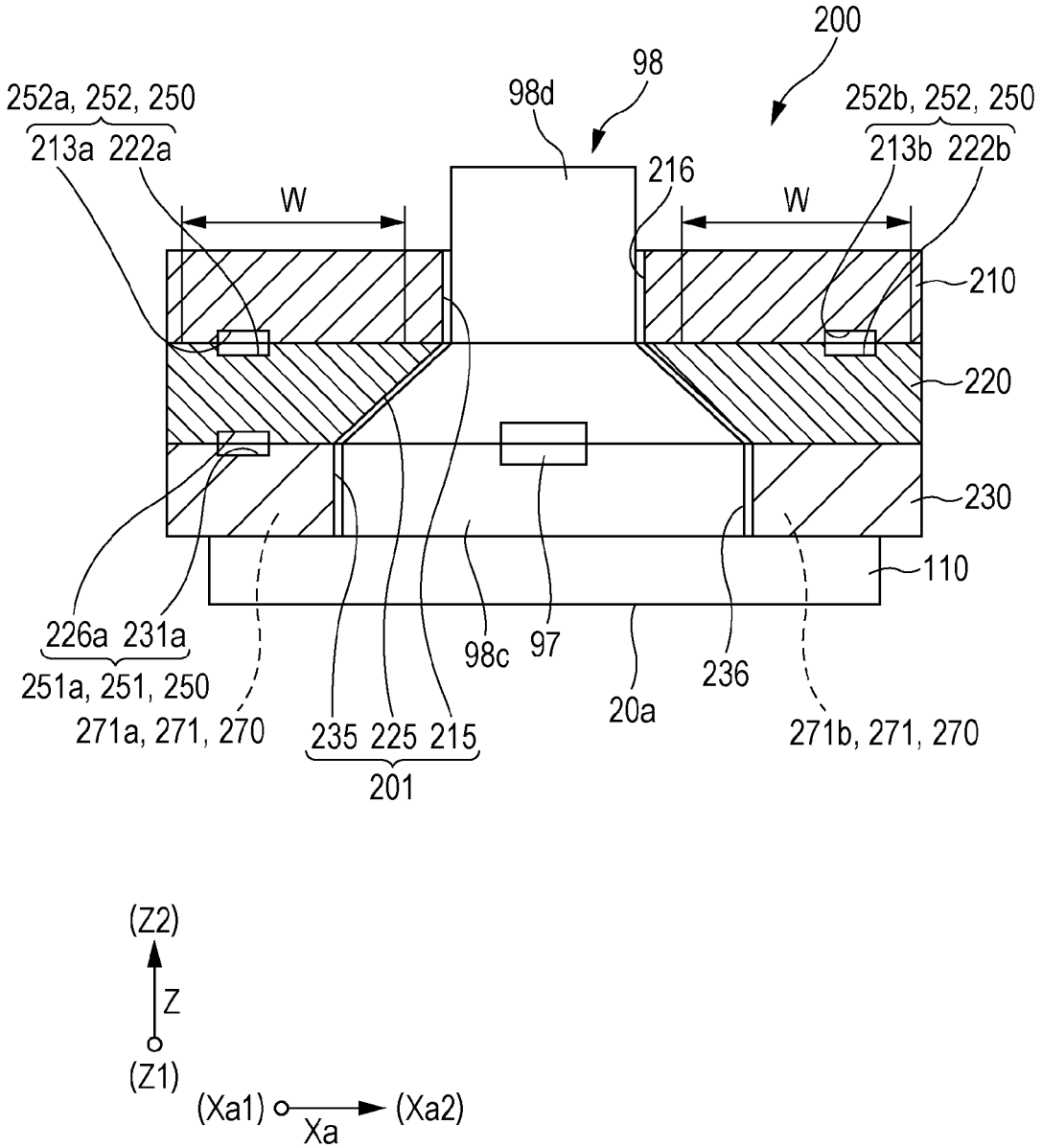
FIG. 16 is a cross-sectional view of FIGS. 10 to 15, taken along a line XVI-XVI.

Details of the flow-path member 200 according to this embodiment will be described with reference to FIGS. 10 to 16. FIG. 10 is a plan view of a first flow-path member as the flow-path member 200, FIG. 11 is a plan view of a second flow-path member as the flow-path member 200, and FIG. 12 is a plan view of a third flow-path member as the flow-path member 200. FIG. 13 is a bottom view of the third flow-path member. FIG. 14 is a cross-sectional view of FIGS. 10 to 13, taken along a line XIV-XIV, and FIG. 15 is a cross-sectional view of FIGS. 10 to 13, taken along a line XV-XV. FIG. 16 is a cross-sectional view of FIGS. 10 to 15, taken along a line XVI-XVI. FIGS. 10 to 12 are plan views seen from the Z2 side and FIG. 13 is a bottom view seen from the Z1 side.

A flow path 240 through which ink flows is provided in the flow-path member 200. In this embodiment, the flow-path member 200 includes three flow-path members stacked in the Z direction and a plurality of flow paths 240. The three flow-path members are a first flow-path member 210, a second flow-path member 220, and a third flow-path member 230. In the Z direction, the first flow-path member 210, the second flow-path member 220, and the third flow-path member 230 are stacked in order from the holding member 120 side (see FIG. 2) to the head main body 110 side. Although not particularly illustrated, the first flow-path member 210, the second flow-path member 220, and the third flow-path member 230 are fixed in an adhesive manner, using an adhesive. However, the configuration is not limited thereto. The first flow-path member 210, the second flow-path member 220, and the third flow-path member 230 may be fixed to each other, using a fixing unit, such as a screw. Furthermore, although the material for forming the flow-path member is not particularly limited, the flow-path member can be constituted of, for example, metal, such as SUS, or resin.

In the flow path 240, one end is an introduction flow path 280 and the other end is a connection portion 290. Ink supplied from a member (which is the holding member 120, in this embodiment) upstream from the flow path 240 and is introduced through the introduction flow path 280. The connection portion 290 functions as an output port through which the ink is supplied to the head. In this embodiment, four flow paths 240 are provided. In each flow path 240, ink is supplied to one introduction flow path 280. In the middle of each flow path 240, the flow path 240 branches into a plurality of flow paths. Therefore, in each flow path 240, the ink is supplied to the head main body 110 through a plurality of connection portions 290.

Some of the four flow paths 240 are first flow paths 241 and the others are second flow paths 242. In this embodiment, two first flow paths 241 and two second flow paths 242 are provided. One of the two first flow paths 241 is referred to as a first flow path 241*a* and the other is referred to as a first flow path 241*b*. Hereinafter, the first flow path 241 indicates both the first flow path 241*a* and the first flow path 241*b*. The second flow path 242 has a similar configuration.

The first flow path 241 includes a first introduction flow path 281. The first introduction flow path 281 connects a first distribution flow path 251 of the first flow path 241 and a flow path (which is the flow path of the holding member 120, in this embodiment) upstream from the flow-path member 200. The first distribution flow path 251 will be described below. In this embodiment, each of two first flow paths 241*a* and 241*b* has a first introduction flow path 281*a* and a first introduction flow path 281*b*.

Specifically, the first introduction flow path 281*a* is constituted of a through-hole 211 and a through-hole 221 which communicate with each other. The through-hole 211 is open to the top surface of a protrusion portion 212 which is provided on the Z2-side surface of the first flow-path member 210 and the through-hole 211 passes through, in the Z direction, both the first flow-path member 210 and the protrusion portion 212. The through-hole 221 passes through the second flow-path member 220 in the Z direction. The first introduction flow path 281*b* has a similar configuration. Hereinafter, the first introduction flow path 281 indicates both the first introduction flow path 281*a* and the first introduction flow path 281*b*.

The second flow path 242 includes a second introduction flow path 282. The second introduction flow path 282 connects a second distribution flow path 252 of the second flow path 242 and a flow path (which is the flow path of the holding member 120, in this embodiment) upstream from the flow-path member 200. The second distribution flow path 252 will be described below. In this embodiment, each of two second flow paths 242*a* and 242*b* has a second introduction flow path 282*a* and a second introduction flow path 282*b*.

Specifically, the second introduction flow path 282*a* is a through-hole open on the top surface of a protrusion portion 212 which is provided on the Z2-side surface of the first flow-path member 210. The second introduction flow path 282*a* passes through, in the Z direction, both the first flow-path member 210 and the protrusion portion 212. The second introduction flow path 282*b* has a similar configuration. Hereinafter, the second introduction flow path 282 indicates both the second introduction flow path 282*a* and the second introduction flow path 282*b*.

The introduction flow path 280 indicates all of the four introduction flow paths described above.

In this embodiment, in a plan view illustrated in FIG. 10, the first introduction flow path 281*a* is disposed in the vicinity of an upper left corner of the first flow-path member 210 and the first introduction flow path 281*b* is disposed in the vicinity of a lower right corner of the first flow-path member 210. In the plan view illustrated in FIG. 10, the second introduction flow path 282*a* is disposed in the vicinity of a upper right corner of the first flow-path member 210 and the second introduction flow path 282*b* is disposed in the vicinity of a lower left corner of the first flow-path member 210.

The first flow path 241 includes the first distribution flow path 251 which is formed by both the second flow-path member 220 and the third flow-path member 230. The first distribution flow path 251 is a part of the first flow path 241, through which ink flows in a direction parallel to the liquid ejection surface 20*a*. In this embodiment, two first flow paths 241 are formed, and thus two first distribution flow paths 251 are formed. One of the two first distribution flow paths 251 is referred to as a first distribution flow path 251*a* and the other is referred to as a first distribution flow path 251*b*.

A distribution groove portion 226*a* and a distribution groove portion 231*a* are matched and sealed, in such a manner that the first distribution flow path 251*a* is formed. The distribution groove portion 226*a* is formed on the Z1-side surface of the second flow-path member 220 and extends in the Y direction. The distribution groove portion 231*a* is formed on the Z2-side surface of the third flow-path member 230 and extends in the Y direction. A distribution groove portion 226*b* and a distribution groove portion 231*b* are matched and sealed, in such a manner that the first distribution flow path 251*b* is formed. The distribution groove portion 226*b* is formed on the Z1-side surface of the second flow-path member 220 and extends in the Y direction. The distribution groove portion 231*b* is formed on the Z2-side surface of the third flow-path member 230 and extends in the Y direction.

The first distribution flow path 251*a* is constituted of both the distribution groove portions 226*a* in the second flow-path member 220 and the distribution groove portion 231*a* in the third flow-path member 230 and the first distribution flow path 251*b* is constituted of both the distribution groove portion 226*b* in the second flow-path member 220 and the distribution groove portion 231*b* in the third flow-path member 230. As a result, the cross-sectional areas of the first distribution flow paths 251*a* and 251*b* are widened, and thus pressure losses in the first distribution flow paths 251*a* and 251*b* are reduced. The first distribution flow path 251*a* may be constituted of only the distribution groove portion 226*a* in the second flow-path member 220 and the first distribution flow path 251*b* may be constituted of only the distribution groove portion 226*b* in the second flow-path member 220. Alternatively, the first distribution flow path 251*a* may be constituted of only the distribution groove portion 231*a* in the third flow-path member 230 and the first distribution flow path 251*b* may be constituted of only the distribution groove portion 231*b* in the third flow-path member 230. The distribution groove portions 226*a* and 226*b* are formed in only the second flow-path member 220 on the Z2 side, in such a manner that degrees of freedom in the arrangement of the first flow path 241 can be improved while preventing the first distribution flow paths 251*a* and 251*b* from interfering with the COF substrate 98 of which the Xa-direction width is reduced as the COF substrate 98 extends from the Z1 side to the Z2 side, as described below.

The first distribution flow path 251*a* and the first distribution flow path 251*b* are disposed in both areas located X-directionally outside the opening portion 201 (in other words, a third opening portion 235) through which the COF substrate 98 is inserted.

The second flow path 242 includes the second distribution flow path 252 which is formed by both the first flow-path member 210 and the second flow-path member 220. The second distribution flow path 252 is a part of the second flow path 242, through which ink flows in a direction parallel to the liquid ejection surface 20*a*. In this embodiment, two second flow paths 242 are formed, and thus two second distribution flow paths 252 are formed. One of the two second distribution flow paths 252 is referred to as a second distribution flow path 252*a* and the other is referred to as a second distribution flow path 252*b*.

A distribution groove portion 213*a* and a distribution groove portion 222*a* are matched and sealed, in such a manner that the second distribution flow path 252*a* is formed. The distribution groove portion 213*a* is formed on the Z1-side surface of the first flow-path member 210 and extends in the Y direction. The distribution groove portion 222*a* is formed on the Z2-side surface of the second flow-path member 220 and extends in the Y direction. A distribution groove portion 213*b* and a distribution groove portion 222*b* are matched and sealed, in such a manner that the second distribution flow path 252*b* is formed. The distribution groove portion 213*b* is formed on the Z1-side surface of the first flow-path member 210 and extends in the Y direction. The distribution groove portion 222*b* is formed on the Z2-side surface of the second flow-path member 220 and extends in the Y direction.

The second distribution flow path 252*a* is constituted of both the distribution groove portions 213*a* in the first flow-path member 210 and the distribution groove portion 222*a* in the second flow-path member 220 and the second distribution flow path 252*b* is constituted of both the distribution groove portion 213*b* in the first flow-path member 210 and the distribution groove portion 222*b* in the second flow-path member 220. As a result, the cross-sectional areas of the second distribution flow paths 252*a* and 252*b* are widened, and thus pressure losses in the second distribution flow paths 252*a* and 252*b* are reduced. The second distribution flow path 252*a* may be constituted of only the distribution groove portion 213*a* in the first flow-path member 210 and the second distribution flow path 252*b* may be constituted of only the distribution groove portion 213*b* in the first flow-path member 210. Alternatively, the second distribution flow path 252*a* may be constituted of only the distribution groove portion 222*a* in the second flow-path member 220 and the second distribution flow path 252*b* may be constituted of only the distribution groove portion 222*b* in the second flow-path member 220. The distribution groove portions 222*a* and 222*b* are formed in only the first flow-path member 210 on the Z2 side, in such a manner that, similarly to in the case of the first distribution flow paths 251*a* and 251*b* described above, degrees of freedom in the arrangement of the second flow path 242 can be improved while preventing the second distribution flow paths 252*a* and 252*b* from interfering with the COF substrate 98.

The second distribution flow path 252*a* and the second distribution flow path 252*b* are disposed in both areas located X-directionally outside the opening portion 201 (in other words, a second opening portion 225) through which the COF substrate 98 is inserted.

Hereinafter, the first distribution flow path 251 indicates both the first distribution flow path 251*a* and the first distribution flow path 251*b*. Furthermore, the second distribution flow path 252 indicates both the second distribution flow path 252*a* and the second distribution flow path 252*b*. In addition, the 250 indicates all of the four distribution flow paths described above.

Figure 19:
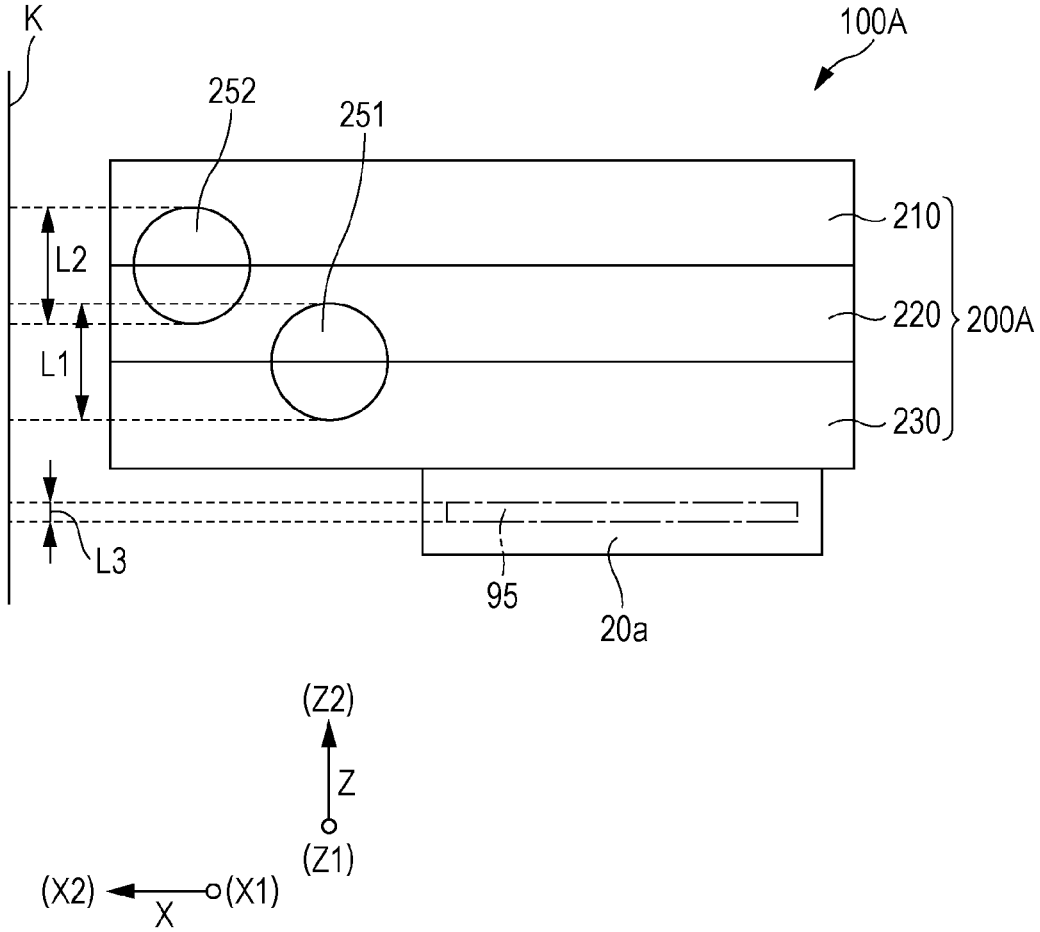
FIG. 19 is a side view of the recording head, in which the positional relationship between distribution flow paths is schematically illustrated.

The first distribution flow path 251 and the second distribution flow path 252 are not arranged on the same plane, as described above. In other words, the first distribution flow path 251 and the second distribution flow path 252 are located at different positions in the Z direction. The arrangement relating to both the first distribution flow path 251 and the second distribution flow path 252 will be described with reference to FIG. 19. FIG. 19 is a side view of the recording head, in which the positional relationship between the first distribution flow path 251 and the second distribution flow path 252 is schematically illustrated.

The meaning of "the first distribution flow path 251 and the second distribution flow path 252 are located at different positions in the Z direction" implies that, in a plane K perpendicular to the liquid ejection surface 20*a*, projection images L1 and L2 obtained by orthogonally projecting both the first distribution flow path 251 and the second distribution flow path 252 do not satisfy a relationship in which one of the projection images does not include the other. In other words, when the projection image L1 and the projection image L2 do not overlap or the projection image L1 and the projection image L2 partially overlap, the first distribution flow path 251 and the second distribution flow path 252 are located at different positions in the Z direction. In contrast, when the projection image L1 and the projection image L2 overlap each other or one projection image includes the other projection image, the first distribution flow path 251 and the second distribution flow path 252 are not located at different positions in the Z direction.

Furthermore, the manifold 95, the first distribution flow path 251, and the second distribution flow path 252 are not formed on the same plane. In other words, a projection image L3 obtained by orthogonally projecting the manifold 95 onto the plane K does not overlap the projection images L1 and L2.

Returning to FIGS. 10 to 16, the first distribution flow path 251 and the second distribution flow path 252 are disposed at different positions in the Z direction, as described above. As a result, the size of the flow-path member 200 in the in-plane direction parallel to the liquid ejection surface 20*a* can be reduced, compared to in the case where the first distribution flow path 251 and the second distribution flow path 252 are formed on the same plane. Preferably, the first distribution flow path 251 and the second distribution flow path 252 are arranged in a state where, when the first distribution flow path 251 and the second distribution flow path 252 are orthogonally projected onto the liquid ejection surface 20*a*, at least parts of the projection images of the distribution flow paths overlap. In this case, the size of the flow-path member 200 in the in-plane direction parallel to the liquid ejection surface 20*a* can be reduced.

In the first flow path 241 of this embodiment, one introduction flow path 280 branches into a plurality of connection portions 290. In other words, the first distribution flow path 251 branches into a plurality of first bifurcation flow paths 261, in the same surface (which is a boundary surface in which the second flow-path member 220 and the third flow-path member 230 are bonded to each other).

In this embodiment, the first distribution flow path 251 branches into six first bifurcation flow paths 261, in the surface (which is a boundary surface between the second flow-path member 220 and the third flow-path member 230) parallel to the liquid ejection surface 20*a*. The six first bifurcation flow paths 261 branched from the first distribution flow path 251*a* are referred to as first bifurcation flow paths 261*a*1 to 261*a*6. Hereinafter, the first bifurcation flow path 261*a* indicates all of the six bifurcation flow paths connected to the first bifurcation flow path 261*a*.

Similarly, six first bifurcation flow paths 261 branched from the first distribution flow path 251*b* are referred to as first bifurcation flow paths 261*b*1 to 261*b*6. Hereinafter, the first bifurcation flow path 261*b* indicates all of the six bifurcation flow paths connected to the first bifurcation flow path 261*b*. In addition, the first bifurcation flow path 261 indicates all of the twelve bifurcation flow paths connected to the first bifurcation flow paths 261*a* and 261*b*.

Reference letters and numerals corresponding to the first bifurcation flow paths 261*a*2 to 261*a*5 of the six first bifurcation flow paths 261*a*1 to 261*a*6 aligned in the Y direction are omitted in the accompanying drawings. However, it is assumed that the first bifurcation flow paths 261*a*2 to 261*a*5 are aligned in order from the Y1 side to the Y2 side. The first bifurcation flow paths 261*b*1 to 261*b*6 have a similar configuration to that described above.

Specifically, a plurality of branch groove portions 232*a* which communicate with the distribution groove portion 231*a* and extend to the opening portion 201 side are provided in the Z2-side surface of the third flow-path member 230. A plurality of branch groove portions 227*a* which communicate with the distribution groove portion 226*a* and extend to the opening portion 201 side are provided in the Z1-side surface of the second flow-path member 220. The branch groove portion 227*a* and the branch groove portion 232*a* are sealed in a state where the branch groove portion 227*a* and the branch groove portion 232*a* face each other, in such a manner that the first bifurcation flow path 261*a* is formed.

A plurality of branch groove portions 232*b* which communicate with the distribution groove portion 231*b* and extend to the opening portion 201 side are provided in the Z2-side surface of the third flow-path member 230. A plurality of branch groove portions 227*b* which communicate with the distribution groove portion 226*b* and extend to the opening portion 201 side are provided in the Z1-side surface of the second flow-path member 220. The branch groove portion 227*b* and the branch groove portion 232*b* are sealed in a state where the branch groove portion 227*b* and the branch groove portion 232*b* face each other, in such a manner that the first bifurcation flow path 261*b* is formed.

The first bifurcation flow path 261*a* is constituted of both the branch groove portions 227*a* in the second flow-path member 220 and the branch groove portion 232*a* in the third flow-path member 230 and the first bifurcation flow path 261*b* is constituted of both the branch groove portion 227*b* in the second flow-path member 220 and the branch groove portion 232*b* in the third flow-path member 230. As a result, the cross-sectional areas of the first bifurcation flow paths 261*a* and 261*b* are widened, and thus pressure losses in the first bifurcation flow paths 261*a* and 261*b* are reduced. The first bifurcation flow path 261*a* may be constituted of only the branch groove portion 227*a* in the second flow-path member 220 and the first bifurcation flow path 261*b* may be constituted of only the branch groove portion 227*b* in the second flow-path member 220. Alternatively, the first bifurcation flow path 261*a* may be constituted of only the branch groove portion 232*a* in the third flow-path member 230 and the first bifurcation flow path 261*b* may be constituted of only the branch groove portion 232*b* in the third flow-path member 230. For example, the branch groove portions 227*a* and 227*b* are formed in only the second flow-path member 220 on the Z2 side. As a result, in an area Q which is inclined in the Ya direction, and thus the Ya-direction width increases as the area Q extends from the Z1 side to the Z2 side, as described below, degrees of freedom in the arrangement of the first flow path 241 can be improved while preventing interference with the COF substrate 98. Furthermore, the branch groove portions 232*a* and 232*b* are formed in only the third flow-path member 230 on the Z1 side. As a result, in an area P of which the width in the Ya direction increases as the area P extends from the Z2 side to the Z1 side, degrees of freedom in the arrangement of the first flow path 241 can be improved while preventing interference with the COF substrate 98.

In the second flow path 242, one introduction flow path 280 branches into a plurality of connection portions 290. The second distribution flow path 252 branches into a plurality of second bifurcation flow paths 262, in the same surface (which is a boundary surface in which the first flow-path member 210 and the second flow-path member 220 are bonded to each other). Details of this will be described below.

In this embodiment, the second distribution flow path 252 branches into six second bifurcation flow paths 262, in the surface (which is a boundary surface between the first flow-path member 210 and the second flow-path member 220) parallel to the liquid ejection surface 20*a*. The six second bifurcation flow paths 262 branched from the second distribution flow path 252*a* are referred to as second bifurcation flow paths 262*a*1 to 262*a*6.

Similarly, six second bifurcation flow paths 262 branched from the second distribution flow path 252*b* are referred to as second bifurcation flow paths 262*b*1 to 262*b*6.

Hereinafter, the second bifurcation flow path 262*a* indicates all of the six bifurcation flow paths connected to the second bifurcation flow path 262*a*. The second bifurcation flow path 262*b* indicates all of the six bifurcation flow paths connected to the second bifurcation flow path 262*b*. The second bifurcation flow path 262 indicates all of the twelve bifurcation flow paths connected to the second bifurcation flow paths 262*a* and 262*b*. Furthermore, the bifurcation flow path 260 indicates all of the twenty-four bifurcation flow paths described above.

Reference letters and numerals corresponding to second bifurcation flow paths 262*a*2 to 262*a*5 of the six second bifurcation flow paths 262*a*1 to 262*a*6 aligned in the Y direction are omitted in the accompanying drawings. However, it is assumed that the second bifurcation flow paths 262*a*2 to 262*a*5 are aligned in order from the Y1 side to the Y2 side. The second bifurcation flow paths 262*b*1 to 262*b*6 have a similar configuration to that described above.

Specifically, a plurality of branch groove portions 214*a* which communicate with the distribution groove portion 213*a* and extend to the opening portion 201 side are provided in the Z1-side surface of the first flow-path member 210. A plurality of branch groove portions 223*a* which communicate with the distribution groove portion 222*a* and extend to the opening portion 201 side are provided in the Z2-side surface of the second flow-path member 220. The branch groove portion 214*a* and the branch groove portion 223*a* are sealed in a state where the branch groove portion 214*a* and the branch groove portion 223*a* face to each other, in such a manner that the second bifurcation flow path 262*a* is formed.

A plurality of branch groove portions 214*b* which communicate with the distribution groove portion 213*b* and extend to the opening portion 201 side are provided in the Z1-side surface of the first flow-path member 210. A plurality of branch groove portions 223*b* which communicate with the distribution groove portion 222*b* and extend to the opening portion 201 side are provided in the Z2-side surface of the second flow-path member 220. The branch groove portion 214*b* and the branch groove portion 223*b* are sealed in a state where the branch groove portion 214*b* and the branch groove portion 223*b* face each other, in such a manner that the second bifurcation flow path 262*b* is formed.

The second bifurcation flow path 262*a* is constituted of both the branch groove portions 214*a* in the first flow-path member 210 and the branch groove portion 223*a* in the second flow-path member 220 and the second bifurcation flow path 262*b* is constituted of both the branch groove portion 214*b* in the first flow-path member 210 and the branch groove portion 223*b* in the second flow-path member 220. As a result, the cross-sectional areas of the second bifurcation flow paths 262*a* and 262*b* are widened, and thus pressure losses in the second bifurcation flow paths 262*a* and 262*b* are reduced. The second bifurcation flow path 262*a* may be constituted of only the branch groove portion 214*a* in the first flow-path member 210 and the second bifurcation flow path 262*b* may be constituted of only the branch groove portion 214*b* in the first flow-path member 210. Alternatively, the second bifurcation flow path 262*a* may be constituted of only the branch groove portion 223*a* in the second flow-path member 220 and the second bifurcation flow path 262*b* may be constituted of only the branch groove portion 223*b* in the second flow-path member 220. For example, the branch groove portions 214*a* and 214*b* are formed in only the first flow-path member 210 on the Z2 side. As a result, in the area Q which is inclined in the Ya direction, and thus the Ya-direction width increases as the area Q extends from the Z1 side to the Z2 side, as described below, degrees of freedom in the arrangement of the second flow path 242 can be improved while preventing interference with the COF substrate 98. Furthermore, the branch groove portions 223*a* and 223*b* are formed in only the second flow-path member 220 on the Z1 side. As a result, in the area P of which the width in the Ya direction increases as the area P extends from the Z2 side to the Z1 side, degrees of freedom in the arrangement of the first flow path 241 can be improved while preventing interference with the COF substrate 98.

An end portion of the first bifurcation flow path 261, which is the end portion on a side opposite to the first distribution flow path 251, is connected to a first vertical flow path 271. Specifically, the first vertical flow path 271 is formed as a through-hole which passes through the third flow-path member 230 in the Z direction.

In this embodiment, vertical flow paths are respectively connected to the first bifurcation flow paths 261*a*1 to 261*a*6 and 261*b*1 to 261*b*6. In other words, in total, twelve first vertical flow paths 271*a*1 to 271*a*6 and 271*b*1 to 271*b*6 are respectively connected to the first bifurcation flow paths.

Similarly, an end portion of the second bifurcation flow path 262, which is the end portion on a side opposite to the second distribution flow path 252, is connected to a second vertical flow path 272. Specifically, a through-hole 224 is provided in the second flow-path member 220, in a state where the through-hole 224 passes through the second flow-path member 220 in the Z direction. A through-hole 233 is provided in the third flow-path member 230, in a state where the through-hole 233 passes through the third flow-path member 230 in the Z direction. The through-hole 224 and the through-hole 233 communicate with each other, in such a manner that the second vertical flow path 272 is formed.

In this embodiment, twelve second vertical flow paths 272*a*1 to 272*a*6 and 272*b*1 to 272*b*6 are respectively connected to second bifurcation flow paths 262*a*1 to 262*a*6 and 262*b*1 to 262*b*6.

Hereinafter, a first vertical flow path 271*a* indicates the first vertical flow paths 271*a*1 to 271*a*6. A first vertical flow path 271*b* indicates the first vertical flow paths 271*b*1 to 271*b*6. The first vertical flow path 271 indicates all of the first vertical flow paths 271*a* and the first vertical flow paths 271*b*.

Similarly, a second vertical flow path 272*a* indicates the second vertical flow paths 272*a*1 to 272*a*6. A second vertical flow path 272*b* indicates the second vertical flow paths 272*b*1 to 272*b*6. The second vertical flow path 272 indicates all of the second vertical flow paths 272*a* and the second vertical flow paths 272*b*.

Furthermore, a vertical flow path 270 indicates all of the twenty-four vertical flow paths described above.

Reference letters and numerals corresponding to the first vertical flow paths 271*a*2 to 271*a*5 of the six first vertical flow paths 271*a*1 to 271*a*6 aligned in the Y direction are omitted in the accompanying drawings. However, it is assumed that the first vertical flow paths 271*a*2 to 271*a*5 are aligned in order from the Y1 side to the Y2 side. The first vertical flow paths 271*b*1 to 271*b*6, the second vertical flow paths 272*a*1 to 272*a*6, and the second vertical flow paths 272*b*1 to 272*b*6 have a similar configuration to that described above.

The vertical flow path 270 described above has the connection portion 290 which is an opening on the Z1 side of the third flow-path member 230. The connection portion 290 communicates with the introduction path 44 provided in the head main body 110. Details of this will be described below.

In this embodiment, the first vertical flow paths 271*a*1 to 271*a*6 respectively have first connection portions 291*a*1 to 291*a*6 which are openings on the Z1 side of the third flow-path member 230. In addition, the first vertical flow paths 271*b*1 to 271*b*6 respectively have first connection portions 291*b*1 to 291*b*6 which are openings on the Z1 side of the third flow-path member 230. Similarly, the second vertical flow paths 272*a*1 to 272*a*6 respectively have second connection portions 292*a*1 to 292*a*6 which are openings on the Z1 side of the third flow-path member 230. In addition, the second vertical flow paths 272*b*1 to 272*b*6 respectively have second connection portions 292*b*1 to 292*b*6 which are openings on the Z1 side of the third flow-path member 230.

The first connection portion 291*a*1, the first connection portion 291*b*1, the second connection portion 292*a*1, and the second connection portion 292*b*1 are connected to one of the six head main bodies 110. The first connection portions 291*a*2 to 291*a*6, the first connection portions 291*b*2 to 291*b*6, the second connection portions 292*a*2 to 292*a*6, and the second connection portions 292*b*2 to 292*b*6 have a similar configuration to that described above. In other words, the first flow path 241*a*, the first flow path 241*b*, the second flow path 242*a*, and the second flow path 242*b* are connected to one head main body 110.

Hereinafter, the first connection portion 291*a* indicates the first connection portions 291*a*1 to 291*a*6. The first connection portion 291*b* indicates the first connection portions 291*b*1 to 291*b*6. A first connection portion 291 indicates all of the first connection portions 291*a* and the first connection portions 291*b*.

Similarly, the second connection portion 292*a* indicates the second connection portions 292*a*1 to 292*a*6. The second connection portion 292*b* indicates the second connection portion 292*b*1 to 292*b*6. A second connection portion 292 indicates all of the second connection portions 292*a* and the second connection portions 292*b*.

Furthermore, a connection portion 290 indicates all of the twenty-four connection portions described above.

The flow-path member 200 according to this embodiment includes four flow paths 240, in other words, the first flow path 241*a*, the first flow path 241*b*, a second flow path 242*a*, and a second flow path 242*b*, as described above. In each flow path 240, a part extending from the introduction flow path 280 as an ink inlet port to a distribution flow path 250 constitutes one flow path and the distribution flow path 250 branches into bifurcation flow paths 260. The bifurcation flow paths 260 are connected to a plurality of head main bodies 110 via both the vertical flow paths 270 and the connection portions 290.

In this embodiment, a black ink Bk, a magenta ink M, a cyan ink C, and a yellow ink Y are used. The cyan ink C, the yellow ink Y, the black ink Bk, and the magenta ink M are respectively supplied from the liquid storage units (not illustrated) to the first flow path 241*a*, the first flow path 241*b*, the second flow path 242*a*, and the second flow path 242*b*. The color inks respectively flow through the first flow path 241*a*, the first flow path 241*b*, the second flow path 242*a*, and the second flow path 242*b*, and then the color inks are supplied to the head main bodies 110.

In addition, the opening portion 201 is provided in the flow-path member 200. The COF substrate 98 provided in the head main body 110 is inserted through the opening portion 201. In this embodiment, the first opening portion 215 is provided in the first flow-path member 210. The first opening portion 215 is inclined with respect to the Z direction and passes through the first flow-path member 210. The second opening portion 225 is provided in the second flow-path member 220, the second opening portion 225 is inclined with respect to the Z direction and passes through the second flow-path member 220. The third opening portion 235 is provided in the third flow-path member 230. The third opening portion 235 is inclined with respect to the Z direction and passes through the third flow-path member 230.

The first opening portion 215, the second opening portion 225, and the third opening portion 235 communicate with one another, in such a manner that one opening portion 201 is formed. The opening portion 201 has an opening shape extending in the Xa direction. Six opening portions 201 are aligned in the Y direction.

In this case, The COF substrate 98 according to this embodiment includes a lower end portion 98*c* and an upper end portion 98*d*, as illustrated in FIG. 16. The lower end portion 98*c* is one end portion of the COF substrate 98, which is close, in the Z direction, to the head main body 110. The upper end portion 98*d* is the other end portion of the COF substrate 98, which is far away, in the Z direction, from the head main body 110. The width of the upper end portion 98*d* in the Xa direction is greater than the width of the lower end portion 98*c* in the Xa direction.

In this embodiment, a part of the COF substrate 98, which is inserted through the first opening portion 215, and a part of the COF substrate 98, which is inserted through the third opening portion 235, have a rectangular shape of which the Xa-direction width is constant. A part of the COF substrate 98, which is inserted through the second opening portion 225, has a trapezoidal shape of which the Xa-direction width is reduced as part of the COF substrate 98 extends from the Z1 side to the Z2 side.

Meanwhile, the opening portion 201 of the flow-path member 200 has a first opening 236 (in other words, the Z1-side opening of the third opening portion 235) and a second opening 216 (in other words, the Z2-side opening of the first opening portion 215). In the Z direction perpendicular to the liquid ejection surface 20*a*, the first opening 236 is close to the head main body 110 and the second opening 216 is far away from the head main body 110.

The size of the second opening 216 in the Xa direction is smaller than the size of the first opening 236 in the Xa direction. In other words, the width of the opening portion 201 in the Xa direction is reduced as the opening portion 201 extends from the Z1 side to the Z2 side in the Z direction. Specifically, the opening portion 201 has a shape allowing the COF substrate 98 to be accommodated therein. The width of the opening portion 201 in the Xa direction is slightly greater than the width of the COF substrate 98 in the Xa direction.

Figure 17B:
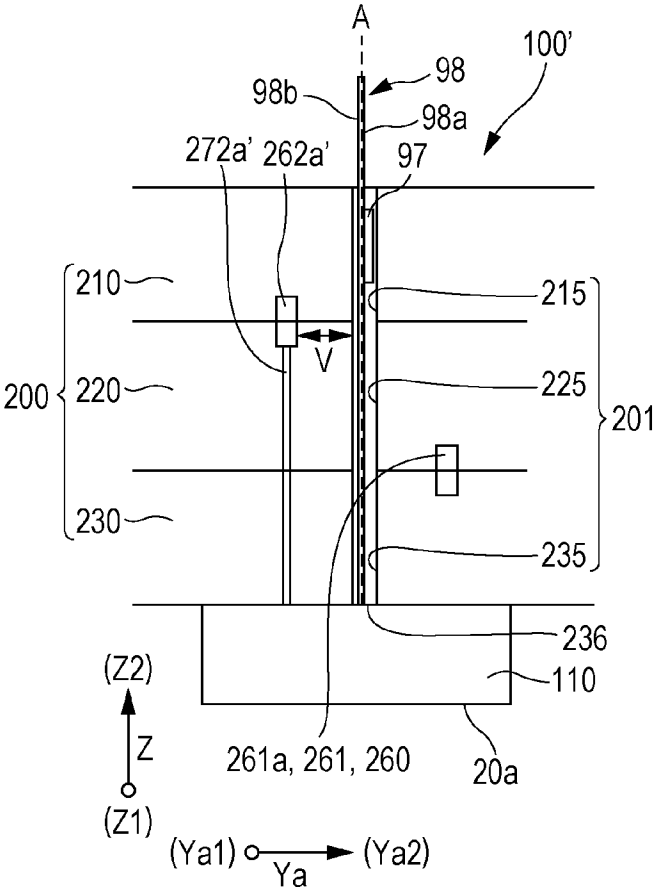
FIG. 17B is a schematic cross-sectional view of a comparative example.
Figure 17A:
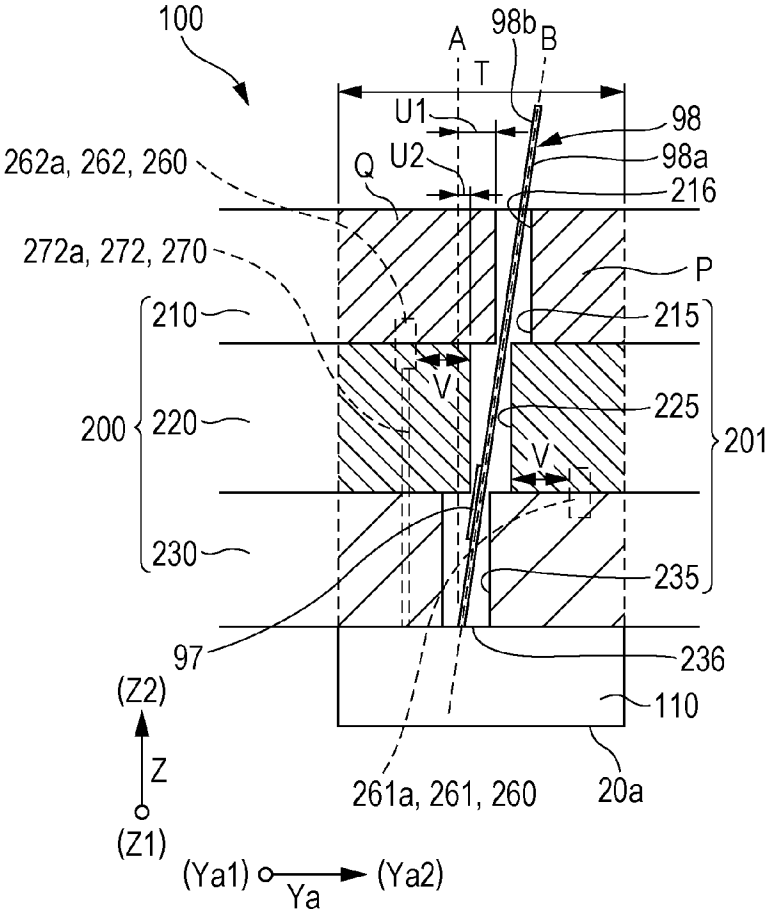
FIG. 17A is a cross-sectional view of FIGS. 10 to 13, taken along a line XVIIA-XVIIA.

The inclination of the COF substrate 98 inserted through the opening portion 201 of the flow-path member 200 will be described with reference to FIGS. 17A and 17B. FIG. 17A is a cross-sectional view of FIGS. 10 to 13, taken along line XVIIA-XVIIA. In other words, FIG. 17A is a schematic side view in which one head main body of the recording head according to this embodiment is seen from the Xa2 side to the Xa1 side in the Xa direction. FIG. 17B is a schematic side view in which a head main body according to a comparative example is seen from the Xa2 side to the Xa1 side in the Xa direction.

The first opening portion 215, the second opening portion 225, and the third opening portion 235 communicate with one another, in such a manner that one opening portion 201 is provided in the flow-path member 200, as illustrated in FIG. 17A. In this case, a plane of the COF substrate 98 which passes through both the first opening 236 of the opening portion 201 of the flow-path member 200, which is the opening on the head main body 110 side, and the second opening 216 of the opening portion 201, which is the opening on the side opposite to the head main body 110 side, is set to a plane B (which is illustrated, in FIG. 17A, by a straight line). A plane which intersects, in the first opening 236, the plane B, is parallel to the Xa direction, and is perpendicular to the liquid ejection surface 20*a* is set to a plane A (which is illustrated, in FIGS. 17A and 17B, by a straight line). In this case, the plane B of the COF substrate 98 intersects the plane A perpendicular to the liquid ejection surface 20*a*.

Specifically, the second opening 216 and the first opening 236 are disposed at different positions in the Ya direction. In this embodiment, respective second openings 216 of the six opening portions 201 and the first openings 236 corresponding thereto are staggered, by a predetermined distance, to the Ya2 side in the Ya direction. In other words, the opening portion 201 is inclined in a state where the second opening 216 side of the plane B is far away from the plane A, from the Ya1 side to the Ya2 side in the Ya direction.

The COF substrate 98 extends from the connection port 43 (see FIG. 8) on the head main body 110 side to the flow-path member 200. In the flow-path member 200 in a portion between the head main body 110 and the relay substrate 140 (see FIG. 2), the COF substrate 98 is inclined in a direction directed toward one surface side of the COF substrate 98. Here, the one surface of the COF substrate 98 is referred to as a first surface 98*a* and the other surface is referred to as a second surface 98*b*. In this case, the first surface 98*a* of the COF substrate 98 is a surface on a side in which the surface does not face the plane A, in other words, a surface on the Ya2 side in the Ya direction. The second surface 98*b* of the COF substrate 98 is a surface on a side in which the surface faces the plane A, in other words, a surface on the Ya1 side in the Ya direction.

The meaning of "in the flow-path member 200 in the portion between the head main body 110 and the relay substrate 140, the COF substrate 98 is inclined in a direction directed to the first surface 98*a* side", implies that a part of the COF substrate 98 which is a portion from the head main body 110 to the second opening 216 as an outlet port of the opening portion 201 of the flow-path member 200 is inclined in the direction toward the first surface 98*a* side. Accordingly, a part of the COF substrate 98, which is a portion protruding from the second opening 216 and is connected to the surface of the relay substrate 140 can be inclined in any direction.

The opening portion 201 has a Ya-direction width in which a gap between the opening portion 201 and a part of the inclined COF substrate 98, which is a portion closest to the opening portion 201, is approximately constant in a portion between the Ya1 side and the Ya2 side. Specifically, the first opening portion 215 has a Ya-direction width in which a gap between the inclined COF substrate 98 and the first flow-path member 210 is approximately constant. The second opening portion 225 has a Ya-direction width in which a gap between the inclined COF substrate 98 and the second flow-path member 220 is approximately constant. In addition, the third opening portion 235 has a Ya-direction width in which a gap between the inclined COF substrate 98 and the third flow-path member 230 is approximately constant. For ease of processing of the flow-path member 200, the first opening portion 215, the second opening portion 225, and the third opening portion 235 have an opening shape passing through the flow-path members in the Z direction. When viewed from the Xa direction, the opening portion 201 has a step shape, as illustrated in FIG. 17A. Needless to say, the opening portion 201 may be inclined in accordance with the inclination of the COF substrate 98. The COF substrate 98 is inserted through such an opening portion 201, and thus the COF substrate 98 inserted through the opening portion 201 is inclined in the direction toward the first surface 98*a* side (in other words, the Ya2 side), with respect to the plane A.

In the Z2-side surface of the head main body 110, the introduction paths 44 are formed around the connection port 43, as illustrated in FIG. 8. The introduction paths 44 are arranged in a state where a gap between the connection port 43 and the introduction path 44 which is located on the Ya1 side, in relation to the connection port 43 of the COF substrate 98, and a gap between the connection port 43 and the introduction path 44 which is located on the Ya2 side are substantially the same. The COF substrate 98 is disposed in a state where a part of the COF substrate 98, which is a portion connected to the lead electrodes 90 extending to both sides of the COF substrate 98 in the Ya direction, is located at a substantially central position of the connection port 43 so as to ease the electrical connection between the COF substrate 98 and the lead electrodes 90 extending to both sides of the COF substrate 98 in the Ya direction. In other words, the COF substrate 98 is disposed, in the Ya direction, closer to one side (which is the Ya1 side, in FIG. 8) surface of the connection port 43. As a result, the COF substrate 98 is disposed, in the Ya direction, closer to one of the introduction paths 44. However, in the flow-path member 200, either a gap between the COF substrate and the Ya1 side in the Ya direction or a gap between the COF substrate and the Ya2 side is set to be approximately constant. As a result, the flow-path member 200 is prevented from coming into contact with the COF substrate 98 and the size of the flow-path member 200 is reduced in the Ya direction.

The first flow path 241 in the flow-path member 200 is connected to the head main body 110 corresponding thereto, through the first bifurcation flow path 261 on the first surface 98*a* side of the COF substrate 98 inclined as described above. The second flow path 242 is connected to the head main body 110 corresponding thereto, through the second bifurcation flow path 262 on the second surface 98*b* side.

Figure 18:
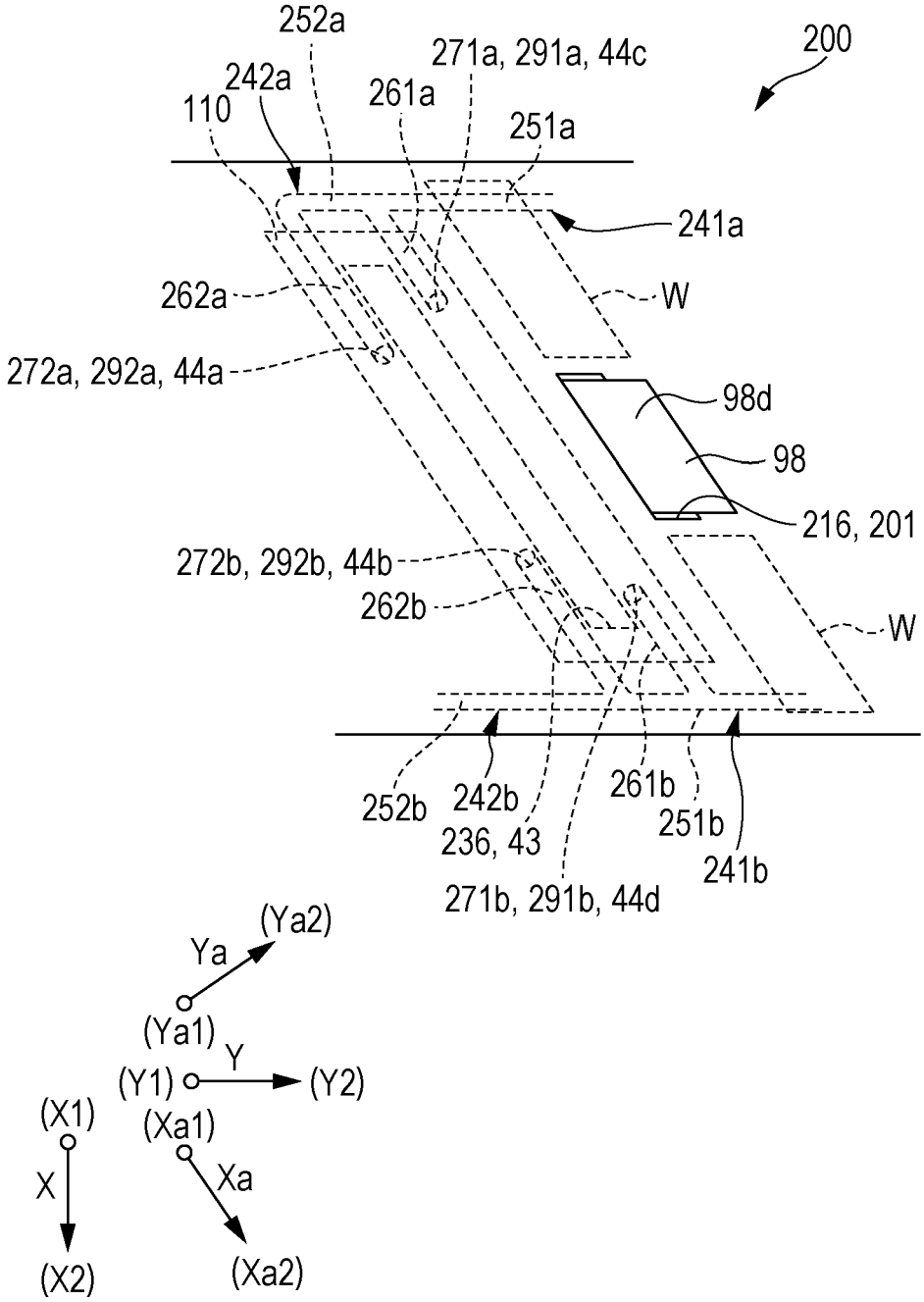
FIG. 18 is a schematic plan view of the head main body according to Embodiment 1 of the invention.

This will be described with reference to FIGS. 17A, 17B, and 18. FIG. 18 is a schematic plan view of one head main body of the recording head according to this embodiment, in which the head main body is viewed from the Z2 side to the Z1 side in the Z direction.

In the Z2-side surface of the head main body 110, four introduction paths 44 are formed around the connection port 43, as illustrated in FIG. 18 (see FIG. 7). Specifically, two introduction paths 44*a* and 44*b* are open in areas further on the Ya1 side in the Ya direction than the connection port 43. The positions of the two introduction paths 44*a* and 44*b* and the position of the connection port 43 overlap in the Xa direction. The introduction path 44*a* is disposed further on the Xa1 side in the Xa direction than the introduction path 44*b*. Two remaining introduction paths 44*c* and 44*d* are open in areas further on the Ya2 side in the Ya direction than the connection port 43. The positions of the two introduction paths 44*c* and 44*d* and the position of the connection port 43 overlap in the Xa direction. The introduction path 44*c* is disposed further on the Xa1 side in the Xa direction than the introduction path 44*d*. The connection port 43 and the first opening 236 have substantially the same shape. The connection port 43 and the first opening 236 communicate with each other.

An introduction path 44*a* is connected to the second flow path 242*a*, in other words, the second introduction flow path 282*a* (see FIG. 14), the second distribution flow path 252*a*, the second bifurcation flow path 262*a*, the second vertical flow path 272*a*, and the second connection portion 292*a*.

An introduction path 44*b* is connected to the second flow path 242*b*, in other words, the second introduction flow path 282*b* (see FIG. 15), the second distribution flow path 252*b*, the second bifurcation flow path 262*b*, the second vertical flow path 272*b*, and the second connection portion 292*b*.

An introduction path 44*c* is connected to the first flow path 241*a*, in other words, the first introduction flow path 281*a* (see FIG. 14), the first distribution flow path 251*a*, the first bifurcation flow path 261*a*, the first vertical flow path 271*a*, and the first connection portion 291*a*.

An introduction path 44*d* is connected to the first flow path 241*b*, in other words, the first introduction flow path 281*b* (see FIG. 15), the first distribution flow path 251*b*, the first bifurcation flow path 261*b*, the first vertical flow path 271*b*, and the first connection portion 291*b*.

The relationship between the introduction paths 44*a* to 44*d*, the first flow path 241, and the second flow path 242 are the same in the six head main bodies 110.

The first flow path 241 is connected to the head main body 110, in an area on the first surface 98*a* side of the COF substrate 98, as described above. In addition, the second flow path 242 is connected to the head main body 110, in an area on the second surface 98*b* side of the COF substrate 98.

In this case, the COF substrate 98 is inclined in the direction toward the first surface 98*a* side and, further, the opening portion 201 is inclined in the direction toward the first surface 98*a* side (that is, the Y2 side), as illustrated in FIG. 17A. When the opening portion 201 is inclined in the direction toward the first surface 98*a* side, as described above, the area of the flow-path member 200, in which the flow paths 240 can be formed, can be constituted of a wide area and a narrow area.

The meaning of "an area of the flow-path member 200, in which the flow paths 240 can be formed, can be constituted of a wide area and a narrow area" implies that an area T of the flow-path member 200, which is the area corresponding to the head main body 110, is divided, in the Ya direction in which the COF substrate 98 is inclined, into the area P and the area Q with the opening portion 201 which is interposed between the area P and the area Q and through which the COF substrate 98 is inserted. In the area T, the area P is an area on the first surface 98*a* side of the COF substrate 98 and the area Q is an area on the second surface 98*b* side of the COF substrate 98. In the same Z-direction surface, the width of the area Q in the Ya direction is greater than the width of the area P in the Ya direction.

In this embodiment, in the area T which forms parts of the first flow-path member 210, the second flow-path member 220, and the third flow-path member 230 constituting the flow-path member 200 and which corresponds to the head main body 110, an area on the first surface 98*a* side in the Ya direction is the area P and an area on the second surface 98*b* side is the area Q. The areas P and Q are hatched in the accompanying drawings.

In this embodiment, the COF substrate 98 is inclined, as illustrated in FIG. 17A. Accordingly, in the Z1-side surface of the first flow-path member 210, which is an example of the same-direction surface, the area Q is increased by a Ya-direction width U1 and the Ya-direction width of the area P is reduced by the width U1. Similarly, in the Z2-side surface of the second flow-path member 220, which is an example of a same-direction surface, the area Q is increased by a Ya-direction width U2 and the Ya-direction width of the area P is reduced by the width U2.

The Ya-direction width of the area Q is increased as the area Q extends from the Z1 side to the Z2 side in the Z direction. In this embodiment, the first flow-path member 210 has a relatively large width difference between the area P and the area Q, compared to in the case of the second flow-path member 220. Similarly, the second flow-path member 220 has a relatively large width difference between the area P and the area Q, compared to in the case of the third flow-path member 230. In other words, a width difference between the area P and the area Q is increased in the flow-path member 200, as the flow-path member 200 extends from the head main body 110 to the relay substrate 140.

The second bifurcation flow path 262 which is disposed in a plane parallel to the liquid ejection surface 20*a* is disposed in the area Q having a large width. The meaning of "the area Q having a large width has a portion in which the second flow path 242 is provided in a state where the second flow path 242 extends along the liquid ejection surface 20*a*" implies that at least a part of a flow path constituting the second flow path 242 is provided, in the area Q, in the plane parallel to the liquid ejection surface 20*a* and the part of the flow path is connected to the introduction path 44 of the head main body 110.

In this embodiment, the second bifurcation flow path 262*a* of the second flow path 242*a* is provided in the area Q. In addition, the second bifurcation flow path 262*b* of the second flow path 242*b* is provided in the area Q.

In the recording head 100 according to this embodiment, the COF substrate 98 is inclined in the direction toward the first surface 98*a* side. Accordingly, the opening portion 201 of the flow-path member 200 can be provided close to the first surface 98*a* side, and thus the area in which the flow paths 240 of the flow-path member 200 can be formed can be constituted of a wide area and a narrow area. As a result, the second bifurcation flow path 262 constituting the second flow path 242 can be disposed in the area Q which is wider than the area P. In other words, since the second bifurcation flow path 262 can be disposed in the area Q having a relatively large width, it is easy to provide an optimal configuration of the second flow path 242 in relation to, for example, the arrangement of the head main body 110. In other words, larger the width of area Q is, higher the degrees of freedom in the arrangement of the second flow path 242 is. The degree of freedom in the arrangement of the second flow path 242 is proportional to the Ya-direction width of the area Q and means that higher the degree of freedom is, the easier the second flow path 242 can be provided in the area Q.

In the recording head 100 according to this embodiment, the COF substrate 98 is inclined, and thus the area Q of which the width in the Ya direction is increased can be formed. The Ya-direction width of the area Q is increased, and thus the second bifurcation flow path 262 constituting a part of the second flow path 242 can be provided in a state where the second bifurcation flow path 262 is prevented from interfering, in the Ya direction, with the COF substrate 98.

Therefore, a gap between the second bifurcation flow path 262 and the plane A can be reduced in the Ya direction of the second flow-path member 220, compared to the comparative example described below. Accordingly, the size of the second flow-path member 220, in other words, the size of the flow-path member 200, can be reduced in the Ya direction. As a result, the Ya-direction width of the recording head 100 can be reduced.

Furthermore, the COF substrate 98 of this embodiment is disposed close to the Ya1-side side surface of the connection port 43, as described above. As a result, the COF substrate 98 is disposed close to the introduction path 44 in the area on the Ya1 side of the connection port 43. A constant gap is maintained between the COF substrate 98 and the bifurcation flow path 260 which is connected to the introduction path 44 via the vertical flow path 270. Thus, the degree of freedom in the arrangement of the bifurcation flow path 260 in an area on the Ya1 side of the COF substrate 98 is reduced. However, the COF substrate 98 is inclined in a direction directed to the Ya2 side opposite to the Ya1 side, and thus, even in such a case, the degree of freedom in the arrangement of the bifurcation flow path 260 in the area on the Ya1 side of the COF substrate 98 is increased. As a result, the size of the flow-path member 200 can be reduced in the Ya direction.

In a recording head in which the COF substrate 98 is not inclined, a reduction in size of the flow-path member 200 cannot be achieved. This will be described with reference to FIGS. 17A and 17B.

A gap between the second opening portion 225 and the second bifurcation flow path 262*a* illustrated in FIG. 17A is set to V. A schematic side view of a recording head according to the comparative example is illustrated in FIG. 17B. A recording head 100' according to the comparative example and the recording head 100 have the same configuration, except for in the inclination of the COF substrate 98, the arrangement of the opening portions 201 along the COF substrate 98, and the size of the area T corresponding to the head main body 110.

In the recording head 100', when a gap V of which the size is the same as in the case of the recording head 100 is maintained between the opening portion 201 and a second bifurcation flow path 262*a'* which is provided in a plane parallel to the liquid ejection surface 20*a*, such that the COF substrate 98 is prevented from interfering, in the Ya direction, with the second bifurcation flow path 262*a'*, it is necessary to move the second bifurcation flow path 262*a'* to the Ya1 side in the Ya direction, by extended the width U in the recording head 100. Accordingly, in the recording head 100' according to the comparative example, a gap between the second bifurcation flow path 262*a'* and the plane A is increased in the Ya direction of the flow-path member 200, and thus the size of the flow-path member 200 cannot be reduced in the Ya direction. In other words, the COF substrate 98 is inclined in the direction toward to the first surface 98*a* side, and the second vertical flow path 272*a* can be located close to the COF substrate 98 side, with the width U1 or the width U2, as illustrated in FIG. 17A. In other words, the size of the flow-path member 200 can be reduced in the Ya direction.

In the recording head 100 according to this embodiment, the first distribution flow path 251*a* of the first flow path 241 and the second distribution flow path 252*a* of the second flow path 242 are located at different positions in the Z direction perpendicular to the liquid ejection surface 20*a*, and thus both paths overlap in the Z direction. In addition, the first distribution flow path 251*b* of the first flow path 241 and the second distribution flow path 252*b* of the second flow path 242 are located at different positions in the Z direction, and thus both paths overlap in the Z direction. Accordingly, the size of the recording head 100 can be reduced in a plane direction of the liquid ejection surface 20*a*, compared to in the case where all of a plurality of distribution flow paths are arranged in the same plane.

Furthermore, in the recording head 100 according to this embodiment, the second bifurcation flow path 262 and the head main body 110 are connected through the second vertical flow path 272 extending in a direction perpendicular to the liquid ejection surface 20*a*. Accordingly, in a plan view seen in the Z direction perpendicular to the liquid ejection surface 20*a*, the area of the second vertical flow path 272 is smaller than an inclined flow path used in the case where the second bifurcation flow path 262 and the head main body 110 are connected through the inclined flow path which is inclined with respect to the direction perpendicular to the liquid ejection surface 20*a*. In other words, when the second distribution flow path 252 and the head main body 110 are connected through the second vertical flow path 272, as in the case of this embodiment, the size of the flow-path member 200 when viewed from the top can be reduced. Similarly, The first bifurcation flow path 261 and the head main body 110 are connected through the first vertical flow path 271 extending in the direction perpendicular to the liquid ejection surface 20*a*, and thus the size of the flow-path member 200 when viewed from the top can be reduced.

The Ya-direction width of the vertical flow path 270 may be smaller than the Ya-direction width of the bifurcation flow path 260. In this case, it is possible to further improve the degree of freedom in the arrangement of the vertical flow path 270 and the bifurcation flow path 260 while maintaining the gap V with respect to the opening portion 201, compared to in the case where the Ya-direction width of the vertical flow path 270 is not smaller than the Ya-direction width of the bifurcation flow path 260. In addition, the cross-sectional area of the vertical flow path 270 may be smaller than that of the bifurcation flow path 260. In this case, it is possible to increase the flow velocity of ink in the vertical flow path 270, and thus air bubbles in the vertical flow path 270 can be effectively discharged.

Here, it is assumed that the second flow path 242 is formed in the area P. In this case, the Ya-direction width of the area Q of the flow-path member 200 is increased and the Ya-direction of the area P is reduced, as the flow-path member 200 extends, in the Z direction, away from the head main body 110. Particularly, when it is assumed that the COF substrate 98 is disposed close to the Ya2-side side surface of the connection port 43, the Ya-direction width of the area P is further reduced to maintain a constant Ya-direction width relating to the COF substrate 98. Accordingly, when a side (for example, the Ya2 side) in which the COF substrate 98 is close, in the Ya direction, to the side surface of the connection port 43 and a side (similarly, the Ya2 side) in which the COF substrate 98 is inclined in the Ya direction are the same, the degree of freedom in the arrangement of the second flow path 242 in the area P is reduced. As a result, it is extremely difficult to arrange the second flow path 242. However, in this embodiment, the second bifurcation flow path 262 is formed in the area Q, and thus the degree of freedom in the arrangement of the second bifurcation flow path 262 is increased. As a result, the size of the flow-path member 200 can be reduced in the Ya direction. Furthermore, a side (for example, the Ya1 side) in which the COF substrate 98 is close, in the Ya direction, to the side surface of the connection port 43 and a side (similarly, the Ya2 side) in which the COF substrate 98 is inclined in the Ya direction are not the same. Thus, the degree of freedom in the arrangement of the bifurcation flow path 260 on the side in which the COF substrate 98 is close, in the Ya direction, to that in the side surface of the connection port 43. As a result, the size of the flow-path member 200 can be reduced in the Ya direction.

Meanwhile, it is assumed that the first flow path 241 is formed in the area Q. In this case, although the Ya-direction width of the area Q of the flow-path member 200 is increased as the flow-path member 200 extends, in the Z direction, away from the head main body 110, the first flow path 241 is formed in an area on a side close to the head main body 110. Thus, it is not possible to take full advantage of the area Q of which the width is increased in the Ya direction. Particularly, in a case where it is assumed that, in order to reduce the size in the plane direction of the liquid ejection surface 20*a*, the first distribution flow path 251*a* and the second distribution flow path 252*a* are located at different positions in the Z direction such that both paths overlap in the Z direction and the first distribution flow path 251*b* and the second distribution flow path 252*b* are located at different positions in the Z direction such that both paths overlap in the Z direction, as in the case of this embodiment, when both the first bifurcation flow path 261 and the second bifurcation flow path 262 are formed in the area Q, the degree of freedom in the arrangement of the flow paths is not relatively high, compared to in the case where the second bifurcation flow path 262 is formed in the area Q and the first bifurcation flow path 261 is formed in the area P. However, in this embodiment, the first bifurcation flow path 261 is formed in the area P, and thus the degree of freedom in the arrangement of the first bifurcation flow path 261 is increased. As a result, the size of the flow-path member 200 can be reduced in the Ya direction. Furthermore, in the first distribution flow path 251 and the second distribution flow path 252 which overlap in the Z direction, the first bifurcation flow path 261 of the first distribution flow path 251 and the second bifurcation flow path 262 of the second distribution flow path 252 do not overlap in the Z direction. As a result, the degrees of freedom in the arrangement of the first bifurcation flow path 261 and the second bifurcation flow path 262 is increased, and thus the size of the flow-path member 200 can be reduced in the Ya direction.

Furthermore, in the COF substrate 98 according to this embodiment, the width of the upper end portion 98*d* in a plane direction (in other words, the Xa direction) is smaller than that of the lower end portion 98*c* (see FIG. 16), as described above. The opening portion 201 is formed matched to the COF substrate 98. Accordingly, the width of the upper end portion 98*d* of the COF substrate 98 is reduced in the plane direction, and thus areas W corresponding to the reduced width are provided, in the flow-path member 200, in both areas outside the second opening 216 in the plane direction. The second flow path 242 can be formed in the area W.

In this embodiment, the second distribution flow path 252 and the second bifurcation flow path 262 of the second flow path 242 are formed in both the first flow-path member 210 and the second flow-path member 220. Accordingly, in the first flow-path member 210 and the second flow-path member 220, areas outside the first opening portions 215 and 225 in the Xa direction are the areas W (see FIG. 16). Furthermore, in this embodiment, the first distribution flow path 251 and the second distribution flow path 252 overlap in the Z direction (see FIGS. 14 and 15). In this case, the first distribution flow path 251 and the second distribution flow path 252 may be arranged in a state where, when the first distribution flow path 251 and the second distribution flow path 252 are projected, in the Z direction, onto the liquid ejection surface 20*a*, the projection images do not completely overlap or partially overlap. Alternatively, at least a part of the projection image of the second distribution flow path 252 may be located, in the X direction, further inside the projection image of the first distribution flow path 251, compared to the projection image of the first distribution flow path 251. In other words, the second distribution flow path 252*a* may be formed passing through the areas W. Furthermore, not only the second distribution flow path 252*a* but also the second distribution flow path 252*b* and the second bifurcation flow path 262 may be formed passing through the areas W. In this case, even when the second distribution flow path 252 and the second bifurcation flow path 262 are arranged at positions at which, when viewed from the Z direction, both flow paths interfere with the lower end portion 98*c* as one end portion of the COF substrate 98, the second distribution flow path 252 and the second bifurcation flow path 262 can be prevented from interfering with the COF substrate 98, due to the Z-direction positions of both flow paths.

In the recording head 100 according to this embodiment, the width of the upper end portion 98*d* of the COF substrate 98 is smaller than that of the lower end portion 98*c* and the opening portion 201 is formed matched with the COF substrate 98, as described above. Thus, the area W in which the second flow path 242 is formed can be provided, in the Xa direction, outside the COF substrate 98. The second flow path 242*b* has a similar configuration. As a result, the degree of freedom in the arrangement of the second flow path 242 is further improved in the flow-path member 200.

Furthermore, the COF substrate 98 having the driving circuit 97 mounted thereon is inserted through the opening portion 201 of the flow-path member 200, as illustrated in FIG. 17A. In this embodiment, the driving circuit 97 is provided on the first surface 98*a* side of the COF substrate 98.

In this case, there is a concern that the driving circuit 97 may come into contact with the inner surface of the opening portion 201. Accordingly, the Ya-direction width of the opening portion 201 is increased by the thickness of the driving circuit 97 such that the driving circuit 97 is prevented from coming into contact with the inner surface of the opening portion 201. The Ya-direction width of the opening portion 201 is increased, in such a manner that it is possible to effectively prevent the driving circuit 97 from coming into contact with the inner wall of the opening portion 201. In this case, the driving circuit 97 is disposed at a position at which the driving circuit 97 is accommodated, in the Z direction, in both the second opening portion 225 of the second flow-path member 220 and the third opening portion 235 of the third flow-path member 230. That is, the driving circuit 97 is not disposed at a position at which the driving circuit 97 is accommodated, in the Z direction, in the first opening portion 215 of the first flow-path member 210. Accordingly, in the Ya direction, the width of the first opening portion 215 can be smaller than that of the second opening portion 225 or the third opening portion 235. In other words, an area in which the second flow path 242 is formed can be provided, in the Ya direction, outside the COF substrate 98. As a result, the degree of freedom in the arrangement of the second flow path 242 is further improved in the flow-path member 200.

When it is assumed that the driving circuit 97 is disposed at a position at which the driving circuit 97 is accommodated in the first opening portion 215 of the first flow-path member 210, the Ya-direction width of the first opening portion 215 cannot be reduced. Thus, the degree of freedom in the arrangement of the second flow path 242 cannot be improved in the flow-path member 200.

Meanwhile, in the recording head 100 according to this embodiment, the driving circuit 97 is disposed at the position at which the driving circuit 97 is accommodated, in the Z direction, in both the second opening portion 225 and the third opening portion 235 and the Ya-direction width of the first opening portion 215 is reduced. As a result, the degree of freedom in the arrangement of the second flow path 242, such as the second distribution flow path 252 and the second bifurcation flow path 262, is improved in the flow-path member 200.

Next, the first flow path 241 which is connected, in the area P having a narrow width, to the head main body 110 will be described. The first bifurcation flow path 261 provided in a plane parallel to the liquid ejection surface 20*a* is disposed in the area P having a narrow width. The meaning of "the first flow path 241 is connected, in the area P having a narrow width, to the head main body 110" implies that at least a part of the flow path constituting the first flow path 241 is formed in the area P described above and the part of the flow path is connected to the introduction path 44 of the head main body 110.

The Ya-direction width of the area P having a narrow width is reduced. Thus, in some cases, the area P cannot have a width adequate for providing the first bifurcation flow path 261. However, in this embodiment, the first flow path 241 is disposed, in the Z direction, closer to the head main body 110 side than the second flow path.

Accordingly, even when the Ya-direction width of the area P is reduced due to the inclination of the COF substrate 98, the first flow path 241 is not affected and can be connected to the head main body 110.

In the recording head 100 having the plurality of head main bodies 110, the first distribution flow path 251 and the second distribution flow path 252 are disposed at different positions in the Z direction, as described in Embodiment 1. Accordingly, the size of the flow-path member 200 in the in-plane direction parallel to the liquid ejection surface 20*a* can be reduced, compared to in the case where the first distribution flow path 251 and the second distribution flow path 252 are arranged in the same plane.

Furthermore, in one head main body 110, a plurality of manifolds 95 are arranged in the same plane. Thus, the positions of respective manifolds 95 can be aligned in the Z direction perpendicular to the liquid ejection surface 20*a*, with respect to the liquid ejection surface 20*a*. Accordingly, in different manifolds, the lengths of the flow paths (which are the supply communication paths 19, the pressure generation chambers 12, and the nozzle communication paths 16) extending from respective manifolds 95 to the nozzle openings 21 set to be values which are as similar as possible to each other. As a result, variation in flow-path resistance can be reduced. In other words, variation in pressure of ink in the flow path 240 can be reduced, and thus it is easy to manage a back-pressure control. In addition, variation in the weight of ink droplets ejected from the nozzle opening 21 can be reduced. Ink ejection properties can be stabilized in the recording head 100, as described above.

Furthermore, the first distribution flow path 251*a* and the second distribution flow path 252*a* are formed in the flow-path member 200, in a state where, when viewed from the Z2 side to the Z1 side in the Z direction, at least parts of the first distribution flow path 251*a* and the second distribution flow path 252*a* overlap. The first distribution flow path 251*a* and the second distribution flow path 252*a* overlap in the Z direction, as described above, and the size of the first distribution flow path 251*a* in the in-plane (which is an XY plane) direction of the liquid ejection surface 20*a* and the size of the second distribution flow path 252*a* in the same direction can be reduced, compared to in the case where the distribution flow paths do not overlap. The first distribution flow path 251*b* and the second distribution flow path 252*b* have a similar configuration. As a result, the size of the recording head 100 in the in-plane direction of the liquid ejection surface 20*a* can be reduced.

Furthermore, the first distribution flow path 251 and the second distribution flow path 252 are formed by three members which are the first flow-path member 210, the second flow-path member 220, and the third flow-path member 230. As described above, the first distribution flow path 251 and the second distribution flow path 252 located at different positions in the Z direction can be formed by at least the three members. As a result, the number of parts can be reduced. Needless to say, four or more members may be used for forming the first distribution flow path 251 and the second distribution flow path 252.

Furthermore, in a plan view seen in the Z direction perpendicular to the liquid ejection surface 20*a*, the size of the second vertical flow path 272 in the second flow-path member 220 is smaller than that of the inclined flow path connecting the second distribution flow path 252 and the head main body 110. In other words, the second distribution flow path 252 and the head main body 110 are connected through the second vertical flow path 272, and thus the size of the second flow-path member (in other words, the flow-path member 200) when viewed from the top can be reduced.

Furthermore the vertical flow path 270 extending in the Z direction perpendicular to the liquid ejection surface 20*a* is used as a flow path connecting the distribution flow path 250 and the manifold 95. Accordingly, it is possible to easily adjust the Z-direction gap between the distribution flow path 250 and the manifold 95. Furthermore, liquid is supplied to the manifold 95 through the vertical flow path 270. In other words, when the manifold 95 and the vertical flow path 270 are orthogonally projected onto the liquid ejection surface 20*a*, the projection image of the vertical flow path 270 is smaller than that of the manifold 95. Liquid is supplied through the vertical flow path 270, and thus the flow velocity of liquid in the vertical flow path 270 is increased. As a result, air bubbles in the vertical flow path 270 can be effectively discharged. Furthermore, the distribution flow paths 250 and the manifolds 95 are connected through the first vertical flow path 271 and the second vertical flow path 272. Thus, even when the first distribution flow path 251 and the second distribution flow path 252 are located at different positions in the Z direction, the degree of freedom in the layout of the distribution flow path 250 and the manifold 95 is improved.

Furthermore, the bifurcation flow paths 260 which branch off from the distribution flow path 250 and communicate with the connection portions 290 are provided. Thus, it is possible to provide flow paths which communicate with the connection portions 290 through the bifurcation flow paths 260 branching off from the distribution flow path 250. As a result, flow paths through which ink is supplied to the plurality of head main bodies 110 can be reliably formed in a small space. Furthermore, since the bifurcation flow paths 260 are provided as described above, the positional relationship of the connection portions 290 in a plane, relating to the distribution flow paths 250, can be set with high degrees of freedom. As a result, the degree of freedom in the layout is improved.

In this embodiment, the distribution flow path 250 and the bifurcation flow path 260 can be provided in the same plane, and thus the distribution flow path 250 and the bifurcation flow path 260 can be formed in a common member. Needless to say, the distribution flow path 250 and the bifurcation flow path 260 may not be provided in the same plane and the bifurcation flow path may be inclined with respect to the Z direction.

In this embodiment, the first distribution flow path 251 and the second distribution flow path 252 are connected to one common head main body 110 through the first connection portion 291 and the second connection portion 292. Accordingly, different color inks of which the number (which is four, in this embodiment) is the same as the number of the flow paths 240 can be supplied to one head main body 110. In this embodiment, different color inks flows in the four flow paths 240. However, inks of the same color may flow in the four flow paths. Only one of an black ink Bk, a magenta ink M, a cyan ink C and a yellow ink Y may be supplied to one head main body 110 through flow paths 240 of two systems of the four systems. Even in this case, liquids of predetermined kinds can be ejected from the plurality of head main bodies 110.

In this embodiment, the first connection portions 291*a*2 to 291*a*6 and 291*b*2 to 291*b*6 and the second connection portions 292*a*2 to 292*a*6 and 292*b*2 to 292*b*6 of the flow paths 240 of four systems are provided in areas on both sides of the COF substrate 98 in the Ya direction, in which the COF substrate 98 is inserted through the first opening portion 215, the second opening portion 225, and the third opening portion 235 is interposed between the connection portions. In this case, the COF substrate 98 can be disposed in a portion between two manifolds 95 aligned in the Ya direction. As a result, it is easy to connect the COF substrate 98 and the lead electrode 90 (in other words, the piezoelectric actuator 300). Furthermore, the connection portion 290 is not necessarily connected to the head main body 110 with the COF substrate 98 interposed therebetween.

In this embodiment, the first introduction flow path 281 communicating with the first distribution flow path 251 and the second introduction flow path 282 communicating with the second distribution flow path 252 are provided. Furthermore, the boundary portion between the first distribution flow path 251 and the first introduction flow path 281 and the boundary portion between the second distribution flow path 252 and the second introduction flow path 282 are disposed in an inside portion between the plurality of manifolds 95, in the Y direction in which ink flows in the first distribution flow path 251 and the second distribution flow path 252. "The Y-direction inside portion between the plurality of manifolds 95" means a portion between both Y-direction-end-side manifolds 95 of a plurality of manifolds 95 is provided in the head main body 110. In this embodiment, the six head main bodies 110 have, in total, twelve manifolds 95. The boundary portions described above are located further on an inner side in the Y direction than both end manifolds 95 of the twelve manifolds 95. In the recording head 100 having such a configuration, it is not necessary to arrange the boundary portions outside the manifolds 95. Accordingly, the Y-direction size of the recording head 100 can be reduced. As a result, when the plurality of the recording heads 100 aligned in the Y direction are fixed to the head fixing substrate 102, it is possible to reduce the size of a gap between adjacent recording heads 100 in the Y direction.

Furthermore, in this embodiment, the first flow-path member 210, the second flow-path member 220, and the third flow-path member 230 are disposed in a portion between the relay substrate 140 and the head main body 110. Accordingly, the flow path 240 can be formed in a portion outside the area in which the COF substrate 98 is disposed. As a result, the size of the first flow-path member 210, the second flow-path member 220, and the third flow-path member 230 can be reduced. However, the configuration is not limited thereto.

In this embodiment, the head main body 110 has the manifold 95 which extends in the Xa direction which is a direction along the end portion of the COF substrate 98 bonded to the head main body 110. The liquid supplied to the head main body 110 is stored in the manifold 95. The connection portion 290 is disposed, in the Xa direction, in a portion between the distribution flow path 250 and one of both ends of the manifold 95, which is the end located far away from the distribution flow path 250 (see FIG. 18). In this case, ink can be supplied, in the Xa direction, by the manifold 95. Thus, it is not necessary to dispose the connection portion 290 on a side far away from the distribution flow path 250. As a result, the layout is facilitated. However, the configuration is not limited thereto.

In this embodiment, all of the COF substrates 98 overlap when viewed in a direction in which ink flows in the first distribution flow path 251 or the second distribution flow path 252. The direction is parallel to a direction of an imaginary straight line connecting the start point and the end point of the first distribution flow path 251. In this embodiment, the direction is parallel to the Y direction. The second distribution flow path 252 has a similar configuration. Since the all of the COF substrates 98 overlap, as described above, the distribution flow path 250 can extend, in the Y direction, in a straight line shape. As a result, it is possible to ensure the minimum width of the distribution flow path 250 in the X direction intersecting the Y direction. In addition, all of the COF substrates 98 do not necessarily overlap.

Furthermore, in this embodiment, the first distribution flow path 251 is disposed further on the head main body 110 side in the Z direction perpendicular to the liquid ejection surface 20*a* than the second distribution flow path 252. In the head main body 110, a nozzle row constituted of the nozzle openings 21 which is aligned in the Xa direction as one direction and through which ink is ejected is provided in the liquid ejection surface 20*a*. The Xa direction in which the nozzle rows are aligned intersects the Xa direction which is the transporting direction of the recording sheet S onto which ink is ejected from the head main body 110. The first distribution flow path 251 includes the first distribution flow path 251*a* and the first distribution flow path 251*b*. The first distribution flow path 251*a* (in other words, a first upstream distribution flow path) and the first distribution flow path 251*b* (in other words, a first downstream distribution flow path) are disposed on both sides of the head main body 110 in the X direction. The second distribution flow path 252 includes the second distribution flow path 252*a* and the second distribution flow path 252*b*. The second distribution flow path 252*a* (in other words, a second upstream distribution flow path) and the second distribution flow path 252*b* (in other words, a second downstream distribution flow path) are disposed on both sides of the head main body 110 in the X direction.

The positions of the first distribution flow path 251*a*, the first distribution flow path 251*b*, the second distribution flow path 252*a*, and the second distribution flow path 252*b* with respect to the COF substrate 98, which are illustrated in FIG. 18, are shared in common by all of the head main bodies 110.

According to such a recording head 100, the head main bodies 110 are aligned in the Y direction, in a state where the arrangement of the head main bodies 110 satisfies the positional relationship described above, in such a manner that, even when a specific nozzle row of the head main body is not extended, a line in the Y direction can be formed, without a gap in the line.

Embodiment 2

Figure 20:
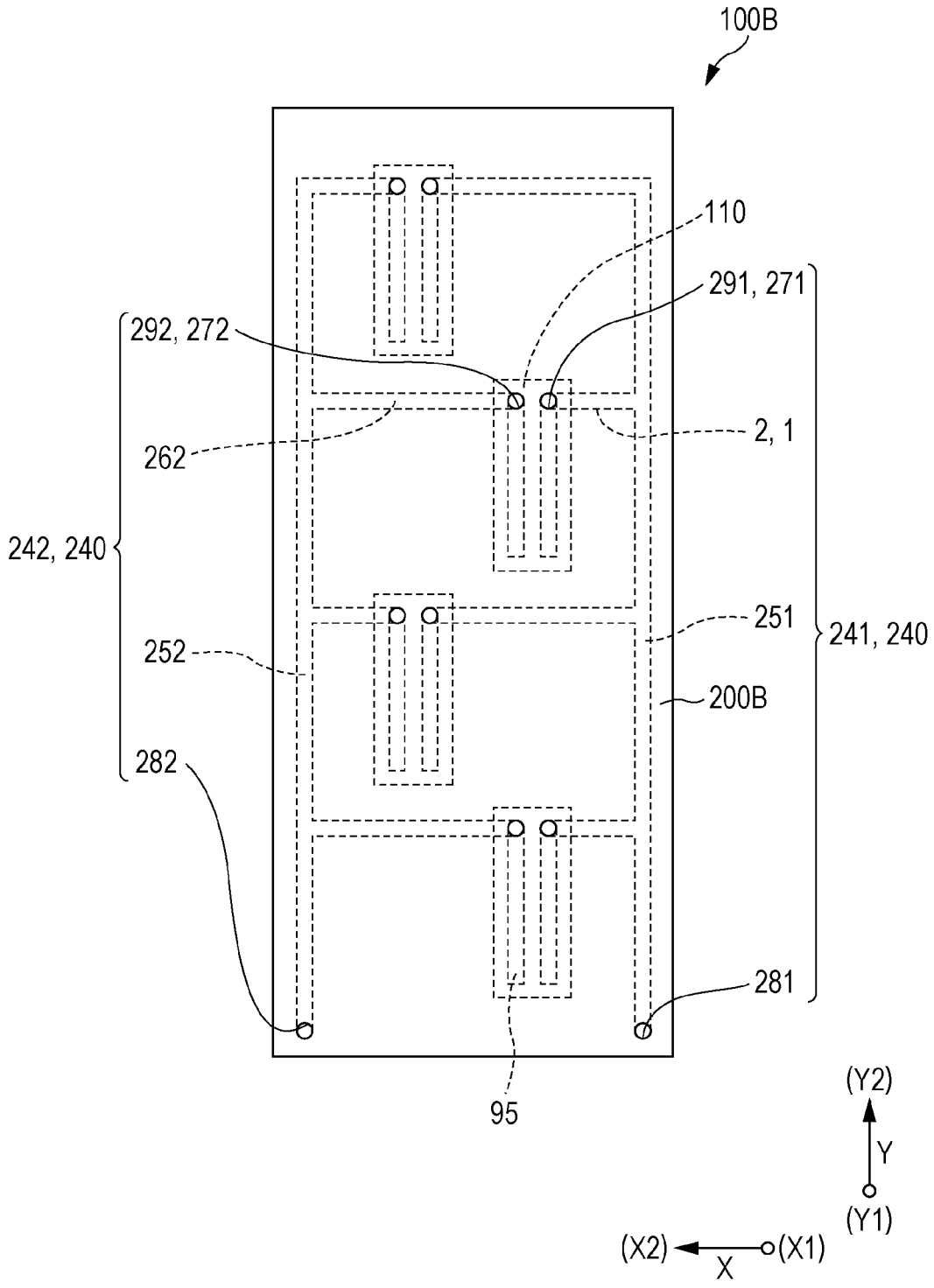
FIG. 20 is a schematic plan view of a recording head according to Embodiment 2.

In the recording head 100 according to Embodiment 1, the head main bodies 110 are aligned to be in one row in the Y direction perpendicular to the X direction as the transporting direction. However, the configuration is not limited thereto. FIG. 20 is a schematic plan view of a recording head 100B according to Embodiment 2. The same reference numerals and letters are given to components of which the configurations are the same as those in Embodiment 1. The descriptions thereof will not be repeated.

In the recording head 100B, the head main bodies 110 are arranged, in a staggered manner, in the Y direction perpendicular to the X direction. A plurality of manifolds 95 of respective head main bodies 110 are arranged in the same plane. The first distribution flow path 251 and the second distribution flow path 252 are not arranged in the same plane.

Even when the head main bodies 110 of the recording head 100B are arranged in a staggered manner, the same effects as those in Embodiment 1 can be obtained.

Embodiment 3

Figure 21:
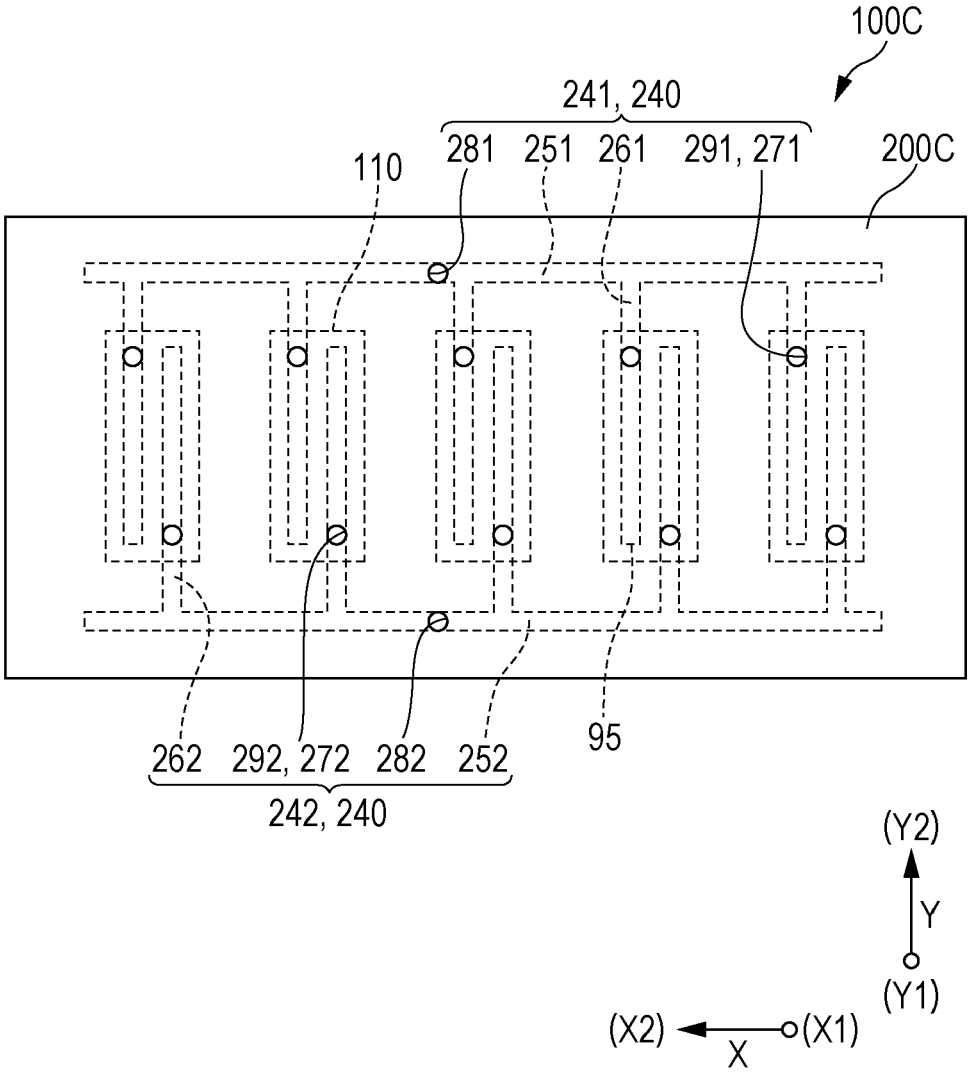
FIG. 21 is a schematic plan view of a recording head according to Embodiment 3.

FIG. 21 is a schematic plan view of a recording head 100C according to Embodiment 3. The same reference numerals and letters are given to components of which the configurations are the same as those in Embodiment 1. The descriptions thereof will not be repeated.

The recording head 100C includes the first introduction flow path 281 communicating with the first distribution flow path 251 and the second introduction flow path 282 communicating with the second distribution flow path 252, as illustrated in FIG. 21. Furthermore, the boundary portion between the first distribution flow path 251 and the first introduction flow path 281 and the boundary portion between the second distribution flow path 252 and the second introduction flow path 282 are disposed in an inside portion between the plurality of manifolds 95, in the X direction in which ink flows in the first distribution flow path 251 and the second distribution flow path 252. "The X-direction inside portion between the plurality of manifolds 95" means a portion between both X-direction-end-side manifolds 95 of a plurality of manifolds 95 provided in head main body 110. In FIG. 21, the five head main bodies 110 have, in total, ten manifolds 95. The boundary portion described above are located further on an inner side in the X direction than both end manifolds 95 of the ten manifolds 95.

In the recording head 100C having such a configuration, it is not necessary to arrange the boundary portions outside the manifolds 95. Accordingly, the X-direction size of the recording head 100C can be reduced.

Furthermore, the first connection portions 291 and the second connection portions 292 are alternately connected to the head main bodies 110 aligned in the X direction in which the first distribution flow path 251 and the second distribution flow path 252 extend. Specifically, in a direction directed from the X2 side to the X1 side in the X direction, ink is supplied from the first distribution flow path 251 to the first manifold 95 through the first connection portion 291. Next, ink is supplied from the second distribution flow path 252 to the subsequent manifold 95 through the second connection portion 292. The remaining manifolds 95 have a similar configuration described above.

Even in the recording head 100C having such a configuration, a plurality of different inks can be supplied to respective head main bodies 110. A configuration is not limited to the configuration in which two different color inks are alternately distributed through both the first distribution flow path 251 and the second distribution flow path 252. Three or more different color inks may be alternately distributed.

Embodiment 4

Figure 22:
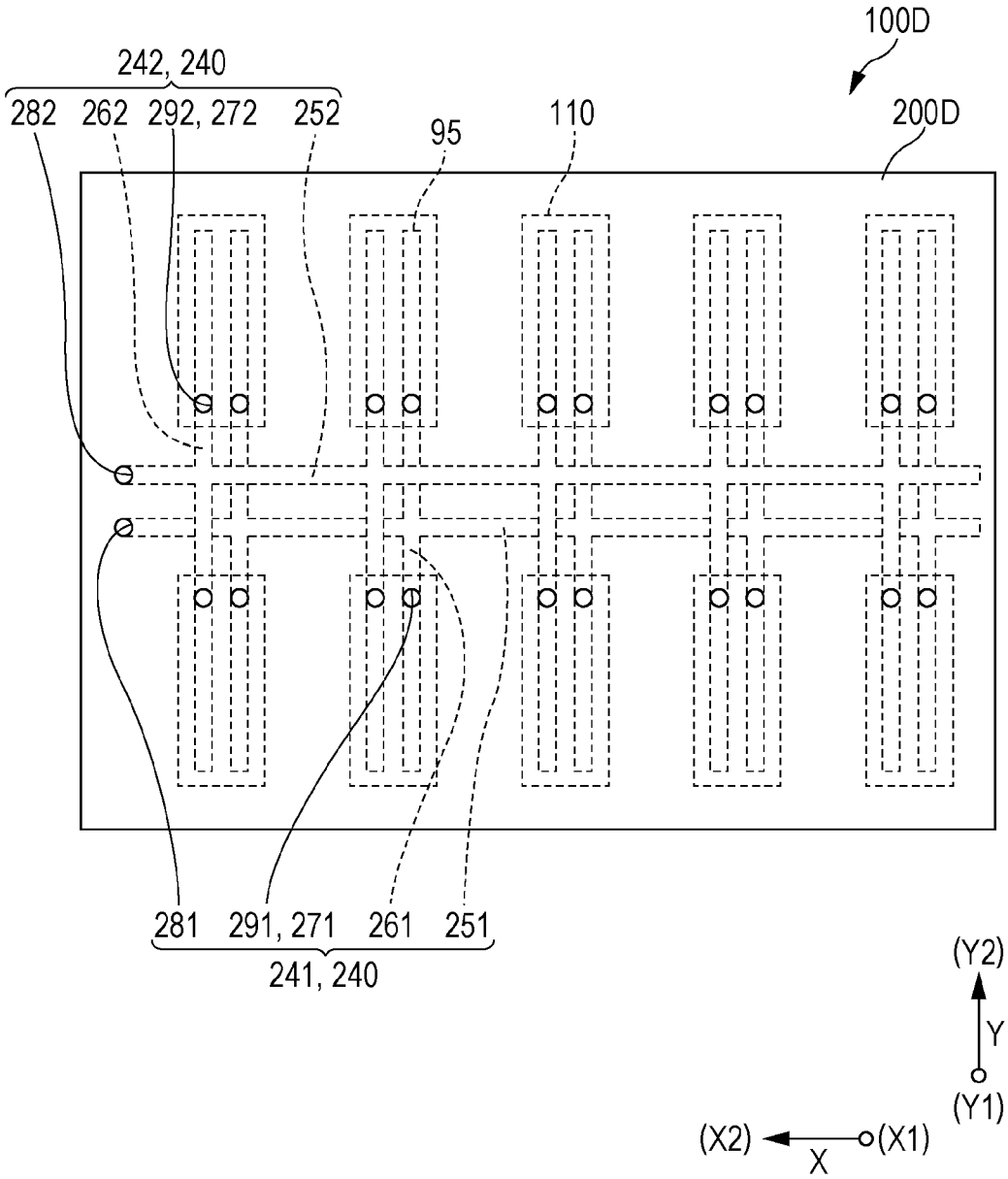
FIG. 22 is a schematic plan view of a recording head according to Embodiment 4.

FIG. 22 is a schematic plan view of a recording head 100D according to Embodiment 4. The same reference numerals and letters are given to components of which the configurations are the same as those in Embodiment 1. The descriptions thereof will not be repeated.

The recording head 100D has a plurality of head main bodies 110 having manifolds 95 extending in the Y direction, as illustrated in FIG. 22. Specifically, two head rows, each of which is constituted of five head main bodies 110 aligned in the X direction, are aligned in the Y direction. The first distribution flow path 251 and the second distribution flow path 252 extend, in the X direction, in a portion between the two head rows.

In other words, in the recording head 100D, the Y direction in which ink flows in the manifold 95 is perpendicular to the X direction in which ink flows in the first distribution flow path 251 and the second distribution flow path 252.

According to the recording head 100D having such a configuration, ink can be effectively supplied over the entirety of a flow-path member 200D when the flow-path member 200D is viewed from the top, compared to in a case where the direction in which ink flows in the manifold 95 is parallel to the direction in which ink flows in the first distribution flow path 251 and the second distribution flow path 252. Furthermore, the size of the distribution flow path 250 can be reduced.

The direction in which ink flows in the distribution flow path 250 is parallel to a direction of an imaginary straight line connecting the start point and the end point of the distribution flow path 250.

Furthermore, the direction in which ink flows in the manifold 95 is parallel to the direction in which the pressure generation chambers 12 of the head main bodies 110 are aligned.

A configuration is not limited to the configuration in which the direction in which ink flows in the manifold 95 is perpendicular to the direction in which ink flows in the first distribution flow path 251 and the second distribution flow path 252. Any configuration may be applied as long as the two directions intersect each other.

Embodiment 5

Figure 23:
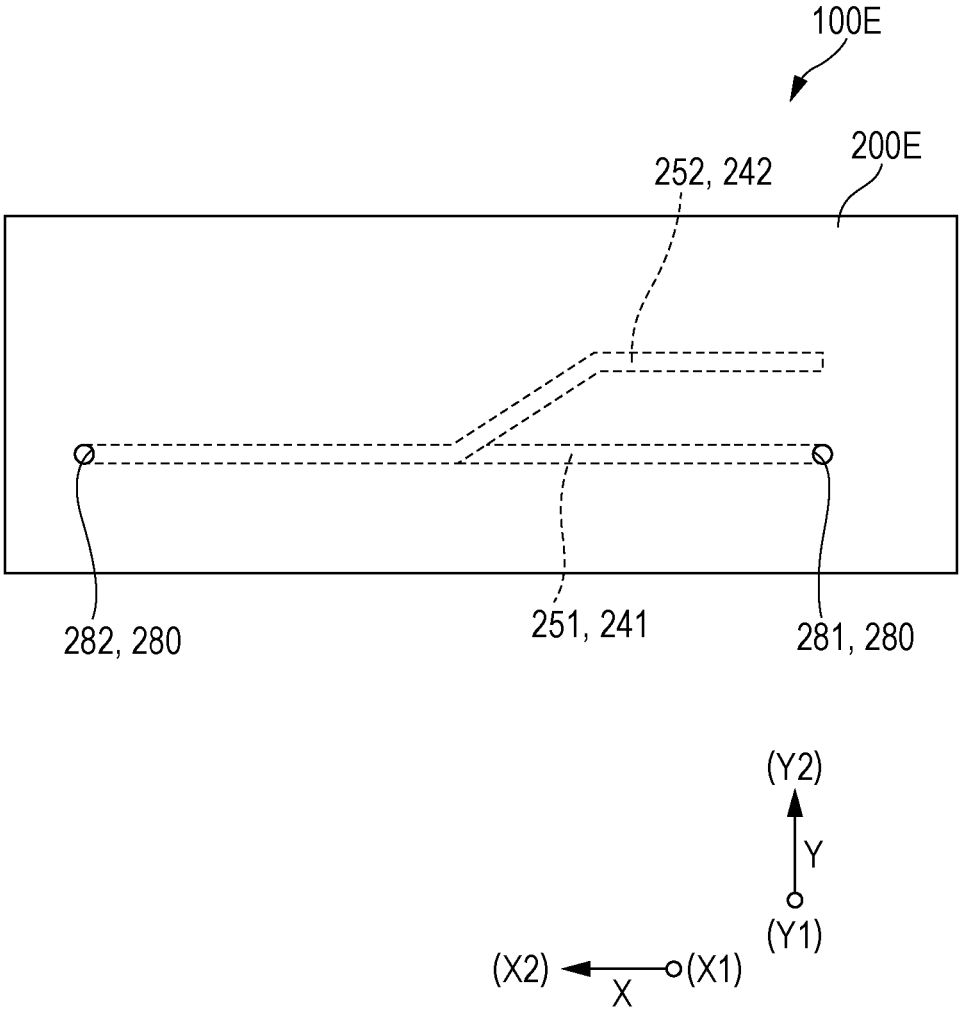
FIG. 23 is a schematic plan view of a recording head according to Embodiment 5.

FIG. 23 is a schematic plan view of a recording head 100E according to Embodiment 5. The same reference numerals and letters are given to components of which the configurations are the same as those in Embodiment 1. The descriptions thereof will not be repeated. The head main body 110 is not illustrated in FIG. 23.

The second distribution flow path 252 extends from the second introduction flow path 282 to the X1 side in the X direction, as illustrated in FIG. 23. The middle portion of the second distribution flow path 252 is bent such that the second introduction flow path 282 does not meet the first introduction flow path 281. In other words, in the recording head 100E, the second distribution flow path 252 is formed in a state where the second distribution flow path 252 makes a detour to avoid the first introduction flow path 281. Since the second distribution flow path 252 is formed in a state where the second distribution flow path 252 makes a detour to avoid the first introduction flow path 281, as described above, the degrees of freedom in the arrangement of the first introduction flow path 281 is improved.

Other Embodiments

Hereinbefore, the embodiments of the invention are described. However, the basic configuration of the invention is not limited thereto.

When the nozzle rows a and b of each head main body 110 of the recording head 100 of Embodiment 1 extend in the Xa direction and the Xa direction are inclined with respect to the X direction as the transporting direction, the X direction and the Xa direction may intersect at an angle greater than 0° and less than 90°. However, the invention also includes the recording head 100 having a configuration in which the X direction and the Xa direction do not intersect. In other words, in a recording head, the head main body 110 may have a configuration in which the Xa direction as a direction of the nozzle row is perpendicular to the X direction as the transporting direction. In this case, the Xa direction is parallel to the Y direction and the Ya direction is parallel to the X direction. Accordingly, in the recording head 100 of Embodiment 1, the size in the Ya direction is reduced. However, in the recording head 100 having the configuration in which the Ya direction is parallel to the X direction, the size thereof can be reduced in the X direction, in other words, the transporting direction of the recording sheet S, which is parallel to the Ya direction.

In the recording head 100 according to Embodiment 1, the COF substrate 98 is inclined with respect to the Z direction. However the configuration is not limited thereto. In other words, the COF substrate 98 may be arranged parallel to the Z direction.

In the recording head 100 according to Embodiment 1, the first flow path 241 and the second flow path 242 are provided and the first distribution flow path 251 and the second distribution flow path 252 are located at different positions in the Z direction. However, the configuration is not limited thereto. A recording head may include a flow-path member in which flow paths parallel to the liquid ejection surface 20*a* are provided in, for example, only the same plane. According to the embodiment described above, a recording head may have a configuration in which only second flow path is provided in a flow-path member including the first flow-path member 210 and the second flow-path member 220. In the case of the recording head in which either the first flow path 241 or the second flow path 242 is not provided, as described above, the Z-direction size of the recording head 100 can be reduced.

In the recording head 100 according to Embodiment 1, the introduction paths 44*c*, 44*d*, 44*a*, and 44*b* are respectively connected to the first flow path 241*a*, the first flow path 241*b*, the second flow path 242*a*, and the second flow path 242*b*. However, the configuration is not limited thereto. The introduction paths 44*c* and 44*b* may be respectively connected to the first flow path 241*a* and the first flow path 241*b* and the introduction paths 44*a* and 44*d* may be connected to the second flow paths 242*a* and 242*b*. In this case, the recording head may a configuration in which only a second flow path is provided and a first flow path is not provided, as described above. Therefore, the optimal flow paths corresponding to, for example, the arrangement of the head main bodies 110 can be provided.

The second flow path 242 is formed by causing the first flow-path member 210 and the second flow-path member 220 to adhere to each other and the first flow path 241 is formed by causing the second flow-path member 220 and the third flow-path member 230 to adhere to each other. However, the method of forming the first flow path 241 and the second flow path 242 is not limited thereto. The first flow path 241 and the second flow path 242 may be integrally formed, without causing two or more flow-path member to adhere to each other, by a lamination forming method allowing three-dimensional forming. Alternatively, each flow-path member may be formed by three-dimensional forming, molding (for example, injection molding), cutting, pressing.

The flow-path member 200 has, as the first flow path 241, two flow paths which are the first flow path 241*a* and the first flow path 241*b*. However, the number of first flow paths is not limited thereto. One first flow path may be provided or three or more first flow paths may be provided. The second flow path 242 has a similar configuration described above.

The first distribution flow path 251*a* branches into the six first bifurcation flow paths 261*a*. However, the configuration is not limited thereto. The first distribution flow path 251*a* may be connected to one head main body 110, without being branched off. The number of branched-out flow paths is not limited to six and may be two or more. The first distribution flow path 251*b*, the second distribution flow path 252*a*, and the second distribution flow path 252*b* have a similar configuration described above. The number of the COF substrates 98 inclined in the direction directed to the first surface 98*a* side is not limited to six. Only some of the COF substrates 98 may be inclined.

The first distribution flow path 251*a* is a flow path through which ink horizontally flows in a portion between the second flow-path member 220 and the third flow-path member 230. However, the configuration is not limited thereto. In other words, the first distribution flow path 251*a* may be a flow path inclined with respect to a Z plane. The first distribution flow path 251*b*, the second distribution flow path 252*a*, and the second distribution flow path 252*b* have a similar configuration.

Furthermore, the first vertical flow path 271*a* is perpendicular to the liquid ejection surface 20*a*. However, the configuration is not limited thereto. In other words, the first vertical flow path 271*a* may be inclined with respect to the liquid ejection surface 20*a*. The first vertical flow path 271*b*, the second vertical flow path 272*a*, and the second vertical flow path 272*b* have a similar configuration.

It is not necessary to set the Xa-direction width of the second opening 216 of the opening portion 201 in the flow-path member 200 to be smaller than that of the first opening 236. The second opening 216 and the first opening 236 may be openings of which the Xa-direction widths are substantially the same and which allow the rectangular-shaped COF substrate 98 to be accommodated therein. On the contrary, the Xa-direction width of the second opening 216 may be greater than that of the first opening 236.

The COF substrate 98 is provided as a flexible wiring substrate. However, a flexible print substrate (FPC) may be used as the COF substrate 98. Furthermore, even when the COF substrate 98 is disposed not close to the Ya1-side side surface of the connection port 43, this configuration can be applied as long as the COF substrate 98 and the lead electrode 90 are electrically connected to each other.

In Embodiment 1, the holding member 120 and the flow-path member 200 are fixed using, for example, an adhesive. However, the holding member 120 and the flow-path member 200 may be integrally formed. In other words, both the hold portion 121 and the leg portion 122 may be provided on the Z1 side of the flow-path member 200. Accordingly, the holding member 120 is not stacked in the Z direction, the Z-direction size of the flow-path member 200 can be reduced. Furthermore, since the hold portion 121 is provided in the flow-path member 200, the size of the flow-path member 200 in both the X direction and in the Y direction can be reduced because it is necessary for the flow-path member 200 to accommodate only a plurality of head main bodies 110 and it is not necessary for the flow-path member 200 to accommodate the relay substrate 140. Furthermore, a plurality of members are integrally formed, and thus the number of parts can be reduced. When the flow-path member 200 is constituted of the first flow-path member 210, the second flow-path member 220, and the third flow-path member 230, both the hold portion 121 and the leg portion 122 may be provided on the Z1 side of the third flow-path member 230.

In Embodiment 1, the head main bodies 110 are aligned in the Y direction and the plurality of head main bodies 110 constitutes the recording head 100. However, the recording head 100 may be constituted of one head main body 110. Furthermore, the number of the recording heads 100 provided in the head unit 101 is not limited. Two or more recording heads 100 may be mounted or one single recording head 100 may be mounted in the ink jet type recording apparatus 1.

The ink jet type recording apparatus 1 described above is a so-called line type recording apparatus in which the head unit 101 is fixed and only the recording sheet S is transported, in such a manner that printing is performed. However, the configuration is not limited thereto. The invention can be applied to a so-called serial type recording apparatus in which the head unit 101 and one or a plurality of recording heads 100 are mounted on a carriage, the head unit 101 or the recording head 100 moves in a main scanning direction intersecting the transporting direction of the recording sheet S, and the recording sheet S is transported, in such a manner that printing is performed.

The invention is intended to be applied to a general liquid ejecting head unit. The invention can be applied to a liquid ejecting head unit which includes a recording head of, for example, an ink jet type recording head of various types used for an image recording apparatus, such as a printer, a coloring material ejecting head used to manufacture a color filter for a liquid crystal display or the like, an electrode material ejecting head used to form an electrode for an organic EL display, a field emission display (FED) or the like, or a bio-organic material ejecting head used to manufacture a biochip.

A wiring substrate of the invention is not intended to be applied to only a liquid ejecting head and can be applied to, for example, a certain electronic circuit.

What is claimed is:

1. A liquid ejecting head comprising:

a head main body which ejects liquid from a liquid ejection surface and has a plurality of manifolds which store the liquid and are in communication with pressure generation chambers; and a flow-path member upstream of the head main body in which a first distribution flow path and a second distribution flow path are provided to supply the liquid to the plurality of manifolds of the head main body, wherein the plurality of manifolds are arranged on the same plane and each of the plurality of manifolds, the first distribution flow path, and the second distribution flow path are not disposed in the same plane.

2. The liquid ejecting head according to claim 1, wherein at least parts of the first distribution flow path and the second distribution flow path overlap when viewed from a direction perpendicular to the liquid ejection surface.

3. A liquid ejecting apparatus comprising:

the liquid ejecting head according to claim 2.

4. The liquid ejecting head according to claim 1, further comprising:

a first introduction flow path which communicates with the first distribution flow path; and a second introduction flow path which communicates with the second distribution flow path, wherein the first introduction flow path and the second introduction flow path extends to a side opposite to the head main body, in a direction perpendicular to the liquid ejection surface, and wherein a boundary portion between the first distribution flow path and the first introduction flow path and a boundary portion between the second distribution flow path and the second introduction flow path are disposed between the plurality of manifolds, in a direction in which ink flows in the first distribution flow path and the second distribution flow path.

5. The liquid ejecting head according to claim 4, wherein, in a direction perpendicular to the liquid ejection surface, the first distribution flow path is disposed closer to the head main body than the second introduction flow path, and wherein the second distribution flow path is spaced from the first introduction flow path.

6. A liquid ejecting apparatus comprising:

the liquid ejecting head according to claim 4.

7. The liquid ejecting head according to claim 1, wherein the flow-path member is formed by stacking a first flow-path member, a second flow-path member, and a third flow-path member, in the direction perpendicular to the liquid ejection surface, in order, far away from the head main body, wherein the first distribution flow path is formed in a boundary between the second flow-path member and the third flow-path member, and wherein the second distribution flow path is formed in a boundary between the first flow-path member and the second flow-path member.

8. The liquid ejecting head according to claim 1, wherein a direction in which liquid flows in the manifold intersects a direction in which liquid flows in the first distribution flow path and the second distribution flow path.

9. The liquid ejecting head according to claim 1, wherein a nozzle row constituted of a plurality of nozzle openings which are aligned in one direction and through which liquid is ejected is provided in the liquid ejection surface, wherein the manifold extends in the one direction, and wherein a vertical flow path extending in a direction perpendicular to the liquid ejection surface allows the manifold to communicate with the first distribution flow path and the second distribution flow path.

10. The liquid ejecting head according to claim 1, wherein the first distribution flow path is formed in a first plane, and wherein the second distribution flow path is formed in a second plane, the first plane being different from the second plane.

11. The liquid ejecting head according to claim 1, wherein a first connection portion and a second connection portion are connected to a common head main body.

12. The liquid ejecting head according to claim 11, further comprising a plurality of other head main bodies each with a liquid ejection surface, a plurality of other first connection portions, and a plurality of other second connection portions, wherein the plurality of other first connection portions and the plurality of other second connection portions are alternately connected to the plurality of other head main bodies aligned in a direction in which the first distribution flow path and the second distribution flow path extend.

13. The liquid ejecting head according to claim 12, further comprising:

a relay substrate to which a plurality of flexible wiring substrates are connected, each of the plurality of flexible wiring substrates being bonded to one of the head main body and the plurality of other head main bodies, wherein the flow-path member is provided in a portion between the relay substrate and the head main body and the plurality of other head main bodies, in a direction in which the plurality of flexible wiring substrates extend to the flow-path member side with respect to the head main body and the plurality of other head main bodies.

14. The liquid ejecting head according to claim 12, wherein all of the plurality of flexible wiring substrates connect to the plurality of other head main bodies, each of which communicates with one of a plurality of other first distribution flow paths and one of a plurality of other second distribution flow paths and overlap when viewed from a direction in which liquid flows in the plurality of other first distribution flow paths or the plurality of other second distribution flow paths.

15. The liquid ejecting head according to claim 12, wherein the first distribution flow path is located further on the head main body side in a direction perpendicular to the liquid ejection surface than the second distribution flow path, wherein nozzle rows constituted of nozzle openings which are aligned in one direction and through which liquid is ejected are provided in the liquid ejection surface of the head main body and the liquid ejection surface of the plurality of other head main bodies, wherein the one direction in which the nozzle rows are aligned intersects a transporting direction of an ejection target medium onto which liquid is ejected by the head main body and the plurality of other head main bodies, wherein the first distribution flow path includes a first upstream-side distribution flow path and a first downstream-side distribution flow path which are disposed on both sides of the head main body and the plurality of other head main bodies in the transporting direction, wherein the second distribution flow path includes a second upstream-side distribution flow path and a second downstream-side distribution flow path which are disposed on both sides of the head main body and the plurality of other head main bodies in the transporting direction, and wherein the positions of the first upstream distribution flow path, the first downstream-side distribution flow path, the second upstream-side distribution flow path, and the second downstream-side distribution flow path, in relation to the plurality of flexible wiring substrates, are common to all of the plurality of other head main bodies and the head main body.

16. The liquid ejecting head according to claim 1, wherein the head main body has the manifold which extends in one direction along an end portion of a flexible wiring substrate, which is the end portion bonded to the head main body, and which stores liquid supplied to the head main body, and wherein a first connection portion and a second connection portions are disposed in a portion between one of both ends of the manifold, which is the end far away, in the one direction, from the distribution flow path, and the distribution flow path.

17. The liquid ejecting head according to claim 1, wherein the first distribution flow path is located closer to the head main body side in a direction perpendicular to the liquid ejection surface than the second distribution flow path, wherein a flexible wiring substrate is constituted of one end portion which is located, in a direction perpendicular to the liquid ejection surface, close to the head main body and the other end portion which is located far away from the head main body, wherein the plane-direction width of the other end portion is smaller than that of the one end portion, and wherein the second distribution flow path is formed in the flow-path member, in a state where the second distribution flow path passes through an area outside the other end portion in the plane direction.

18. A liquid ejecting apparatus comprising:

the liquid ejecting head according to claim 1.

* * * * *